US007650689B2

(12) United States Patent
Furuya et al.

(10) Patent No.: US 7,650,689 B2
(45) Date of Patent: Jan. 26, 2010

(54) TERMINAL INSERTING DEVICE

(75) Inventors: Hiroshi Furuya, Shizuoka (JP); Kazuhiko Sugimura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 520 days.

(21) Appl. No.: 11/496,460

(22) Filed: Aug. 1, 2006

(65) Prior Publication Data

US 2007/0022600 A1 Feb. 1, 2007

(30) Foreign Application Priority Data

Aug. 1, 2005 (JP) ..... 2005-223477

(51) Int. Cl.
*H01R 43/20* (2006.01)

(52) U.S. Cl. ..... 29/749; 29/33 M; 29/754; 29/759

(58) Field of Classification Search ..... 29/33 M, 29/593, 747, 748, 759, 845, 881, 884, 749, 29/754
See application file for complete search history.

(56) References Cited

U.S. PATENT DOCUMENTS 4,835,844 A * 6/1989 Gerst et al. ..... 29/747

FOREIGN PATENT DOCUMENTS

JP 2000-357577 12/2000

* cited by examiner

*Primary Examiner*—A. Dexter Tugbang
*Assistant Examiner*—Livius R Cazan
(74) *Attorney, Agent, or Firm*—Kratz, Quintos & Hanson, LLP.

(57) ABSTRACT

A terminal inserting device is provided, by which pulling force to pull a terminal fitting can be changed after the terminal fitting is inserted. The terminal inserting device includes an inserting unit and a control device. The inserting unit includes a front chuck unit and electric wire chuck unit, by which an electric wire is chucked and a terminal fitting attached to the electric wire is inserted into a terminal-receiving chamber of a connector housing. The electric wire chuck unit includes a pair of electric wire chucks, an insertion motor and an air cylinder. The electric wire chucks chuck the electric wire therebetween. The insertion motor pulls the terminal fitting after the terminal fitting is inserted in the terminal-receiving chamber. The air cylinder changes force which brings the pair of the electric wire chucks close to the connector housing so that pulling force to pull the terminal fitting can be changed. The control device controls the air cylinder to change the pulling force.

4 Claims, 38 Drawing Sheets

TERMINAL INSERTING DEVICE

BACKGROUND OF THE INVENTION (1) Field of the Invention

The present invention relates to a terminal inserting device, by which terminal fittings attached to electric wires are inserted into terminal-receiving chambers of a connector housing.

(2) Description of the Related Art

Terminal fittings attached to electric wires are inserted in order into terminal-receiving chambers of a connector housing, thereby assembling a wiring harness to be mounted on a motor vehicle as a mobile unit. In order to insert the terminal fittings into the terminal-receiving chambers of the connector housing, so far various terminal inserting devices have been used (for example, see Japanese Patent Application Laid-Open No. 2000-357577).

A terminal inserting device disclosed in Japanese Patent Application Laid-Open No. 2000-357577 includes a device body, a plurality of holding jigs as housing holding means, a rod as electric wire holding means, and an inserting head as terminal inserting means. The device body is placed on a floor in a plant.

The holding jigs are attached to the device body and attach the connector housing thereto. A plurality of the holding jigs are lined up on a straight line. The inserting head takes out the electric wire from the rod and inserts the terminal fitting attached to the electric wire into the terminal-receiving chamber of the connector housing.

In the terminal inserting device, the inserting head takes out in order the electric wire from the rod and inserts the terminal fitting attached to the electric wire into the terminal-receiving chamber of the connector housing held by the holding jigs. Thus, the terminal inserting device assembles the wiring harness.

In the terminal inserting device described above, the terminal fittings are inserted in the connector housing and thereafter, the electric wires attached to the terminal fittings are pulled so that it is confirmed whether or not the terminal fittings are attached to the connector housing on a desired condition. At that time, the pulling force is determined according to article numbers of the terminal fittings.

Therefore, it is desired that pulling force for pulling the terminal fitting is changed depending on the article numbers of the terminal fittings.

SUMMARY OF THE INVENTION

It is therefore an objective of the present invention to solve the above problem and to provide a terminal inserting device, by which pulling force to pull the terminal fitting can be changed after the terminal fitting is inserted.

In order to attain the above objective, the present invention is to provide a terminal inserting device for inserting terminal fittings attached to electric wires into terminal-receiving chambers of a connector housing, including:

terminal inserting means for inserting the terminal fittings attached to the electric wires into the terminal-receiving chambers of the connector housing;

electric wire holding means for holding the electric wire, the electric wire holding means being movable together with the terminal inserting means;

pulling means for pulling the electric wire after the terminal inserting means inserts the terminal fitting in the terminal-receiving chamber;

changing means for changing pulling force with which the pulling means pulls the electric wire; and control means for controlling the changing means to change the pulling force according to article numbers of the terminal fittings.

With the construction described above, since there are provided the changing means for changing pulling force with which the pulling means pulls the electric wire and the control means for controlling the changing means, therefore the pulling force with which the pulling means pulls the electric wire can be changed according to article numbers of the terminal fittings after the terminal fittings are inserted.

Preferably, the changing means includes:

a body which leaves the connector housing when the pulling means pulls the electric wire; and a retractable member which is retractable from the body toward the connector housing, attaches the electric wire holding means thereto, and changes biasing force for biasing the electric wire holding means toward the connector housing, and the control means controls the retractable member to change the biasing force according to the article numbers of the terminal fittings.

With the construction described above, since the changing means includes the retractable member, which is retractable from the body that moves relatively to the connector housing with the pulling means and biases the electric wire holding means toward the connector housing, therefore the electric wire is pulled with a force difference between the pulling force and the biasing force. Accordingly, force to pull the electric wire can be finely changed in comparison with a case in which only the pulling force itself to pull the electric wire is changed and therefore, the force to pull the electric wire can be set close to a desired force.

Preferably, pressurized fluid is supplied into the body of the changing means and pressure of the pressurized fluid is changed so that the retractable member changes the biasing force.

With the construction described above, since the control means controls the retractable member to change the biasing force for biasing the electric wire holding means, therefore the force for pulling the electric wire can be securely changed.

Preferably, the pressurized fluid is air.

With the construction described above, the changing means is an air cylinder in which the retractable member is moved by the pressure of pressurized air. Therefore, the force to pull the electric wire can be changed with a simple and inexpensive construction and the electric wire can be pulled with a desired force.

DESCRIPTION OF THE PREFERRED EMBODIMENTS

Figure 10:
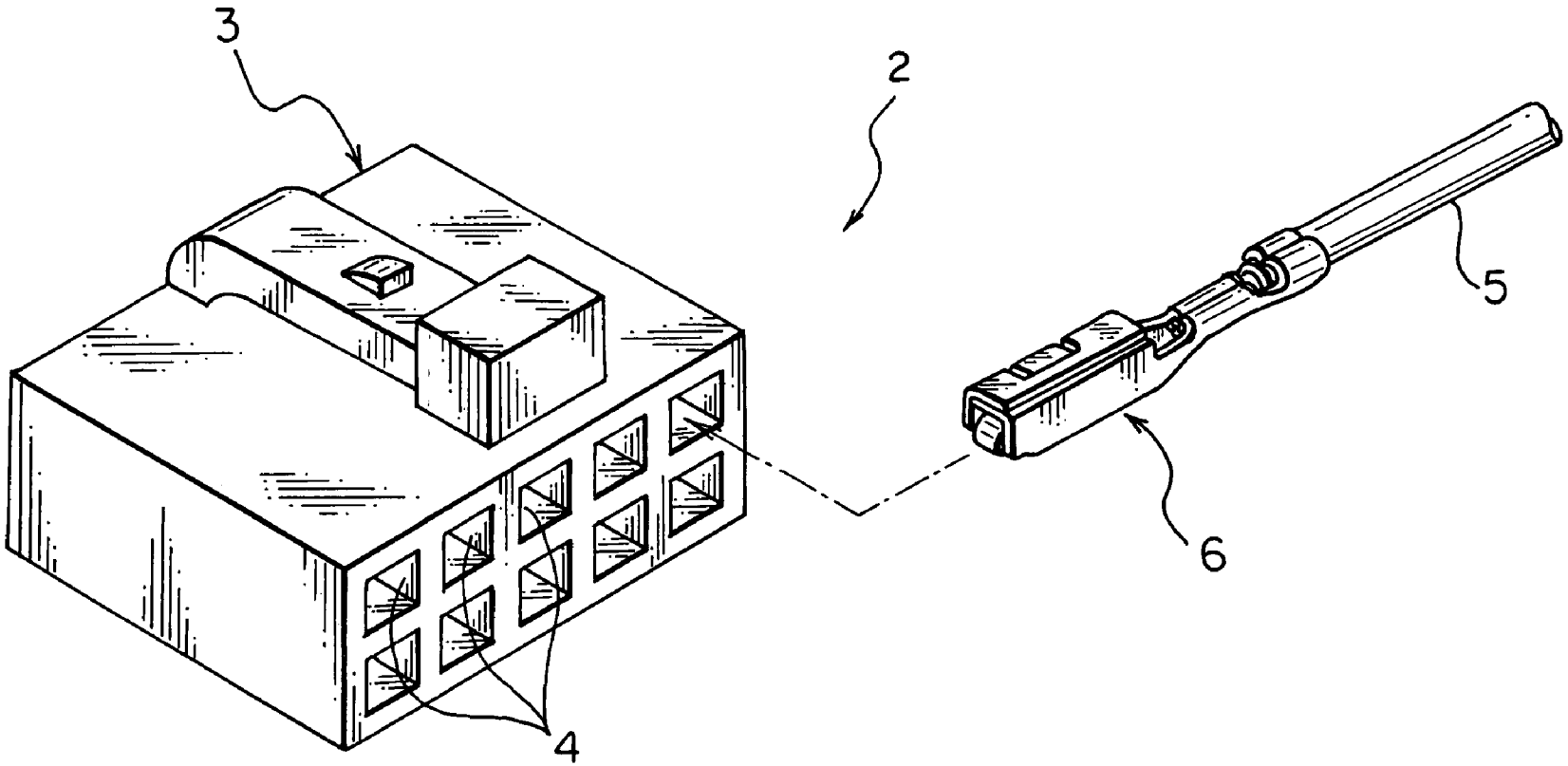
FIG. 10 is a perspective view illustrating a connector housing into which terminal fittings are inserted in the terminal inserting device shown in FIG. 1.

In the following, a terminal inserting device 1 according to a preferred embodiment of the present invention will be explained with reference to FIGS. 1-40. The terminal inserting device 1 (shown in FIG. 1) is, for example, a device for inserting terminal fittings 6 attached to electric wires 5 into respective terminal-receiving chambers 4 of a connector housing 3 of a connector 2 shown in FIG. 10.

The connector housing 3 is made of electrically insulating synthetic resin and formed in a box-shape. The connector housing 3 includes a plurality of terminal-receiving chambers 4. The terminal-receiving chamber 4 is a hole (space) extending straight and penetrating through the connector housing 3. The terminal-receiving chamber 4 receives the terminal fitting 6 attached to the electric wire 5.

The terminal fitting 6 is attached to the electric wire 5. The electric wire 5 is a so-called coated wire including an electrically conductive core wire and an electrically insulating coating.

In the connector housing 3, the terminal fittings 6 attached to the respective electric wires 5 are received in the respective terminal-receiving chambers 4, thereby constructing the connector 2. The connector 2 is coupled with a mating connector or the like, thereby constructing a wiring harness which is mounted on a motor vehicle and so on. Either the terminal-receiving chamber 4 or the terminal fitting 6 has a locking arm which engages with the other. When the locking arm engages with the other, the connector housing 3 and the terminal fitting 6 attached to the electric wire 5 are fixed to each other. If the article number of the connector 2 is different, an external form of the connector housing 3 is different, for example, in terms of the number and/or positions of the terminal-receiving chamber 4.

Further, if the article number of the connector 2 is different, that is, if the article number of the terminal fitting 6 and the article number of the connector housing 3 are different, of course, a size and a form of the locking arm described above are different. Further, as for the connector 2 described above, after the terminal fitting 6 is inserted in the terminal-receiving chamber 4 of the connector housing 3, in order to confirm whether or not the locking arm engages, the electric wire 5 to which the terminal fitting 5 is attached is pulled in a direction reverse to the insertion direction of the terminal fitting 5. At that time, pulling force to pull the electric wire 5 differs depending on the article number of the connector 2, that is, the article number of the terminal fitting 6 and the article number of the connector housing 3.

Figure 1:
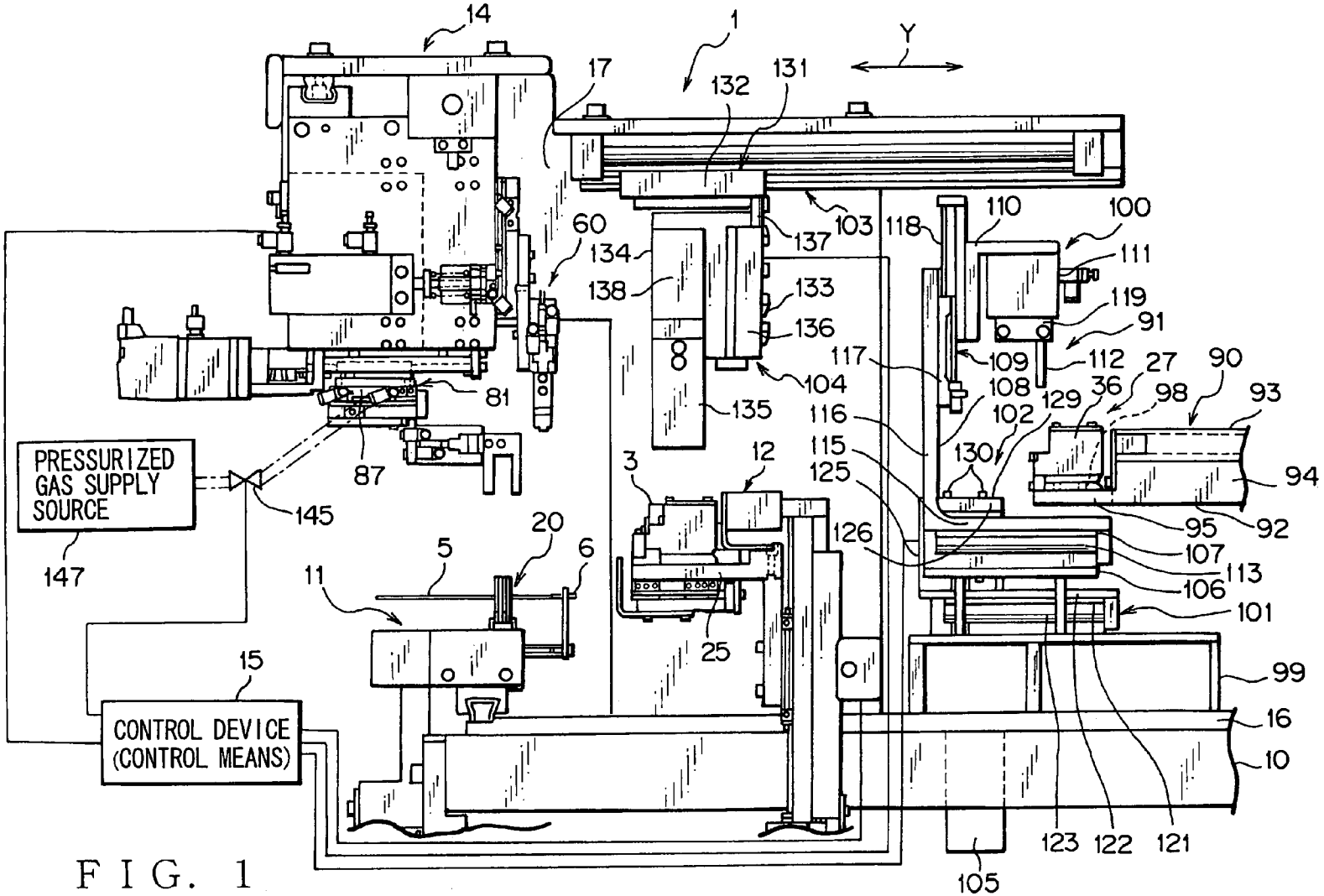
FIG. 1 is a side view illustrating a construction of a terminal inserting device according to a preferred embodiment of the present invention.

As shown in FIG. 1, the terminal inserting device 1 includes a device body 10, a jig placing unit 90 as a jig placing part, a jig conveying unit 91 as a jig conveying means, an electric wire holding unit 11, a housing holding unit 12, a guide unit 13 (shown in FIG. 5) as a guide means, an inserting unit 14, and a control device 15 as a control means.

The device body 10 is placed on a floor and so on in a plant. The device body 10 includes a table 16 having a flat upper surface extending in a horizontal direction, a rising-up pole 17, and a rising-up plate 18. The pole 17 and the plate 18 rise upward from the upper surface of the table 16.

Figure 2:
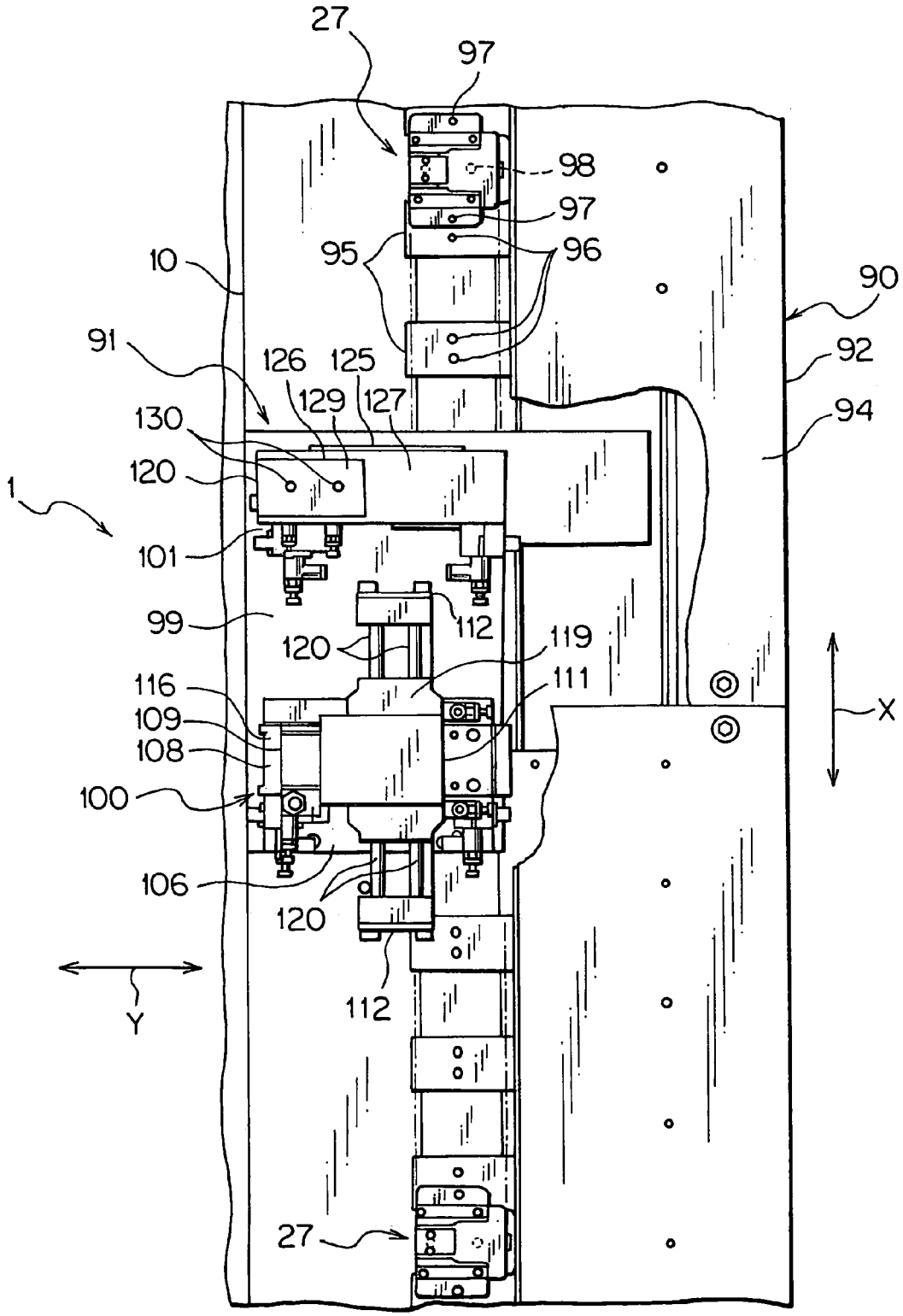
FIG. 2 is a plan view illustrating a jig conveying unit of the terminal inserting device shown in FIG. 1.

As shown in FIGS. 1 and 2, the jig placing unit 90 includes a jig placing bed 92 attached to the device body 10 and a housing feeding part 93 (shown in FIG. 1). As shown in FIG. 2, the jig placing bed 92 includes a mount 94 to be attached to the device body 10 and a plurality of jig placing parts 95. The mount 94 extends straight. The jig placing parts 95 protrude from the mount 94 toward the inserting unit 14 and lined up in the longitudinal direction of the mount 94 being spaced from one another. On the jig placing parts 95, positioning pins 96 for positioning a holding jig 27 protrude upward. A lifting base 126 (explained later on) of a jig lifting unit 102 can enter into between the jig placing parts 95 adjacent to each other from below.

The housing feeding part 93 is provided correspondingly to each holding jig 27 to be placed on the jig placing bed 92. The housing feeding part 93 is formed in a tube-shape and receives the connector housing 3, which is held by the holding jig 27, therein.

Figure 4:
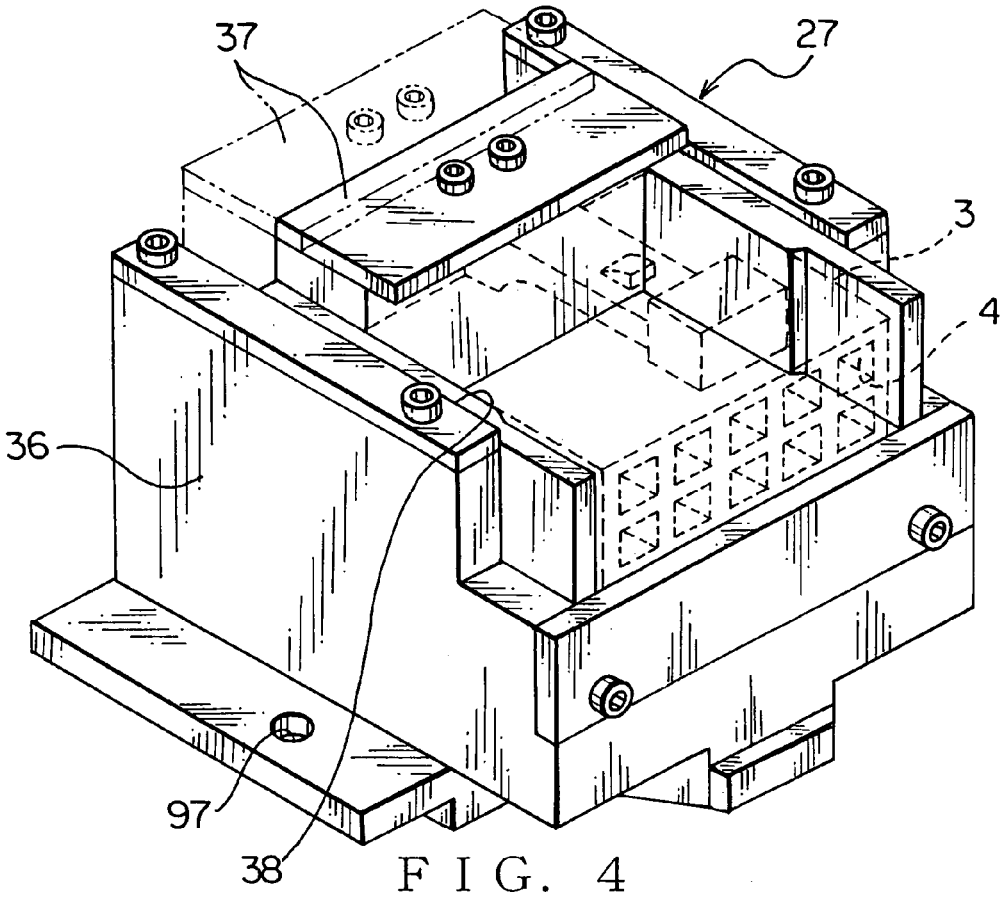
FIG. 4 is a perspective view illustrating a holding jig and so on of the terminal inserting device shown in FIG. 1.
Figure 9:
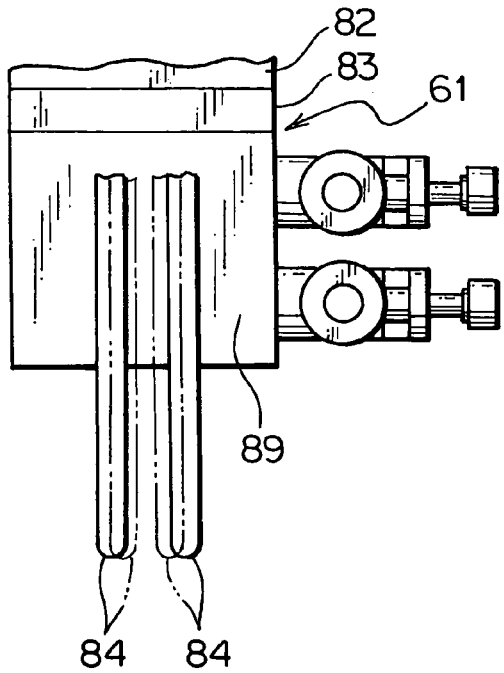
FIG. 9 is a front view illustrating an electric wire chuck of the terminal inserting device shown in FIG. 1.

As shown in FIG. 4, the holding jig 27 includes a rectangular parallelopiped-shaped jig body 36, a slide member 37 and a coil spring (not shown in the figure) as a bias means. The jig body 36 is provided with a notch 38 corresponding to an external form of the slide member 37.

The slide member 37 is provided within the notch 38. The slide member 37 is slidably supported by the jig body 36 in a direction in which the slide member 37 approaches and leaves the electric wire holding unit 11. As shown by solid lines in FIG. 4, when the slide member 37 approaches the electric wire holding unit 11, the slide member 37 puts the connector housing 3 between the slide member 37 and the jig body 36, thereby preventing the connector housing 3 from coming out from the notch 38 from an upper surface-side of the jig body 36.

As shown by alternate long and two short dashes lines in FIG. 4, when the slide member 37 leaves the electric wire holding unit 11, it is allowed that the connector housing 3 comes out from the notch 38 of the slide member 37 and comes off from the jig body 36. Here, a state shown by the solid lines in FIG. 4 is called a coming-off preventing state, while a state shown by the alternate long and two short dashes lines in FIG. 4 is called a coming-off allowing state. The coil spring biases the slide member 37 so as to open the notch 38.

Thus, the holding jig 27 can move in a range between the coming-off allowing state in which the connector housing 3 is allowed to come off from the holding jig 27 and the coming-off preventing state in which the connector housing 3 is prevented from coming off from the holding jig 27.

The holding jig 27 is provided with a plurality of positioning holes 97, 98 for positioning. The positioning holes 97 are formed in side edges of the jig body 36 of the holding jig 27 penetrating through the side edges. The positioning holes 98 are formed hollow from a bottom surface of the jig body 36 of the holding jig 27.

An external form of the holding jig 27 is preferably the same even if an article number of the connector housing 3, which is held by the holding jig 27, is different. If an article number of the connector housing 3, which is held by the holding jig 27, is different, a shape of the notch 38 of the holding jig 27 is different.

The jig placing bed 92 places a plurality of the holding jigs 27 thereon on a condition that the holding jig 27 rides the jig placing parts 95 adjacent to each other. At that time, the positioning pin 96 enters into the positioning hole 97 of the holding jig 27. Since the mount 94 extends straight and the jig placing parts 95 are lined up in the longitudinal direction of the mount 94 being spaced from one another, therefore the jig placing unit 90 lines up a plurality of the holding jigs 27 spaced from one another along the horizontal direction and along an arrow X (shown in FIG. 2) as the straight first direction. The arrow X is parallel to both the direction in which a plurality of the holding jigs 27 are lined up and the longitudinal direction of the mount 94 of the jig placing bed 92.

Figure 3:
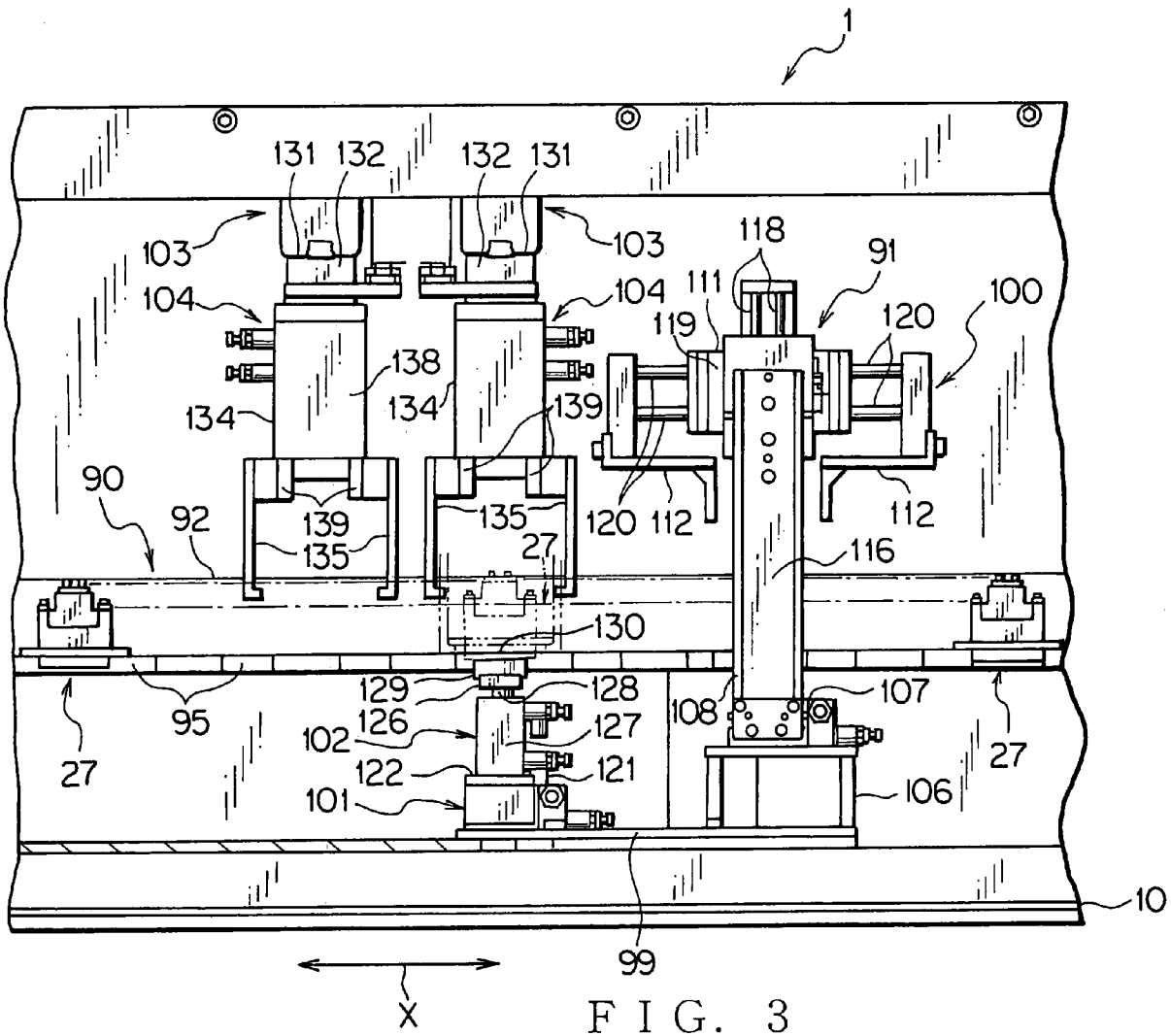
FIG. 3 is a front view illustrating a jig conveying unit of the terminal inserting device shown in FIG. 1.

As shown in FIGS. 2 and 3, the jig conveying unit 91 includes a movable table 99, a housing conveying unit 100, a slide unit 101, a jig lifting unit 102 as a pulling-out means, a second slide unit 103, and a jig grasping unit 104 as a grasping means.

The movable table 99 is provided between the mount 94 of the jig placing bed 92 of the jig placing unit 90 and the housing holding unit 12. The movable table 99 is movable along the arrow X by a motor 105 (shown in FIG. 1) attached to a device body 10, a pair of pulleys rotatably provided at both ends in the direction of the arrow X of the device body 10, and an endless belt suspended to the pair of the pulleys. The endless belt circulates between the pair of the pulleys by a rotation drive force of the motor 105 so that the movable table 99 moves along the arrow X.

As shown in FIGS. 1-3, the housing conveying unit 100 includes a support base 106, slide cylinder 107, support part 108, elevating cylinder 109, elevating plate 110, chuck cylinder 111 and a pair of housing chucks 112. The support base 106 is placed on and attached to the movable table 99.

The slide cylinder 107 includes a cylinder body 113 and a rod 114 (shown in FIG. 12) which can extend and contract from the cylinder body 113. The cylinder body 113 is attached on the support base 106 in such a way that the extended rod 114 approaches the jig placing unit 90. The longitudinal direction of the rod 114 and the extending or contracting direction of the rod 114 are along an arrow Y (shown in FIGS. 1 and 2) as the second direction, which crosses at right angles the arrow X and is parallel to the horizontal direction.

The support part 108 includes a flat plate part 115 and rising-up part 116. The flat plate part 115 is attached to the rod 114 of the slide cylinder 107. The rising-up part 116 extends (i.e. rises up) upward from the flat plate part 115. The elevating cylinder 109 includes a cylinder body 117 and a rod 118 which can extend and contract from the cylinder body 117. The cylinder body 117 is attached to an upper end of the rising-up part 116 of the support part 108 in such a way that the extended rod 118 faces upward.

The elevating plate 110 is attached to the rod 118 of the elevating cylinder 109. The chuck cylinder 111 includes a cylinder body 119 and an approaching-and-leaving rod 120 which protrudes from the cylinder body 119. The cylinder body 119 is attached to the elevating plate 110. The approaching-and-leaving rod 120 protrudes from the cylinder body 119 toward both directions of the arrow X.

The pair of the approaching-and-leaving rods 120 extends or contracts from the cylinder body 119 within a range between the position shown by the solid lines in FIG. 3 and the position shown by the alternate long and two short dashes lines in FIG. 3 so as to approach or leave each other. The housing chucks 112 are attached to the approaching-and-leaving rods 120. When the pair of the housing chucks 112 approach each other, the pair of the housing chucks 112 puts the connector housing 3 situated in the housing feeding part 93 therebetween.

In the housing conveying unit 100, the rod 118 of the elevating cylinder 109 extends and the rod 114 of the slide cylinder 107 extends, and the chuck cylinder 111 is situated above the housing feeding part 93. In the housing conveying unit 100, the rod 118 of the elevating cylinder 109 contracts on a condition that the approaching-and-leaving rods 120 of the chuck cylinder 111 part away from each other, so that the chuck cylinder 111 approaches the housing feeding part 93. Then, in the housing conveying unit 100, the approaching-and-leaving rods 120 of the chuck cylinder 111 approach each other so as to put the connector housing 3 situated in the housing feeding part 93 between the housing chucks 112.

In the housing conveying unit 100, the rod 118 of the elevating cylinder 109 contracts so as to pull out the chucked connector housing upward from the housing feeding part 93. In the housing conveying unit 100, the rod 114 of the slide cylinder 107 contracts, thereafter the rod 118 of the elevating cylinder 109 contracts so as to insert the chucked connector housing 3 into the notch 38 of the holding jig 27 placed on the jig placing unit 90. In the housing conveying unit 100, the approaching-and-leaving rods 120 of the chuck cylinder 111 part away from each other, thereafter the rod 118 of the elevating cylinder 109 extends so as to part the chuck cylinder 111 from the holding jig 27. Thus, the housing conveying unit 100 conveys the connector housing 3 from the housing feeding part 93 to the holding jig 27.

As shown in FIG. 2, the slide unit 101 is lined up along the arrow X together with the housing conveying unit 100. As shown in FIG. 1, the slide unit 101 includes a slide cylinder 121 and a slide plate 122. The slide cylinder 121 includes a cylinder body 123 and a rod 124 (shown in FIG. 19) which can extend and contract from the cylinder body 123. The cylinder body 123 is attached to the movable table 99 in such a way that the extended rod 124 approaches the jig placing unit 90. The longitudinal direction of the rod 124 and the extending or contracting direction of the rod 124 are along the arrow Y as the second direction, which crosses at right angles the arrow X and is parallel to the horizontal direction. The slide plate 122 is attached to the rod 124 of the slide cylinder 121. Thus, the slide plate 122 is movable along the arrows X and Y.

As shown in FIG. 3, the jig lifting unit 102 includes an elevating cylinder 125 and a lifting base 126. The elevating cylinder 125 is placed on the slide plate 122. Therefore, as shown in FIG. 2, the jig lifting unit 102 is lined up along the arrow X together with the housing conveying unit 100. The elevating cylinder 125 includes a cylinder body 127 and a rod 128 which can extend and contract from the cylinder body 127. The cylinder body 127 is attached to the slide plate 122 in such a way that the extended rod 128 faces upward.

The lifting base 126 is attached to the rod 128 of the elevating cylinder 125. The lifting base 126 includes a base body 129, an upper surface of which is flat along the horizontal direction, and a positioning pin 130 protruding from the base body 129. When the rod 124 of the slide cylinder 121 extends and the rod 128 of the elevating cylinder 125 extends, the lifting base 126 enters between the jig placing parts 95 adjacent to each other of the jig placing unit 90, so that the holding jig 27 is placed on the base body 129 of the lifting base 126.

In the jig lifting unit 102, when the rod 128 of the elevating cylinder 125 contracts and the rod 124 of the slide cylinder 121 extends, the lifting base 126 enters in between the jig placing parts 95 adjacent to each other. In the jig lifting unit 102, the rod 128 of the elevating cylinder 125 extends, the holding jig 27 is placed on the base body 129 of the lifting base 126 and further, the base body 129 of the lifting base 126 lifts the holding jig 27 upward. Then, the positioning pin 96 of the jig placing unit 90 comes out from the positioning hole 97 of the holding jig 27 and the positioning pin 130 of the lifting base 126 enters into the positioning hole 98 of the holding jig 27.

Thereafter, the jig lifting unit 102 contracts the rod 124 of the slide cylinder 121, so that the holding jig 27 is pulled out to the side of the housing holding unit 12 from the jig placing unit 90. Thus, the jig lifting unit 102 is movable along both the arrow X and the arrow Y. The jig lifting unit 102 enters below the jig placing bed 92 of the jig placing unit 90 so as to lift one holding jig 27 of a plurality of the holding jigs 27 placed on the jig placing bed 92 and to take out the one holding jig 27 from the jig placing bed 92.

As shown in FIGS. 1 and 3, the second slide unit 103 includes a slide cylinder 131. The slide cylinder 131 includes a cylinder body 132, which is formed on an upper end of the rising-up plate 18 of the device body 10 and is slidable along the arrow Y.

As shown in FIGS. 1 and 3, the jig grasping unit 104 includes an elevating cylinder 133, a chuck cylinder 134, and a pair of jig chucks 135. The elevating cylinder 133 includes a cylinder body 136 and a rod 137 which can extend and contract from the cylinder body 136. The cylinder body 136 is placed in such a way that the extending rod 137 faces upward. The rod 137 is attached to the cylinder body 132 of the slide cylinder 131.

The chuck cylinder 134 includes a cylinder body 138 and a pair of approaching-and-leaving rods 139. In the cylinder body 138, the pair of approaching-and-leaving rods 139 protrudes downward from the cylinder body 138 and the pair of approaching-and-leaving rods 139 is placed along the arrow X spaced from each other. The cylinder body 138 is attached to the cylinder body 136 of the elevating cylinder 133. The pair of the jig chucks 135 is attached to the respective approaching-and-leaving rods 139. When the jig chucks 135 approach to each other, the jig chucks 135 put the holding jig 27 held by the lifting base 126 or the housing holding unit 12 therebetween.

The jig grasping unit 104 is movable along the arrow Y as the second direction. As explained later on, the jig grasping unit 104 approaches one holding jig 27 lifted on the lifting base 126 by the jig lifting unit 102 from above and grasps the one holding jig 27 with the jig chuck 135. Then, the jig grasping unit 104 conveys the grasped holding jig 27 to the housing holding unit 12.

As explained later on, the jig grasping unit 104 is held by the housing holding unit 12 and approaches the holding jig 27 in which all desired terminal fittings 6 are inserted in the held connector housing 3 from above so as to grasp the one holding jig 27 with the jig chuck 135. Then, the jig grasping unit 104 conveys the grasped holding jig 27 to the lifting base 126 of the jig lifting unit 102.

A pair of the second slide units 103 and a pair of the jig grasping units 104 are provided. The pair of the jig grasping units 104 is lined up along the arrow X. The jig grasping unit 104 situated at the right side in FIG. 3 conveys the holding jig 27 from the lifting base 126 of the jig lifting unit 102 to the housing holding unit 12. While the jig grasping unit 104 situated at the left side in FIG. 3 conveys the holding jig 27 from the housing holding unit 12 to the lifting base 126 of the jig lifting unit 102.

When the jig grasping unit 104 conveys the holding jig 27 from the lifting base 126 of the jig lifting unit 102 to the housing holding unit 12, first, the rod 137 of the elevating cylinder 133 is contracted and rod 137 of the elevating cylinder 133 is extended on a condition that the lifting base 126 of the jig lifting unit 102 is positioned below one jig grasping unit 104. At that time, the approaching-and-leaving rods 139 of the chuck cylinder 134 are kept away from each other. Then, the approaching-and-leaving rods 139 of the chuck cylinder 134 approach to each other so as to put (i.e. chuck) the holding jig 27 between the pair of the jug chucks 135.

Thereafter, the jig grasping unit 104 contracts the rod 137 of the elevating cylinder 133, then moves the cylinder body 132 of the slide cylinder 131 along the arrow Y so as to position the chucked holding jig 27 above the housing holding unit 12. Then, the rod 137 of the elevating cylinder 133 is extended so as to place the chucked holding jig 27 on the housing holding unit 12 and to part the approaching-and-leaving rods 139 of the chuck cylinder 134 away from each other. Thereafter, the rod 139 of the elevating cylinder 133 is contracted. Thus, the jig grasping unit 104 conveys the holding jig 27 from the jig lifting unit 102 to the housing holding unit 12.

The jig grasping unit 104 conveys the holding jig 27 from the housing holding unit 12 to the lifting base 126 of the jig lifting unit 102, that is, acts reversely to the case that the jig grasping unit 104 conveys the holding jig 27 from the lifting base 126 of the jig lifting unit 102 to the housing holding unit 12.

Figure 5:
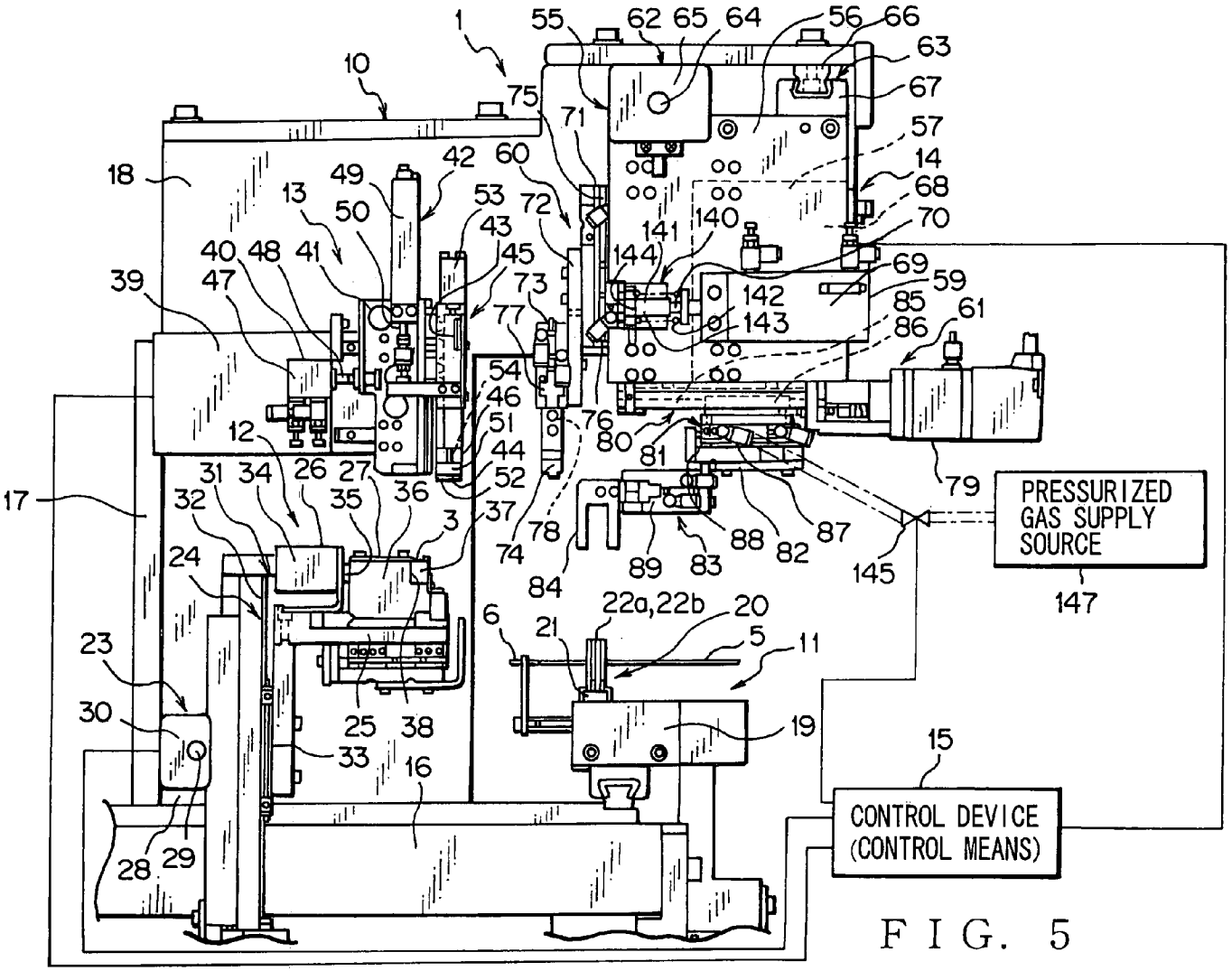
FIG. 5 is a side view illustrating a partial construction of the terminal inserting device shown in FIG. 1.
Figure 6:
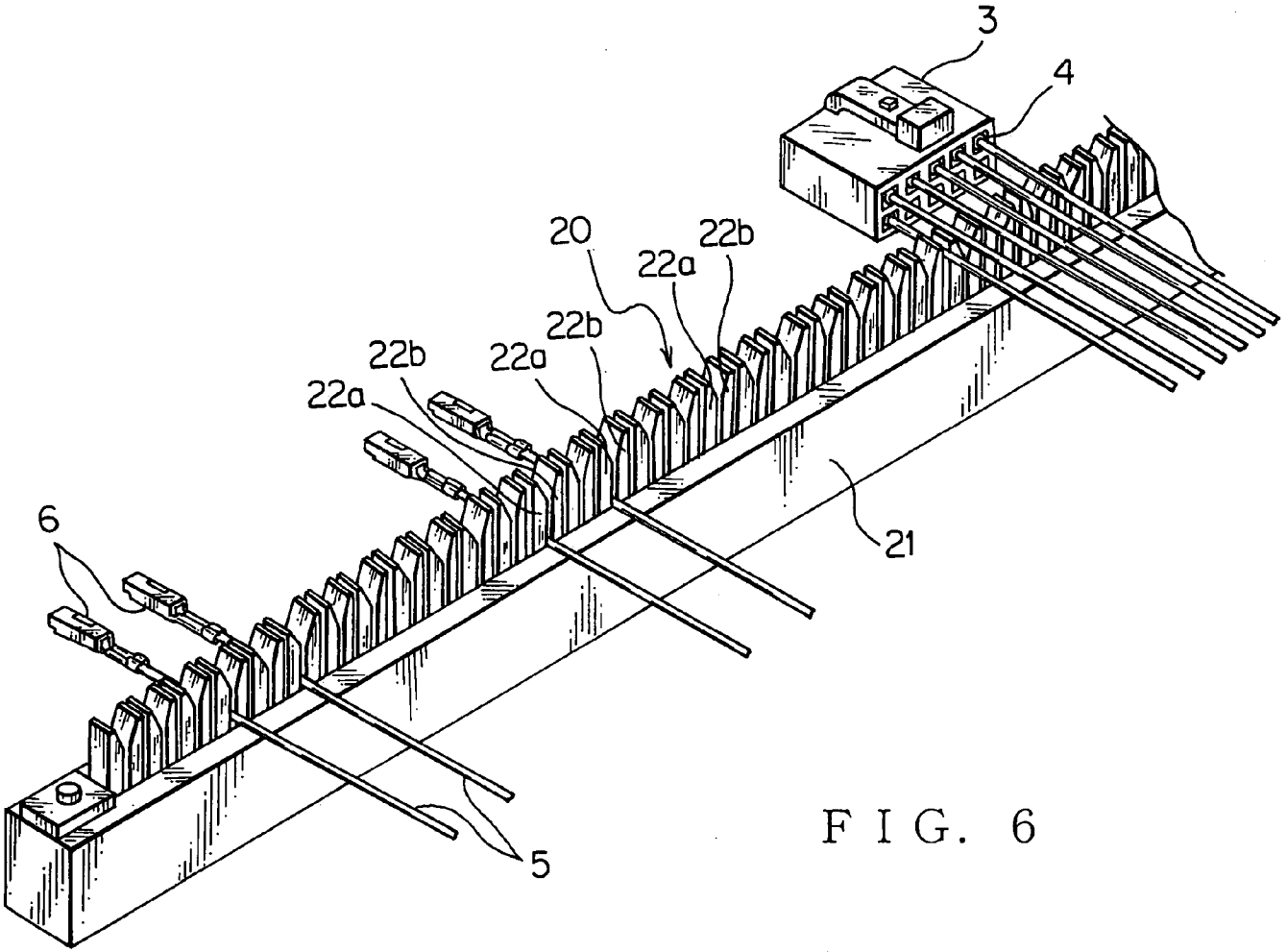
FIG. 6 is a perspective view illustrating a rod and so on of the terminal inserting device shown in FIG. 1.

As shown in FIGS. 5 and 6, the electric wire holding unit 11 includes a unit body 19 and a rod 20 detachable from the unit body 19. The unit body 19 is attached to a table 16 of the device body 10. The unit body 19 is formed in a rod (pole) shape, the longitudinal direction of which is parallel to the horizontal direction. The longitudinal direction of the unit body 19 is parallel to a direction from the depth to the front or a direction from the front to the depth in FIG. 5.

As shown in FIG. 6, the rod 20 includes a bar-shaped rod body 21 and a plurality of pairs of nipping members 22*a* and 22*b* rising up from the rod body 21. The rod body 21 is detachable from the unit body 19. The rod body 21 is attached to the unit body 19 on a condition that the longitudinal direction of the rod body 21 is parallel to the longitudinal direction of the unit body 19.

The nipping members 22*a* and 22*b* are supported by the rod body 21 movably in a direction in which the nipping members 22*a* and 22*b* approach and leave each other. The nipping members 22*a* and 22*b* are biased in the direction in which the nipping members 22*a* and 22*b* approach and leave each other. The nipping members 22*a* and 22*b* are arranged adjacently to each other in the longitudinal direction of the rod body 21. A plurality of the pairs of the nipping members 22*a* and 22*b* are lined up along the longitudinal direction of the rod body 21. The nipping members 22*a* and 22*b* nip (put) the electric wire 5 therebetween.

The electric wire holding unit 11 puts the electric wire 5, to which the terminal fitting 6 before its insertion to the terminal-receiving chamber of the connector housing 3 is attached, between the nipping members 22*a* and 22*b* so as to hold the electric wire 5, that is, to hold the connector housing 3.

As shown in FIG. 5, the housing holding unit 12 includes a horizontal moving unit 23, an elevating unit 24 as an elevating supporting unit, a supporting table 25, a connector fixing cylinder 26 as a connector fixing means, and a holding jig 27 as a housing holding means.

The horizontal moving unit 23 includes a motor (not shown in the figure) and a ball screw 28. The motor is attached to the device body 10. The ball screw 28 includes a screw shaft 29 and a nut 30. The screw shaft 29 is rotatably supported by the device body 10 on a condition that the longitudinal direction of the screw shaft 29 is parallel to the horizontal direction. The screw shaft 29 is rotated by the motor around a shaft axis thereof.

The longitudinal direction of the ball screw 29 is parallel to a direction from the depth to the front or a direction from the front to the depth in FIG. 5. The nut 30 screw-engages with the screw shaft 29. The elevating unit 24 is attached to the nut 30, that is, the holding jig 27 is attached to the nut 30. The horizontal moving unit 23 conveys the nut 30 in the longitudinal direction of the ball screw 29 by rotation drive force of the motor, that is, the horizontal moving unit 23 conveys the holding jig 27 in the longitudinal direction of the ball screw 29 by rotation drive force of the motor.

The elevating unit 24 includes a motor (not shown in the figure) and a ball screw 31. The motor is attached to the nut 30. The ball screw 31 includes a screw shaft 32 and a nut 33. The screw shaft 32 is rotatably supported by the nut 30 on a condition that the longitudinal direction of the screw shaft 32 is parallel to the vertical direction. The screw shaft 32 is rotated by the motor around a shaft axis thereof. The nut 33 screw-engages with the screw shaft 32. The support table 25 is attached to the nut 33, that is, the holding jig 27 held on the support table 25 is attached to the nut 33. The elevating unit 24 moves the holding jig 27 held on the support table 25 in the longitudinal direction of the screw shaft 32 by the rotation drive force of the motor. Thus, the elevating unit 24 elevatingly supports the holding jig 27 held on the support table 25.

The support table 25 is attached to the nut 33 of the elevating unit 24. The support unit 25 extends toward the electric wire holding unit 11 in the horizontal direction from the nut 33 of the elevating unit 24.

The connector fixing cylinder 26 includes a cylinder body 34 attached to a support table 25 and a rod 25 formed stretchable from the cylinder body 34. The cylinder body 34 is attached to the support table 25 in such a way that the longitudinal direction of the rod 35 is parallel to the horizontal direction and that when the rod 35 extends the cylinder body 34 approaches the electric wire holding unit 11. When the rod 35 extends, the rod 35 presses a slide member 37 (explained later on) of the holding jig 27 against bias force of a coil spring. When the rod 35 extends, the connector fixing cylinder 26 maintains the holding jig 27 in a coming-off preventing state (explained later on).

When the rod 35 contracts, the rod 35 ceases to press the slide member 37 of the holding jig 27. When the rod 35 contracts, the connector fixing cylinder 26 maintains the holding jig 27 in a coming-off allowing state (explained later on). Thus, the connector fixing cylinder 26 is elevatingly supported together with the holding jig 27 by the elevating unit 24 and displaces the holding jig 27 in a range between the coming-off preventing state and the coming-off allowing state.

When the terminal fitting 6 is inserted into the terminal-receiving chamber 4 of the connector housing 3, the housing holding unit 12 positions the holding jig 27, which is held on the support table 25 by the elevating unit 24, above. When the terminal fitting 6 is inserted into the terminal-receiving chamber 4 of the connector housing 3, in the housing holding unit 12, the connector fixing cylinder 26 maintains the holding jig 27 in the coming-off preventing state, that is, fixes the connector housing 3 to the holding jig 27.

In the housing holding unit 12, when all of the terminal fittings 6 are inserted into the respective terminal-receiving chambers 4 of the connector housing 3 (that is, when the last terminal fitting is inserted), the connector fixing cylinder 26 displaces the holding jig 27 into the coming-off allowing state. Then, the elevating unit 24 brings the holding jig 27 down on a condition that an electric wire chuck unit 61 grasps the electric wire 5 attached to the terminal fitting 6 that is last inserted in the terminal-receiving chamber 4. The housing holding unit 12 takes the connector housing 3 out from the holding jig 27.

As shown in FIG. 5, the guide unit 13 includes a body plate 39, front-and-rear cylinder 40, support plate 41, elevating cylinder 42, elevating plate 43, fixing guide plate 44, guide opening-and-closing part 45, and moving guide plate 46. The body plate 39 is attached to an upper end situated on the side parted away from the table 16 of the rising-up pole 17. The body plate 39 extends toward the electric wire holding unit 11 from the rising-up pole 17.

The front-and-rear cylinder 40 includes a cylinder body 47 and a rod 48 formed stretchable from the cylinder body 47. The cylinder body 47 is attached to the body plate 39 in such a way that the longitudinal direction of the rod 48 is parallel to the horizontal direction and that when the rod 48 extends the cylinder body 47 approaches the electric wire holding unit 11. When the rod 48 extends, the front-and-rear cylinder 40 parts the support plate 41 (that is, parts the guide plates 44 and 46) from the holding jig 27 and brings it (or them) close to the electric wire holding unit 11. When the rod 48 contracts, the front-and-rear cylinder 40 brings the support plate 41 (that is, brings the guide plates 44 and 46) close to the holding jig 27.

The support plate 41 is attached to the rod 48 of the front-and-rear cylinder 40. The elevating cylinder 42 includes a cylinder body 49 and a rod 50 formed stretchable from the cylinder body 49. The cylinder body 49 is attached to the support plate 41 in such a way that the longitudinal direction of the rod 50 is parallel to the vertical direction and that when the rod 35 extends the cylinder body 49 approaches the housing holding unit 12.

When the rod 50 extends, the elevating cylinder 42 brings the elevating plate 43 (that is, brings the guide plates 44 and 46) close to the holding jig 27. When the rod 50 contracts, the elevating cylinder 42 parts the elevating plate 43 (that is, parts the guide plates 44 and 46) away from the holding jig 27. Thus, the elevating cylinder 42 supports the elevating plate 43 (that is, supports the guide plates 44 and 46) elevatingly.

Figure 7:
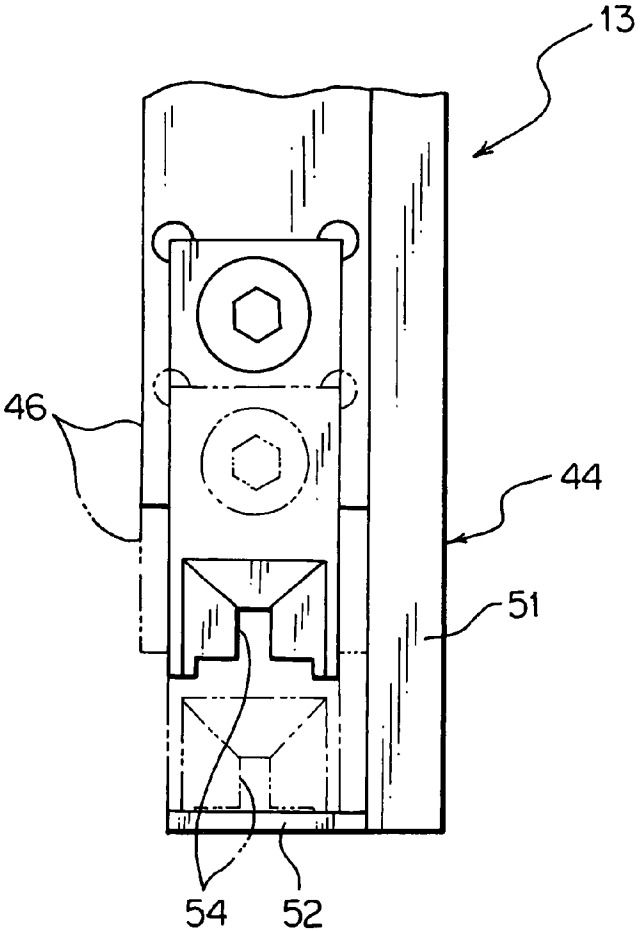
FIG. 7 is a front view illustrating a guide plate of a guide unit of the terminal inserting device shown in FIG. 1.

The elevating plate 43 is attached to the rod 50 of the elevating cylinder 42. The fixing guide plate 44 is attached to the elevating plate 43. As shown in FIG. 7, the fixing guide plate 44 integrally includes a vertical part 51 extending in the vertical direction and a horizontal part 52 in the horizontal direction from a lower end of the vertical part 51.

The guide opening-and-closing part 45 includes a cylinder body 53 and a rod formed stretchable from the cylinder body 53. The cylinder body 53 is attached to the support plate 43 in such a way that the longitudinal direction of the rod is parallel to the vertical direction and that when the rod extends the cylinder body 53 approaches the housing holding unit 12. When the rod extends, the guide opening-and-closing part 45 brings the moving guide plate 46 close to the holding jig 27. When the rod contracts, the guide opening-and-closing part 45 parts the moving guide plate 46 away from the holding jig 27. Thus, the guide opening-and-closing part 45 supports the moving guide plate 46 elevatingly. Thus, the moving guide plate 46 is movable in a range between a position shown by the solid lines in FIG. 7 and a position shown by the alternate long and two short dashes lines in FIG. 7.

The moving guide plate 46 is attached to the rod of the guide opening-and-closing part 45. The moving guide plate 46 is supported by the elevating plate 43 elevatingly in the vertical direction. The moving guide plate 46 is formed in a belt plate shape having the longitudinal direction in parallel to the vertical direction. A lower end of the moving guide plate 46 is provided with a guide notch 54. An opening of the guide notch 54 becomes gradually narrow in the horizontal direction (right-and-left direction in FIG. 5) as approaching to the holding jig 27 and is made equal to an opening of the terminal-receiving chamber 4.

In the guide unit 13, on a condition that the holding jig 27 of the housing holding unit 12 is positioned below the guide unit 13, when the rod of the cylinder body 53 contracts and the rod 48 of the front-and-rear cylinder 40 extends and the rod 50 of the elevating cylinder 42 extends, the guide plates 44 and 46 overlap with an opening of the terminal-receiving chamber 4 of the connector housing 3 held by the holding jig 27 in the horizontal direction. Then, in the guide unit 13, the rod of the cylinder body 53 extends, thereby allowing the horizontal part 52 of the fixing guide plate 44 to come in contact with the lower end of the moving guide plate 46.

Then, a lower part of the guide notch 54 is closed by the horizontal part 52 and a plan shape of the guide notch 54 becomes equal to that of the opening of the terminal-receiving chamber 4. Further, the rod 48 of the front-and-rear cylinder 40 contracts so that the guide plates 44 and 46 adhere to the connector housing 3 held by the holding jig 27. Then, the guide notch 54 communicates with the terminal-receiving chamber 4 into which the terminal fitting 6 is inserted. Thus, the terminal fitting 6 attached to the electric wire 5 is guided through the guide notch 54 so that the guide unit 13 guides the terminal fitting 6 into the terminal-receiving chamber 4 of the connector housing 3.

As shown in FIG. 5, the inserting unit 14 includes a horizontal moving unit 55, horizontal moving plate 56, elevating cylinder 57, elevating plate 58 (shown in FIG. 30), inserting cylinder 59, front chuck unit 60 as a terminal inserting means, damper mechanism 140, detecting sensor (not shown in the figure) as detecting means, and electric wire chuck unit 61.

The horizontal moving unit 55 includes a motor (not shown in the figure), ball screw 62, and linear guide 63. The motor is attached to the device body 10. The ball screw 62 includes a screw shaft 64 and a nut 65. The screw shaft 64 is rotatably supported on an upper end of the rising-up plate 18 of the device body 10 on a condition that the longitudinal direction of the screw shaft 64 is parallel to the horizontal direction. The screw shaft 64 is rotated around a shaft axis thereof by the motor. The longitudinal direction of the screw shaft 64 is parallel to a direction from the depth to the front or a direction from the front to the depth in FIG. 5. The nut 65 screw-engages with the screw shaft 64. The horizontal moving plate 56 is attached to the nut 65, that is, the front chuck unit 60 and the electric wire chuck unit 61 are attached to the nut 65.

The linear guide 63 includes a rail 66 and a slider 67. The rail 66 is attached to the rising-up plate 18 on a condition that the longitudinal direction of the rail 66 is parallel to the screw shaft 64. The slider 67 is attached to the rail 66 slidably in the longitudinal direction of the rail 66. The nut 65 screw-engages with the screw shaft 64. The horizontal moving plate 56 is attached to the slider 67, that is, the front chuck unit 60 and the electric wire chuck unit 61 are attached to the slider 67.

The horizontal moving unit 55 moves the nut 65 and the horizontal moving plate 56, that is, the front chuck unit 60 and the electric wire chuck unit 61 in the longitudinal direction of the screw shaft 64 by rotation drive force of the motor.

The horizontal moving plate 56 is attached to both the nut 65 and the slider 67. The horizontal moving plate 56 extends downward from the nut 65 and the slider 67.

The elevating cylinder 57 includes a cylinder body 68 attached to the horizontal moving plate 56 and a rod formed stretchable from the cylinder body 68. The elevating cylinder 57 elevates the elevating plate 58 by stretching and contracting the rod.

The elevating plate 58 is elevatingly supported by the horizontal moving plate 56 and movably supported by the horizontal moving plate 56 in the horizontal direction and in a direction in which the elevating plate 58 approaches and leaves the housing holding unit 12.

The inserting cylinder 59 includes a cylinder body 69 attached to the horizontal moving plate 56 and a rod 70 formed stretchable from the cylinder body 69. The elevating plate 58 is attached to the rod 70 through a damper mechanism 140. When the rod 70 extends, the inserting cylinder 59 brings the elevating plate 58 close to the housing holding unit 12, that is, brings the front chuck unit 60 and the electric wire chuck unit 61 close to the housing holding unit 12. When the rod 70 contracts, the inserting cylinder 59 parts the elevating plate 58 away from the housing holding unit 12, that is, parts the front chuck unit 60 and the electric wire chuck unit 61 away from the housing holding unit 12. The inserting cylinder 59 allows the elevating plate 58 to approach and leave the housing holding unit 12, that is, allows the front chuck unit 60 and the electric wire chuck unit 61 to approach and leave the housing holding unit 12.

The front chuck unit 60 includes an elevating cylinder 71, a support plate 72, a chuck cylinder 73, and a pair of front chucks 74.

Figure 30:
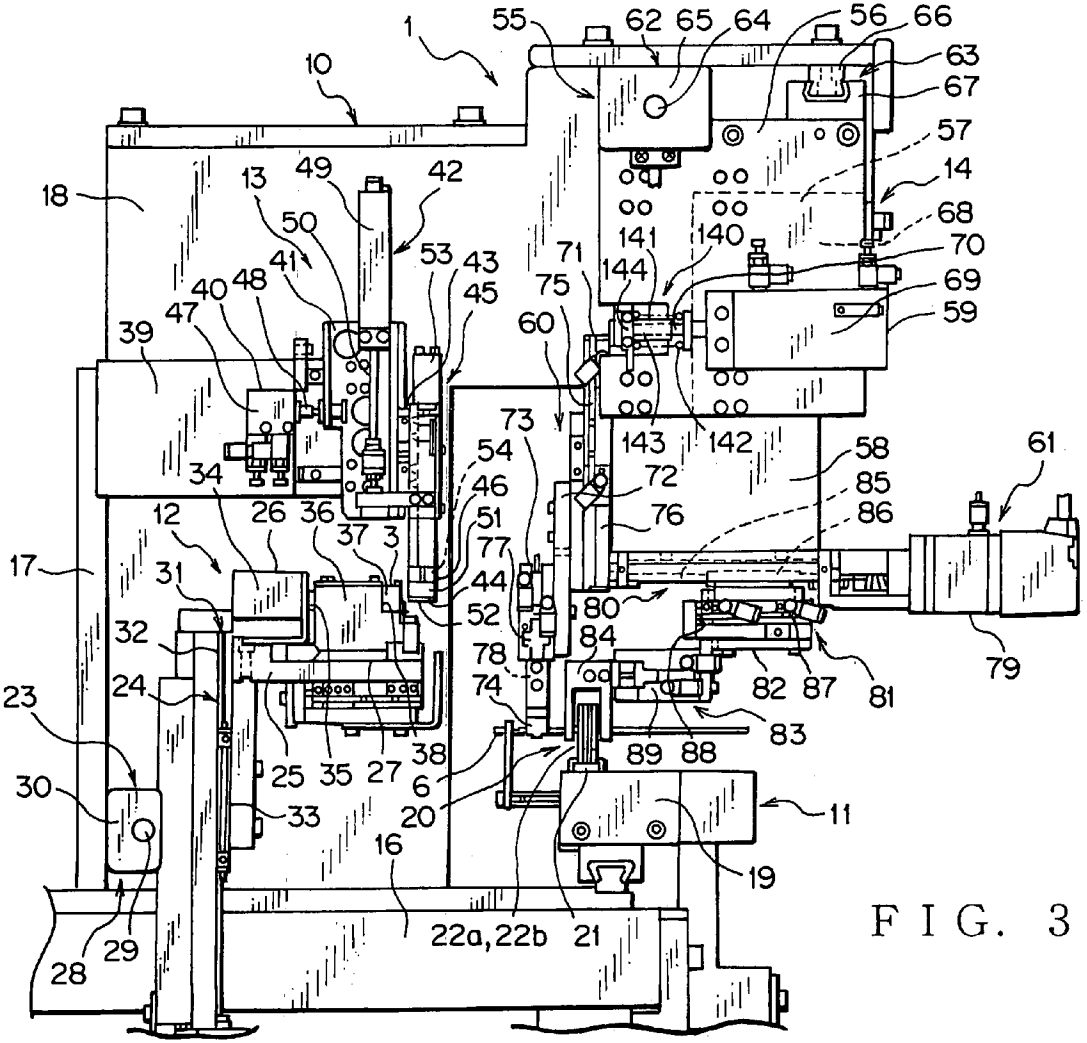
FIG. 30 is a side view illustrating a state when a guide plate falls from the state shown in FIG. 29 and a chuck unit chucks an electric wire and terminal fitting held by a rod.

As shown in FIG. 30, the elevating cylinder 71 includes a cylinder body 75 and a rod 76 formed stretchable from the cylinder body 75. The cylinder body 75 is attached to an end surface of the elevating plate 58 in the proximity of the housing holding unit 12. When the rod 76 extends from the cylinder body 75, the rod 76 moves downward.

Figure 8:
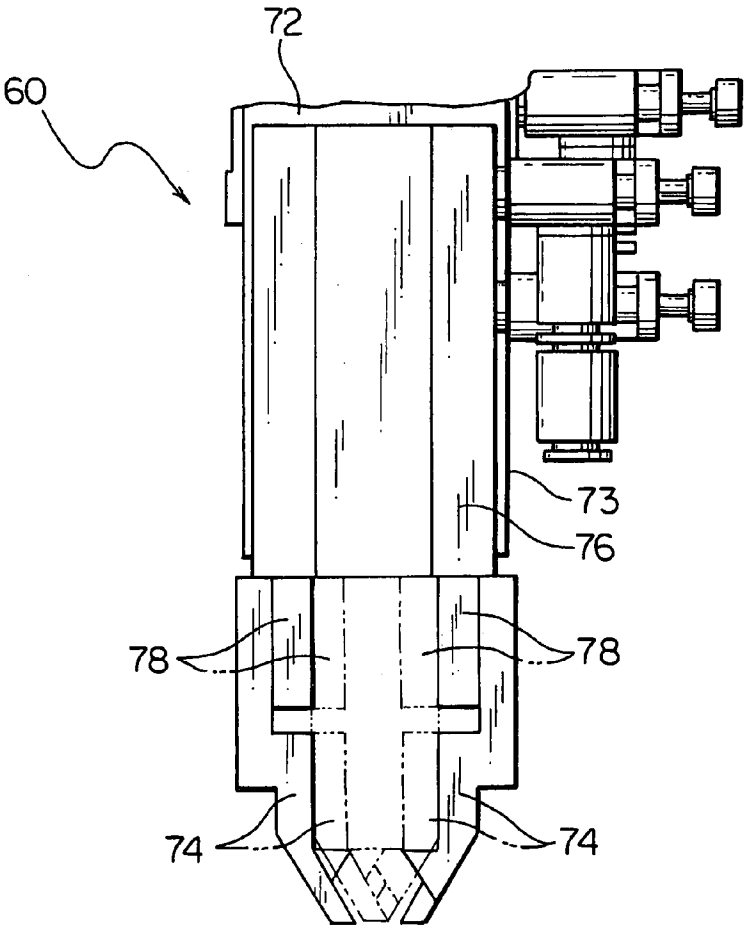
FIG. 8 is a front view illustrating a front chuck of the terminal inserting device shown in FIG. 1.

Both surfaces of the support plate 72 are arranged in the vertical direction and attached to the rod 76 of the elevating cylinder 71. As shown in FIG. 8, the chuck cylinder 73 includes a cylinder body 77 attached to the support plate 72 and a pair of approaching-and-leaving rods 78 projecting from the cylinder body 77. The approaching-and-leaving rods 78 project downward from the cylinder body 77 and spaced from each other in a direction from the depth to the front or a direction from the front to the depth in FIG. 5.

The approaching-and-leaving rods 78 are movable in a range between a position shown by the solid lines in FIG. 8 and a position shown by the alternate long and two short dashes lines in FIG. 8. The front chucks 74 are attached to the respective approaching-and-leaving rods 78. When the front chucks 74 approach each other, they put the electric wire 5 therebetween.

In the front chuck unit 60, the front chucks 74 are subjected to the elevating action by the elevating cylinder 71 and parted away from each other by the chuck cylinder 73, so that the front chucks 74 chuck the electric wire 5, to which the terminal fitting 6 is attached, held by the electric wire holding unit 11. Then, the front chucks 74 are subjected to the elevating action by the elevating cylinder 71 and brought close to the connector housing 3 by the inserting cylinder 59, so that the front chuck unit 60 inserts the terminal fitting 6 attached to the electric wire 5 chucked by the front chucks 74. Thus, the front chuck unit 60 inserts the terminal fitting 6 attached to the electric wire 5 into the terminal-receiving chamber 4 of the connector housing 3.

Figure 40:
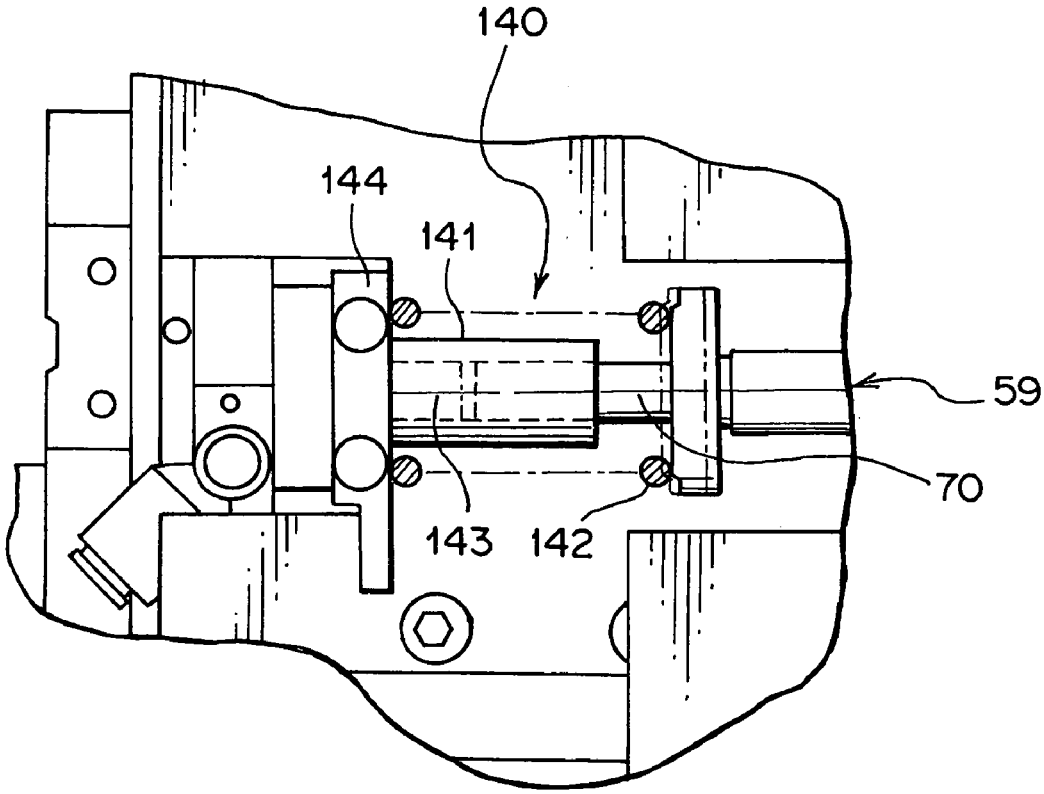
FIG. 40 is an enlarged side view of a part A in FIG. 39.

As shown in FIG. 40, the damper mechanism 140 includes a damper member 141 and a coil spring 142 as a bias means. The damper member 141 integrally includes a tube part 143 through which the rod 70 of the inserting cylinder 59 passes and a flange part 144 projecting toward the outer circumference from an end of the tube part 143. The rod 70 is inserted into the tube part 143. The tube part 143 is movable relatively to the rod 70 in the axial direction. The tube part 143 prevents the rod 70 of the inserting cylinder 59 from coming out (i.e. coming off). The flange part 144 is provided at an end of the tube part 143 in the proximity of the front chuck unit 60. The flange part 144 attaches the elevating plate 58 thereto.

The coil spring 142 is provided between the rod 70 of the inserting cylinder 59 and the flange part 144. The coil spring 142 biases the flange part 144, that is, biases the damper member 141 in a direction parting away from the inserting cylinder 59. That is, the coil spring 142 biases the pair of the front chucks 74 toward the connector housing 3 held by the housing holding unit 12.

When the terminal fitting 6 attached to the electric wire 5 chucked by the front chuck unit 60 abuts against the fixing guide plate 44 or the moving guide plate 46 of the guide unit 13, the damper mechanism 140 puts the rod 70 of the inserting cylinder 59 into the depth of the tube part 143 of the damper member 141 against the bias force of the coil spring 142 even if the rod 70 extends further. Then, the damper mechanism 140 prevents the terminal fitting 6, which abuts against the fixing guide plate 44 or the moving guide plate 46 of the guide unit 13, from approaching the connector housing 3 further, thereby preventing the terminal fitting 6 from buckling.

When the terminal fitting 6 is inserted into the terminal-receiving chamber 4 of the connector housing 3 without abutting against the fixing guide plate 44 or the moving guide plate 46 of the guide unit 13, the coil spring 142 does not contract.

When the rod 70 extends so as to insert the terminal fitting 6 into the terminal-receiving chamber 4 of the connector housing 3, the detecting sensor detects whether or not the front chuck unit 60 is displaced to a position where the terminal fitting 6 is inserted in the terminal-receiving chamber 4. That is, the detecting sensor detects whether or not the terminal fitting 6 attached to the electric wire 5 chucked by the front chuck unit 60 is inserted in the terminal-receiving chamber 4 of the connector housing 3 and abuts against the fixing guide plate 44 or the moving guide plate 46 of the guide unit 13. As the detecting sensor, for example, a combination of a known laser diode (LD) and a photodiode (PD) or a proximity sensor can be used. The detecting sensor outputs the detected results to the control device 15.

As shown in FIG. 5, the electric wire chuck unit 61 includes an inserting motor 79 as a pulling means, a ball screw 80, an air cylinder 81 as a changing means, a chuck support plate 82, a chuck cylinder 83, and a pair of electric wire chucks 84 as an electric wire holding means.

The inserting motor 79 is attached to an end part of the elevating plate 58. The ball screw 80 includes a screw shaft 85 and a nut 86. The longitudinal direction of the screw shaft 85 is parallel to the horizontal direction and parallel to the right-and-left direction in FIG. 5. The screw shaft 85 is rotatably supported by a lower end part of the elevating plate 58. The screw shaft 85 is rotated around the shaft axis by the inserting motor 79. The nut 86 screw-engages with the screw shaft 85. The nut 86 is attached to the cylinder body 87 of the air cylinder 81. The inserting motor 79 brings the electric wire chuck 84 close to or part the electric wire chuck 84 away from the connector housing 3 held by the holding jig 27 of the housing holding unit 12. That is, the inserting motor 79 inserts the terminal fitting 6 attached to the electric wire 5 held by the electric wire chuck 84 into the terminal-receiving chamber 4 of the connector housing 3, and pulls the electric wire 5 attached to the terminal fitting 6 inserted in the terminal-receiving chamber 4. That is, the inserting motor 79 pulls the terminal fitting 6 received in the terminal-receiving chamber 4 of the connector housing 3 in a direction reverse to the insertion direction of the terminal fitting 6.

The air cylinder 81 includes a cylinder body 87, a rod 88 as a retractable member formed retractable from the cylinder body 87, and a pair of regulators as an adjusting means. The cylinder body 87 is attached to the nut 86. The longitudinal direction of the rod 88 is the horizontal direction and parallel to the right-and-left direction in FIG. 5. The cylinder body 87 is attached to the nut 86 in such a way that when the rod 88 extends the cylinder body 87 approaches the housing holding unit 12.

The rod 88 includes a rod body formed in a rod shape and a piston provided at an end part of the rod body. An end part in the longitudinal direction of the rod body is inserted in the cylinder body 87. An outer peripheral surface of the piston comes in close contact with an inner peripheral surface of the cylinder body 87. The piston is movable in the longitudinal direction of the cylinder body 87 and that of the rod body. The piston partitions a space within the cylinder body 87 into the first room in the proximity of the guide unit 13 and the second room being parted away from the guide unit 13. Air as a pressurized fluid is supplied into the first room of the cylinder body 87 from a pressurized gas supply source 147.

In the air cylinder 81, when the air pressure in the first room of the cylinder body 87 exceeds that in the second room, the rod 88 contracts. When the air pressure in the second room of the cylinder body 87 exceeds that in the first room, the rod 88 extends.

The regulator 145 is provided between the pressurized gas supply source 147 and the first room. The regulator 145 changes the air pressure in the first room in accordance with a command from the control device 15.

When the regulator 145 changes the air pressure in the first room, the air cylinder 81 changes the pulling force and pushing force when the rod 88 extends or contracts from the cylinder body 87. That is, when the regulator 145 changes the air pressure in the first room, the regulator 145 can change bias force for biasing the terminal fitting 6, that is, for biasing the electric wire chuck 84 toward the connector housing 3.

The chuck support plate 82 is attached to the rod 88 of the air cylinder 81. When the rod 88 of the air cylinder 81 extends or contracts from the cylinder body 87, the chuck support plate 82 moves in the horizontal direction approaching or leaving the housing holding unit 12.

The chuck cylinder 83 includes a cylinder body 89 attached to the chuck support plate 82 and a pair of approaching-and-leaving rods (not shown in the figure) projecting from the cylinder body 89 toward the housing holding unit 12. The approaching-and-leaving rods are spaced from each other in a direction from the depth to the front or a direction from the front to the depth in FIG. 5.

The electric wire chucks 84 are attached to the respective approaching-and-leaving rods. The electric wire chucks 84 is movable in a range between a position shown by the solid lines in FIG. 9 and a position shown by the alternate long and two short dashes lines in FIG. 9. When the front chucks 84 approach each other, they put the electric wire 5 attached to the terminal fitting 6 therebetween. The electric wire chuck 84 is movable together with the front chuck 74, that is, together with the front chuck unit 60 by the inserting cylinder 59.

When the elevating cylinder 57 puts the elevating plate 58 down and the rod 76 of the elevating cylinder 71 extends, the inserting unit 14 brings the approaching-and-leaving rods 78 of the chuck cylinder 73 close to each other or parting the approaching-and-leaving rods 78 away from each other so as to put the electric wire 5 held by the rod 20 between the pair of the front chucks 74. Further, the inserting unit 14 brings the approaching-and-leaving rods of the chuck cylinder 83 close to each other or parting the approaching-and-leaving rods away from each other so as to put the electric wire 5 held by the rod 20 between the pair of the electric wire chucks 84.

When the elevating cylinder 57 raises the elevating plate 58, the inserting unit 14 pulls out the terminal fitting 6 and the electric wire 5 attached to the terminal fitting 6 from the rod 20 of the electric wire holding unit 11. Thus, the inserting unit 14 takes out the electric wire 5 held by the electric wire holding unit 11 from the electric wire holding unit 11.

The inserting unit 14 extends the rod 70 of the inserting cylinder 59 so as to bring the elevating plate 58 close to the holding jig 27. The inserting unit 14 inserts the terminal fitting 6 into the guide notch 54 of the guide unit 13. Then, the inserting unit 14 parts the pair of the front chucks 74 of the front chuck unit 60 away from each other so as to raise the front chucks 74 (i.e. to retract them from the electric wire 5) by the elevating cylinder 71 of the front chuck unit 60. The inserting unit 14 brings the electric wire chuck unit 61 close to the holding jig 27 by the inserting motor so as to insert the terminal fitting 6 into the terminal-receiving chamber 4 of the connector housing 2 held by the holding jig 27.

Then, the locking arm described above engages to fix the connector housing 3 and the terminal fitting 6 to each other. Thereafter, the inserting unit 14 pulls the electric wire 5, that is, pulls the terminal fitting 6 by the inserting motor 79 and extends the rod 88 of the air cylinder 81 from the cylinder body 87 with force, which is weaker than the pulling force by the inserting motor 79 and is force in accordance with an article number of the terminal fitting 6. Then, the electric wire 5 (or the terminal fitting 6) is pulled in a direction, in which the electric wire 5 (or the terminal fitting 6) comes out from the terminal-receiving chamber 4 of the connector housing 3, with a difference force between the pulling force by the inserting motor 79 and the extending force of the rod 88 of the air cylinder 81. Here, the pulling force for pulling the terminal fitting 6, that is, the extending force of the rod 88 of the air cylinder 81 is predetermined depending on the article numbers of the terminal fittings 6 and is changed appropriately according to the article numbers of the terminal fittings 6.

Then, the inserting unit 14 parts the electric chucks 84 from each other so as to part the electric wire chuck unit 61 from the electric wire 5. Then, the inserting unit 14 takes out a next electric wire 5 from the rod 5 and inserts the terminal fitting 6 attached to the electric wire 5 into the terminal-receiving chamber 4.

When the inserting unit 14 inserts the last terminal fitting 6 into the terminal-receiving chamber 4, the inserting unit 14 maintains to grasp the electric wire 5 attached to the terminal fitting 6 inserted last. Then, the elevating unit 24 of the housing holding unit 12 puts the holding jig 27 down. Then, the connector housing 3 is released from the holding jig 27.

Then, while the electric wire chuck unit 61 maintains to grasp the electric wire 5 attached to the terminal fitting 6 inserted last, the inserting unit 14 press-fits the electric wire 5 in between the nipping members 22*a* and 22*b* by actions of the inserting cylinder 59, inserting motor 79, elevating cylinder 57, and horizontal moving unit 55. Thus, the inserting unit 14 conveys the electric wire 5 attached to the terminal fitting 6, which is inserted last into the terminal-receiving chamber 4, to the electric wire holding unit 11 to hold the electric wire 5. Thus, by cooperation of the housing holding unit 12 and the inserting unit 14, one holding jig 27 of a plurality of the holding jigs 27 placed on the jig placing unit 90 is placed and the terminal fitting 6 is inserted into the terminal-receiving chamber 4 of the connector housing 3 held by the holding jig 27.

The control device 15 is a computer having a known RAM, ROM and CPU. The control device 15 connects the jig conveying unit 91, housing holding unit 12, guide unit 13 and inserting unit 14 to one another and controls actions thereof, thereby controlling the whole terminal inserting device 1.

The control device 15 stores the positions of the holding jigs 27 corresponding to the respective article numbers of the connector 2. The control device 15 stores the order of the terminal-receiving chambers 4, into which the terminal fittings 6 of the connector housing 3 depending on the article number of the connector 2 to be assembled are inserted, stores the positions of the terminal fittings 6 to be inserted into the respective terminal-receiving chambers 4 at the rod 20, and stores the positions of the respective terminal-receiving chambers 4. Further, the control device 15 stores the positions of the nipping members 22*a* and 22*b*, into which the electric wire 5 attached to the terminal fitting 6 last inserted in the assembled connector 2 is press-fit. The control device 15 is connected to known information inputting devices such as a keyboard, operation devices such as a switch, and display means such as alarm or lamp for indicating a defective insertion of the terminal fitting 6 or the like.

The control device 15 stores pressure of air to be supplied into the first room when the terminal fitting 6 is pulled after the insertion thereof, depending on the article numbers of the terminal fittings 6. That is, the control device 15 stores the pulling force for pulling the terminal fitting 6 after the insertion thereof into the connector housing 3 depending on the article numbers of the terminal fittings 6.

The control device 15 makes the regulator 145 control the pressure in the first room of the air cylinder 81 higher than that in the second room until the terminal fitting 6 is taken out from the rod 20 and inserted into the terminal-receiving chamber 4 of the connector housing 3. That is, the control device 15 maintains the rod 88 of the air cylinder 81 being contracted until the terminal fitting 6 is taken out from the rod 20 and inserted into the terminal-receiving chamber 4 of the connector housing 3.

The control device 15 makes the regulator 145 control the pressure in the first room of the air cylinder 81 lower than that in the second room when the terminal fitting 6 is inserted into the terminal-receiving chamber 4 of the connector housing 3 and pulled with the inserting motor 79. At that time, air having a predetermined pressure depending on the article number of the terminal fitting 6 is supplied into the first room. That is, the control device 15 stores the force with which the rod 88 defined according to the article number of the terminal fitting 6 biases the electric wire chucks 84 toward the connector housing 3. The control device 15 extends the rod 88 when the inserting motor 79 pulls the terminal fitting 6 in the terminal-receiving chamber 4.

On the basis of information from the detecting sensor, the control device 15 judges whether or not the terminal fitting 6 abuts against the guide plates 44 and 46 so as to contract the coil spring 142 when the terminal fitting 6 is inserted into the connector housing 3. If the control device 15 judges that the coil spring 142 contracts, that is, if the control device 15 judges that the terminal fitting 6 abuts against the guide plates 44 and 46, the control device 15 stops insertion action of the inserting unit 14 and makes the display means described above display a defective insertion of the terminal fitting 6.

As for the terminal inserting device 1, when the terminal fittings 6 are inserted into the respective terminal-receiving chambers 4 of the connector housing 3, first, an article number of a connector 2 to be assembled is inputted to the control device 15. Further, a plurality of the holding jigs 27 are placed on the jig placing unit 90. The rod 20 according to the article number is attached to the unit body 19 of the electric wire holding unit 11.

Figure 11:
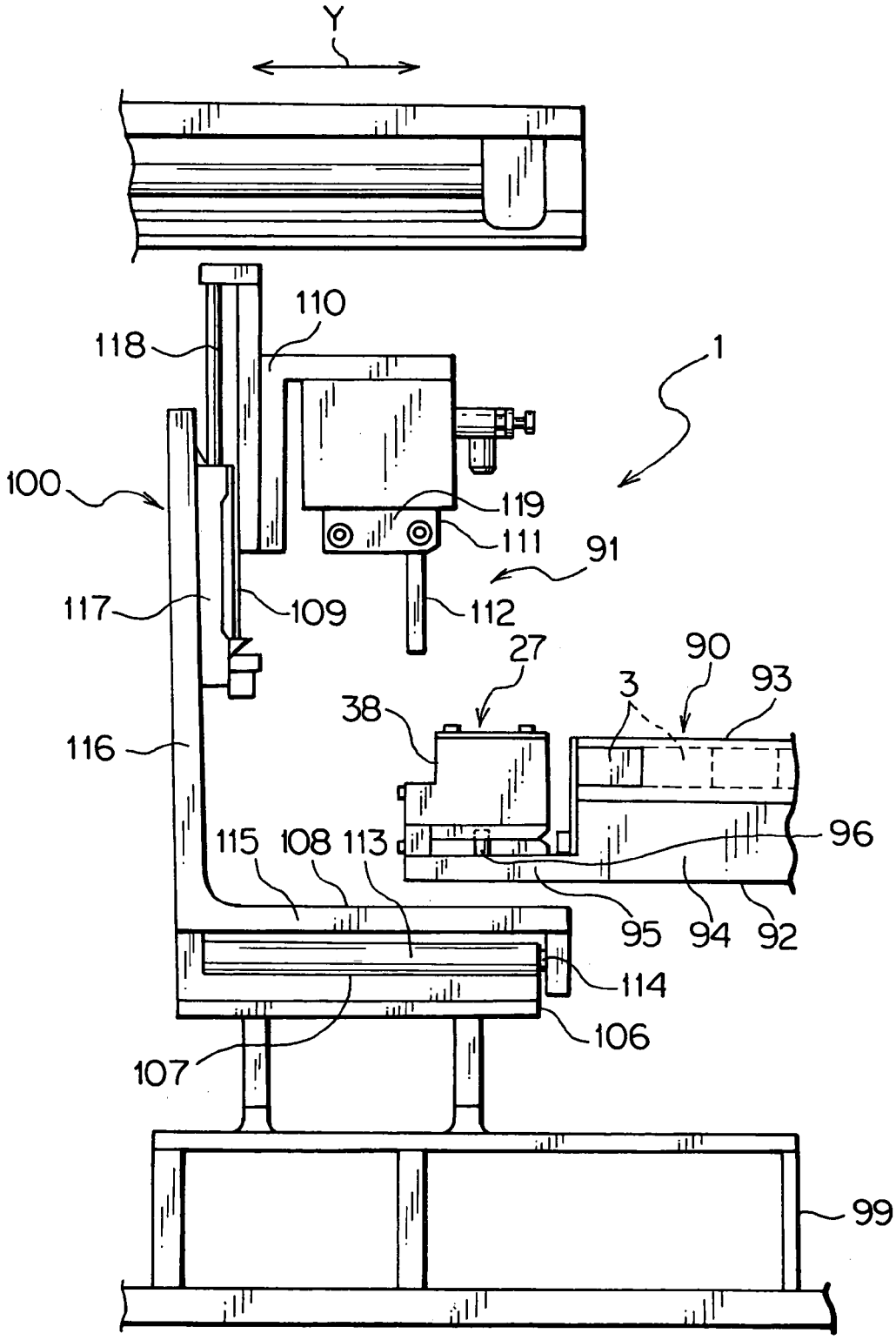
FIG. 11 is a side view illustrating a housing mobile unit of a jig conveying unit of the terminal inserting device shown in FIG. 1.
Figure 12:
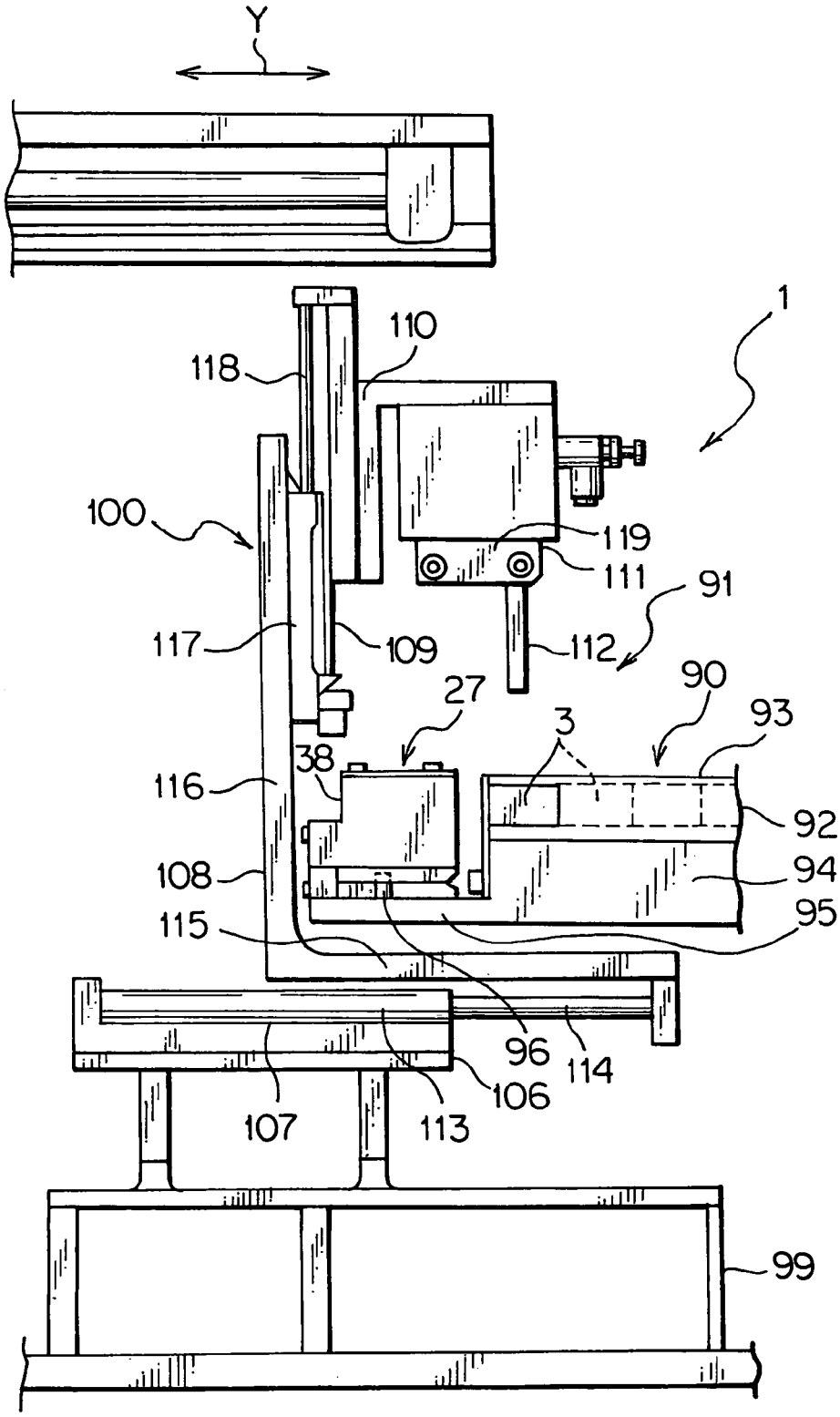
FIG. 12 is a side view illustrating a state when a rod of a slide cylinder of a housing mobile unit shown in FIG. 11 is extended.

Then, by means of the operation device described above, a command of action start is inputted to the control device 15. Then, as shown in FIG. 11, the control device 15 moves the movable table 99 and positions the chuck cylinder 111 of the housing conveying unit 100 above the holding jig 27 corresponding to an article number of the connector 2 to be assembled. At that time, the rod 118 of the elevating cylinder 109 extends and the approaching-and-leaving rods 120 of the chuck cylinder 111 are parted from each other. Then, as shown in FIG. 12, the control device 15 extends the rod 114 of the slide cylinder 107 of the housing conveying unit 100.

Figure 13:
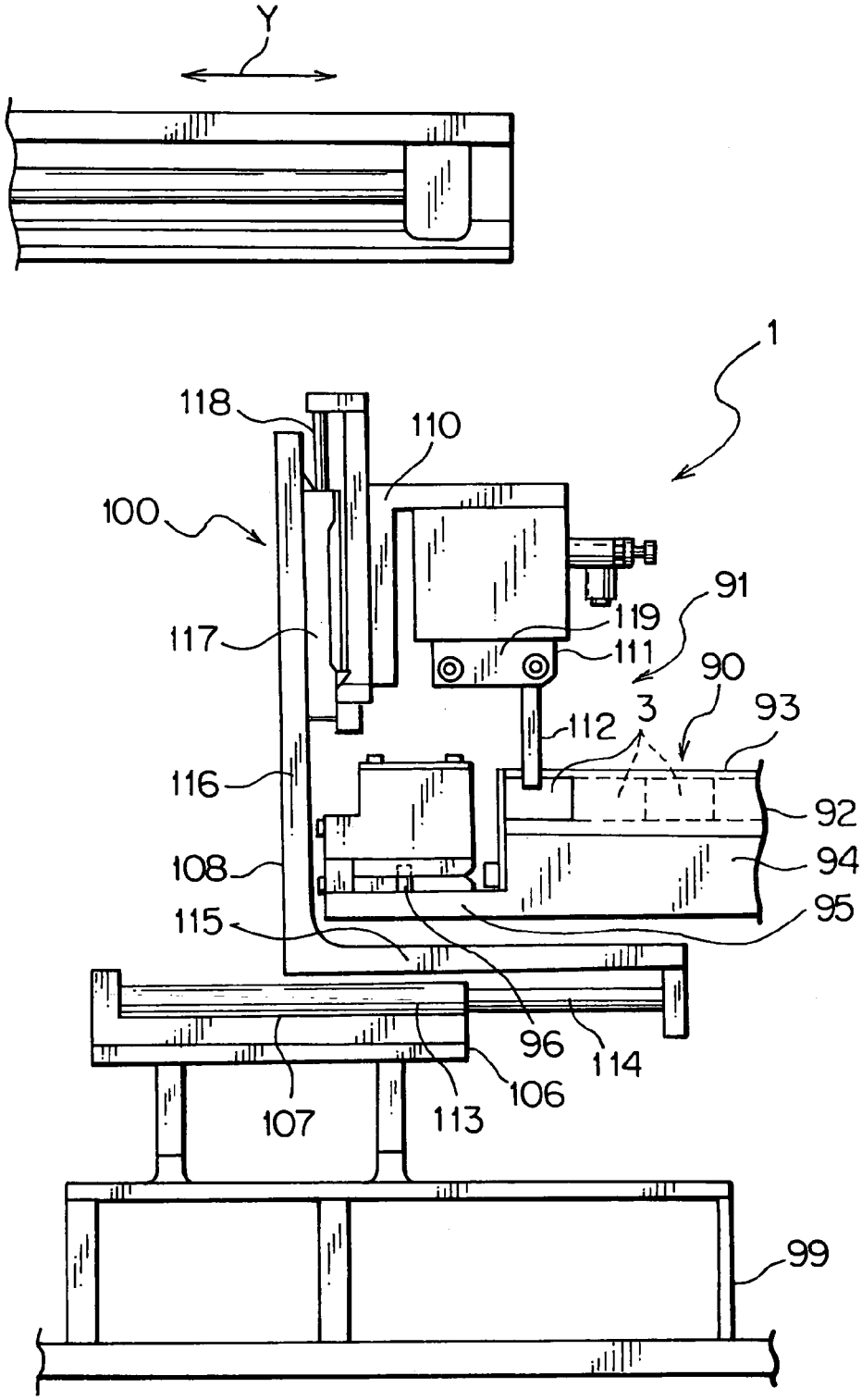
FIG. 13 is a side view illustrating a state when a rod of an elevating cylinder of a housing mobile unit shown in FIG. 12 is contracted.
Figure 14:
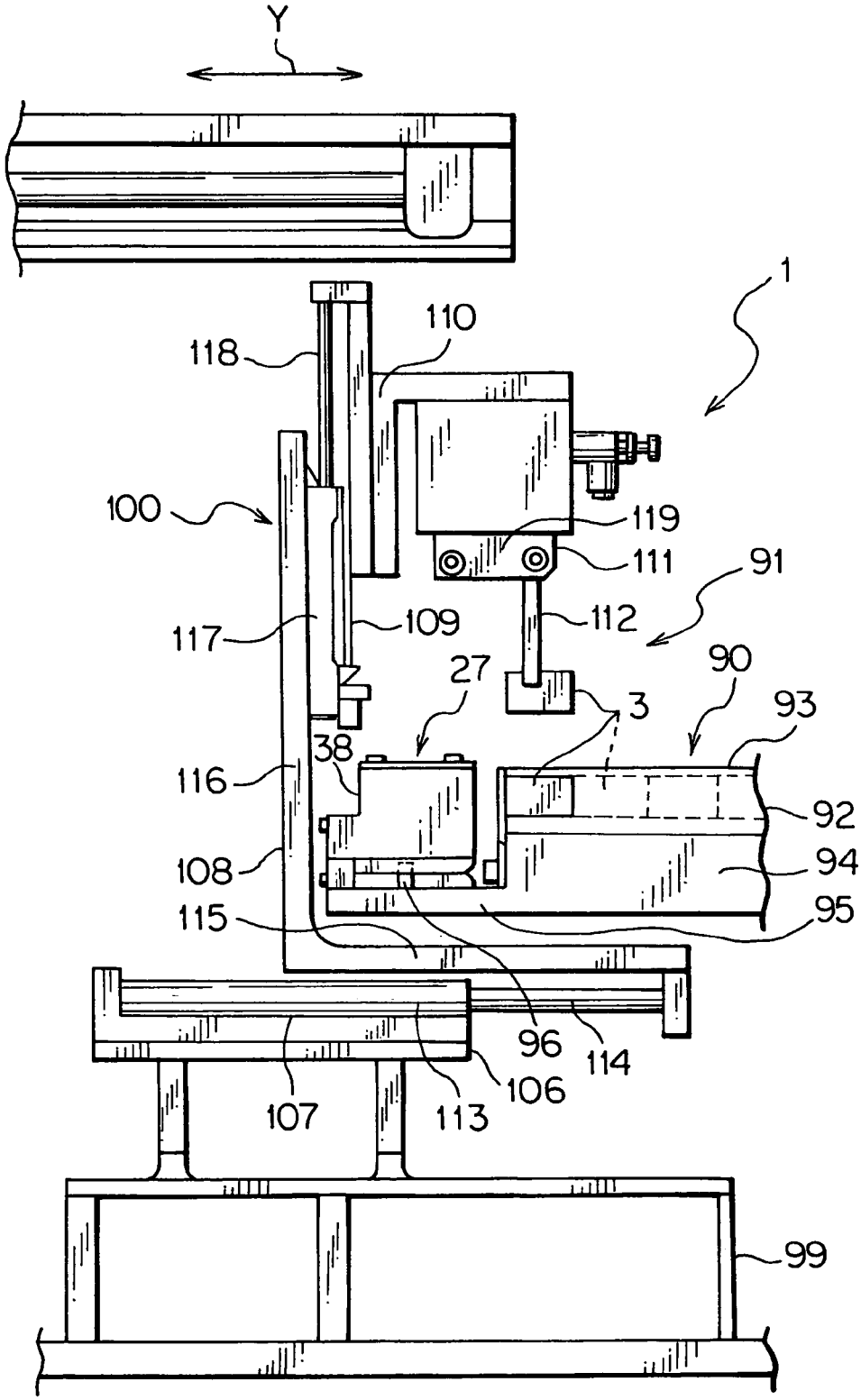
FIG. 14 is a side view illustrating a state when a rod of an elevating cylinder of a housing mobile unit shown in FIG. 13 is extended.
Figure 15:
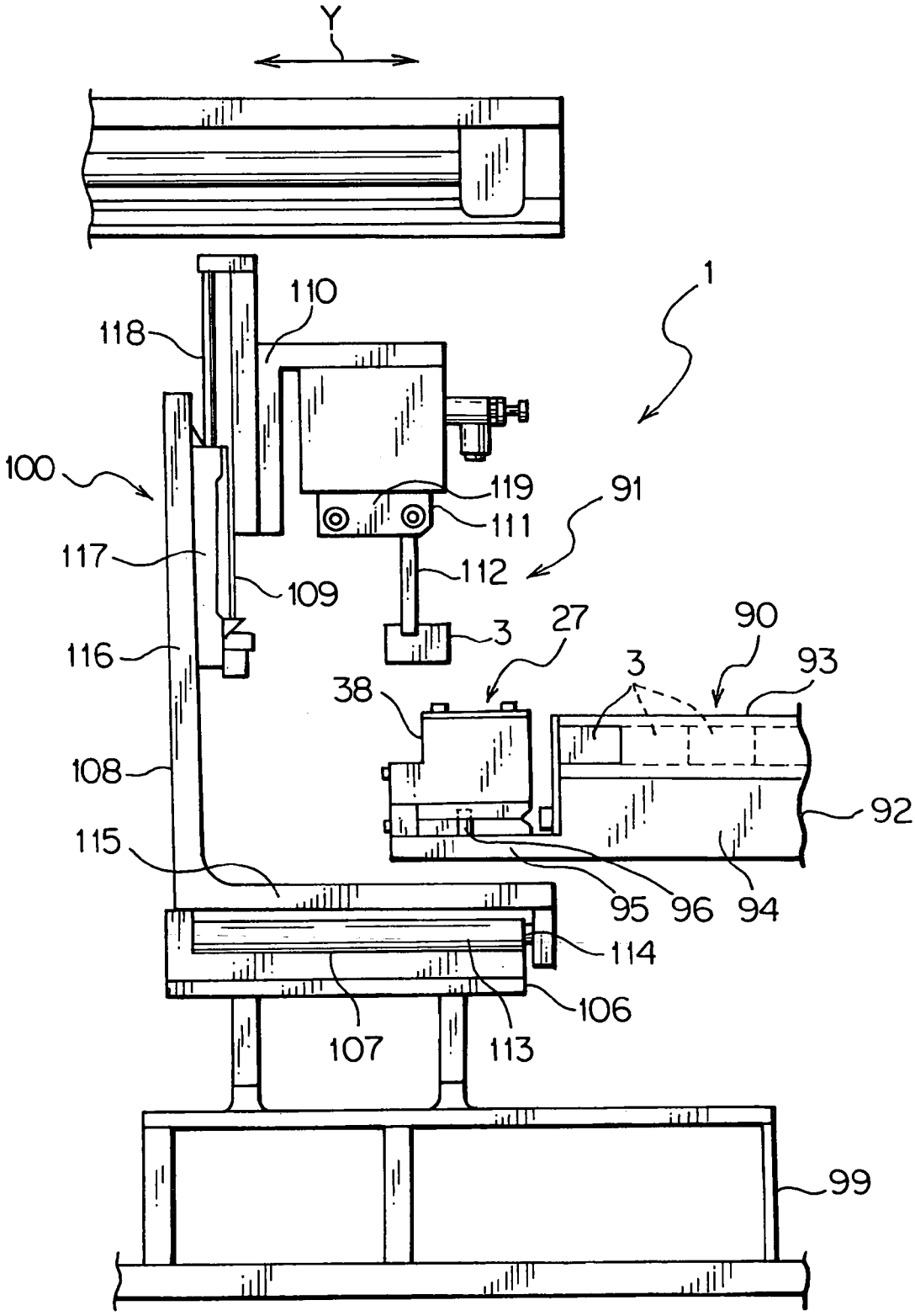
FIG. 15 is a side view illustrating a state when a rod of a slide cylinder of a housing mobile unit shown in FIG. 14 is contracted.

Then, the chuck cylinder 111 is positioned above the connector housing 3 in the housing feeding part 93. Thereafter, as shown in FIG. 13, the control device 15 contracts the rod 118 of the elevating cylinder 109 and brings the approaching-and-leaving rods 120 of the chuck cylinder 111 close to each other. Thus, the connector housing 3 within the housing feeding part 93 is grasped (i.e. chucked) by the housing conveying unit 100. As shown in FIG. 14, the control device 15 extends rod 118 of the elevating cylinder 109. As shown in FIG. 15, the control device 15 contracts the rod 114 of the slide cylinder 107 of the housing conveying unit 100.

Figure 16:
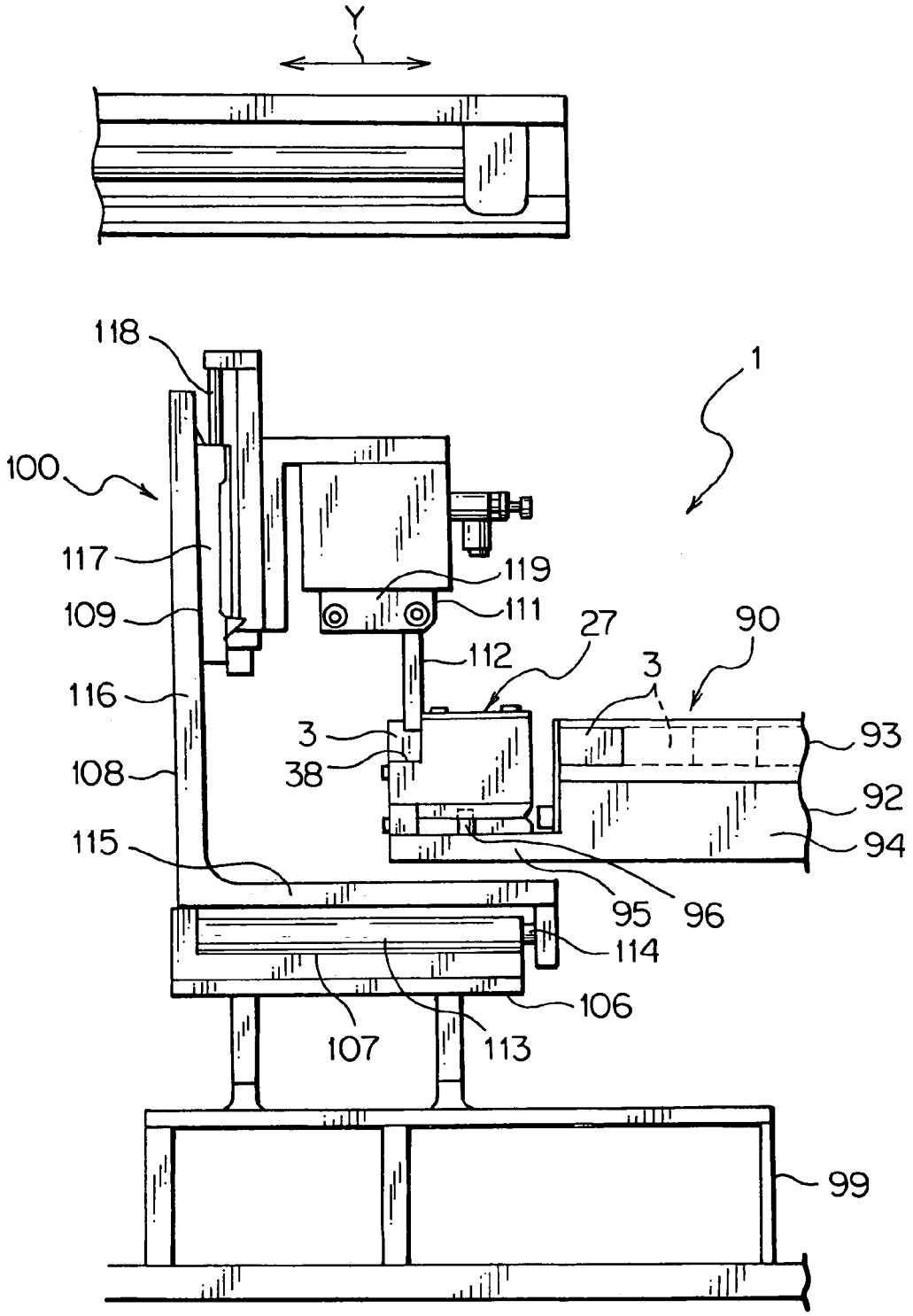
FIG. 16 is a side view illustrating a state when a rod of an elevating cylinder of a housing mobile unit shown in FIG. 15 is contracted.
Figure 17:
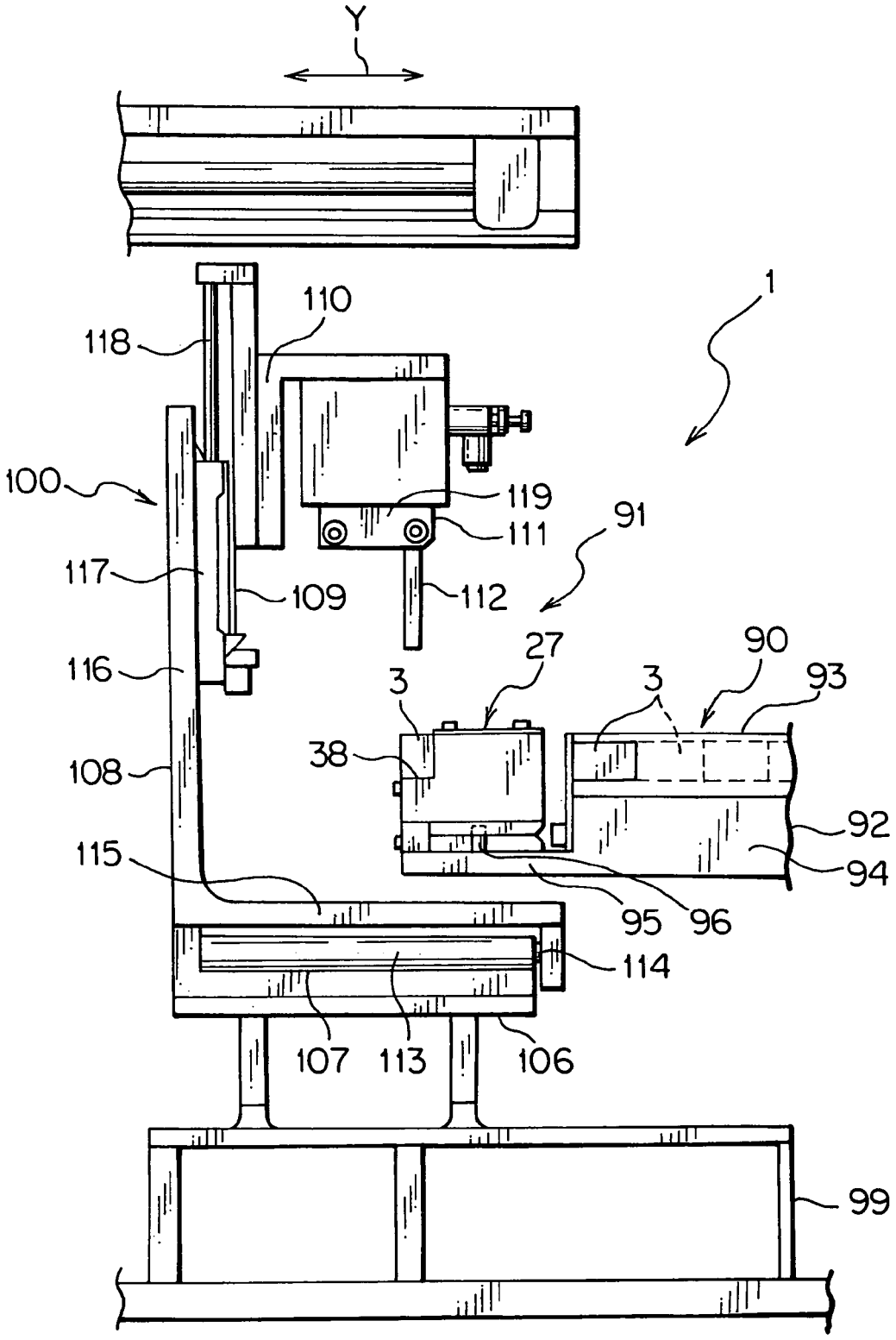
FIG. 17 is a side view illustrating a state when a rod of an elevating cylinder of a housing mobile unit shown in FIG. 16 is extended.

Thereafter, as shown in FIG. 16, the control device 15 contracts the rod 118 of the elevating cylinder 109 so as to insert the chucked connector housing 3 into the notch 38 of the holding jig 27 and parts the approaching-and-leaving rods 120 of the chuck cylinder 111 from each other. Then, as shown in FIG. 17, the control device 15 extends the rod 118 of the elevating cylinder 109 of the housing conveying unit 100. Thus, first, the control device 15 makes the housing conveying unit 100 convey the connector housing 3 from the housing feeding part 93 to the holding jig 27.

Figure 18:
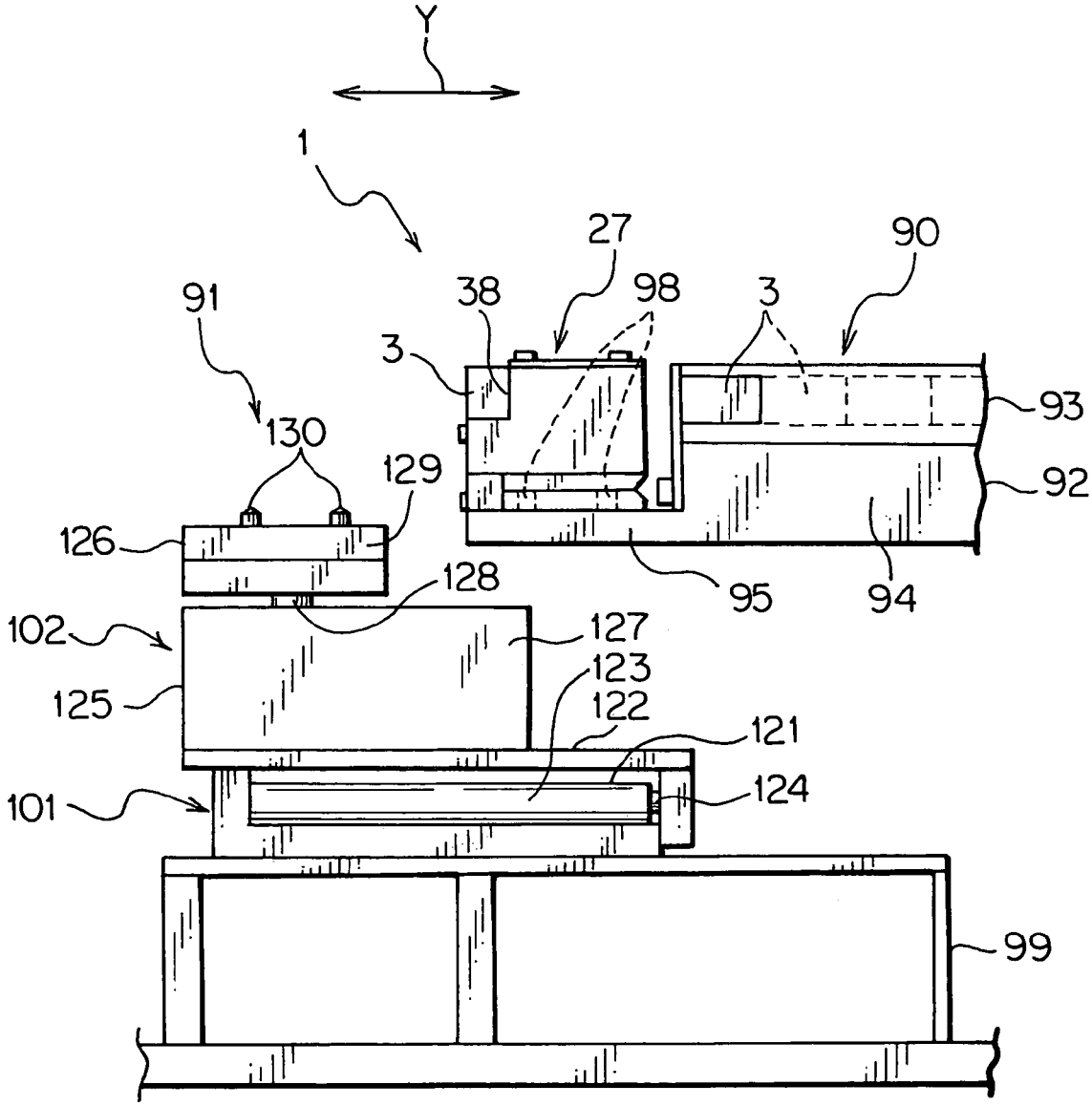
FIG. 18 is a side view illustrating a slide unit of a jig conveying unit and a jig lifting unit of the terminal inserting device shown in FIG. 1.
Figure 19:
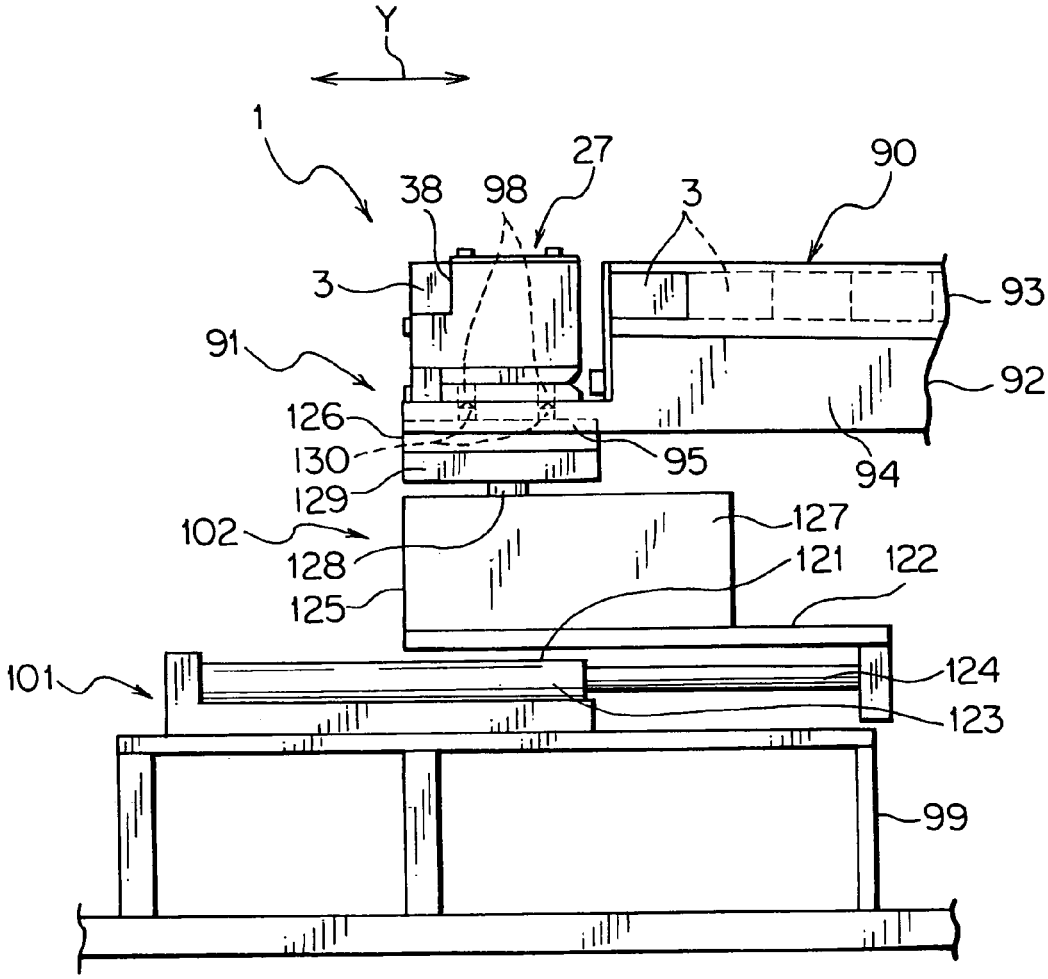
FIG. 19 is a side view illustrating a state when a rod of a slide cylinder of a slide unit shown in FIG. 18 is extended.

Then, as shown in FIG. 18, the control device 15 moves the movable table 99 so as to line up the holding jig 27, to which the connector housing 3 is conveyed by the housing conveying unit 100, and the jig lifting unit 102 along the arrow Y. At that time, the rod 128 of the elevating cylinder 125 contracts and the rod 124 of the slide cylinder 121 of the slide unit 101 contracts. Then, as shown in FIG. 19, the control device 15 extends the rod 124 of the slide cylinder 121. Then, the lifting base 126 of the jig lifting unit 102 is positioned below the holding jig 27.

Figure 20:
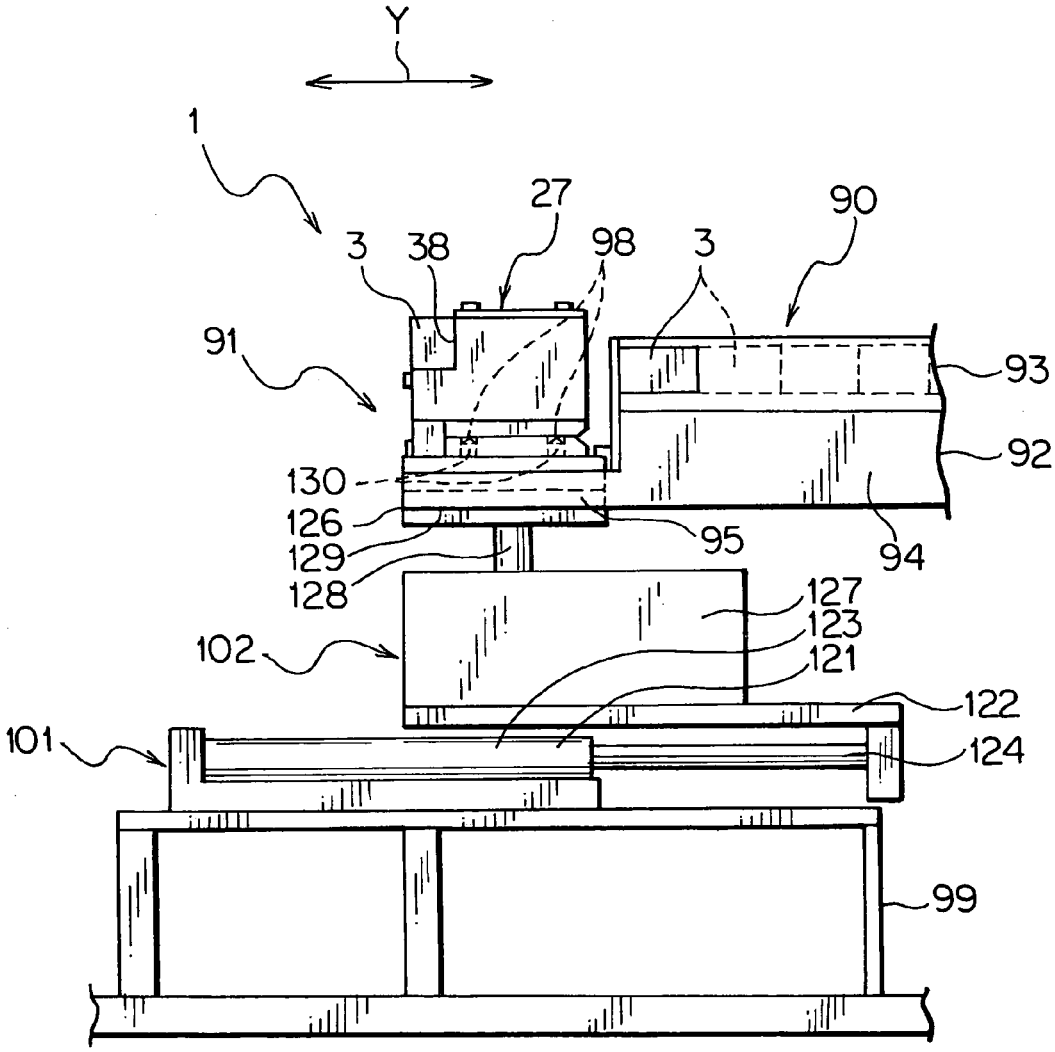
FIG. 20 is a side view illustrating a state when a rod of an elevating cylinder of a jig lifting unit shown in FIG. 19 is extended.
Figure 21:
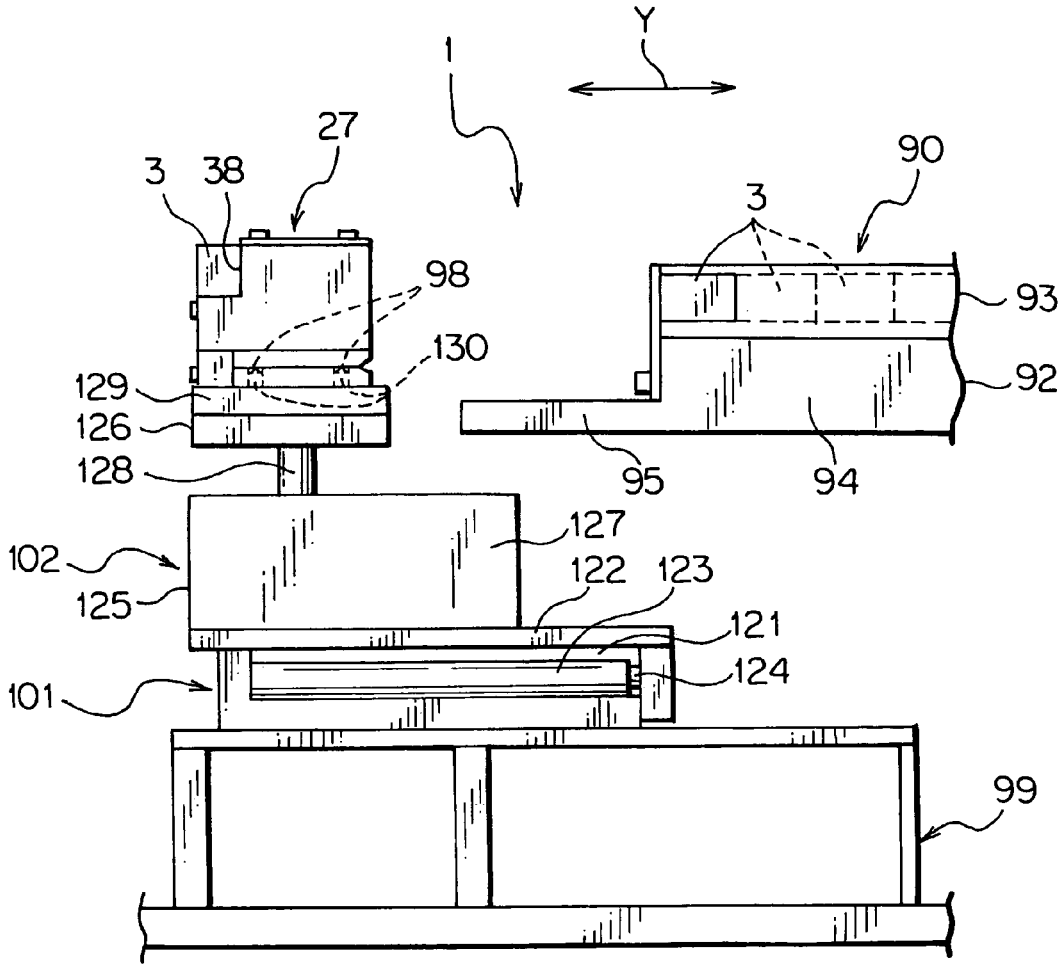
FIG. 21 is a side view illustrating a state when a rod of a slide cylinder of a slide unit shown in FIG. 20 is contracted.
Figure 22:
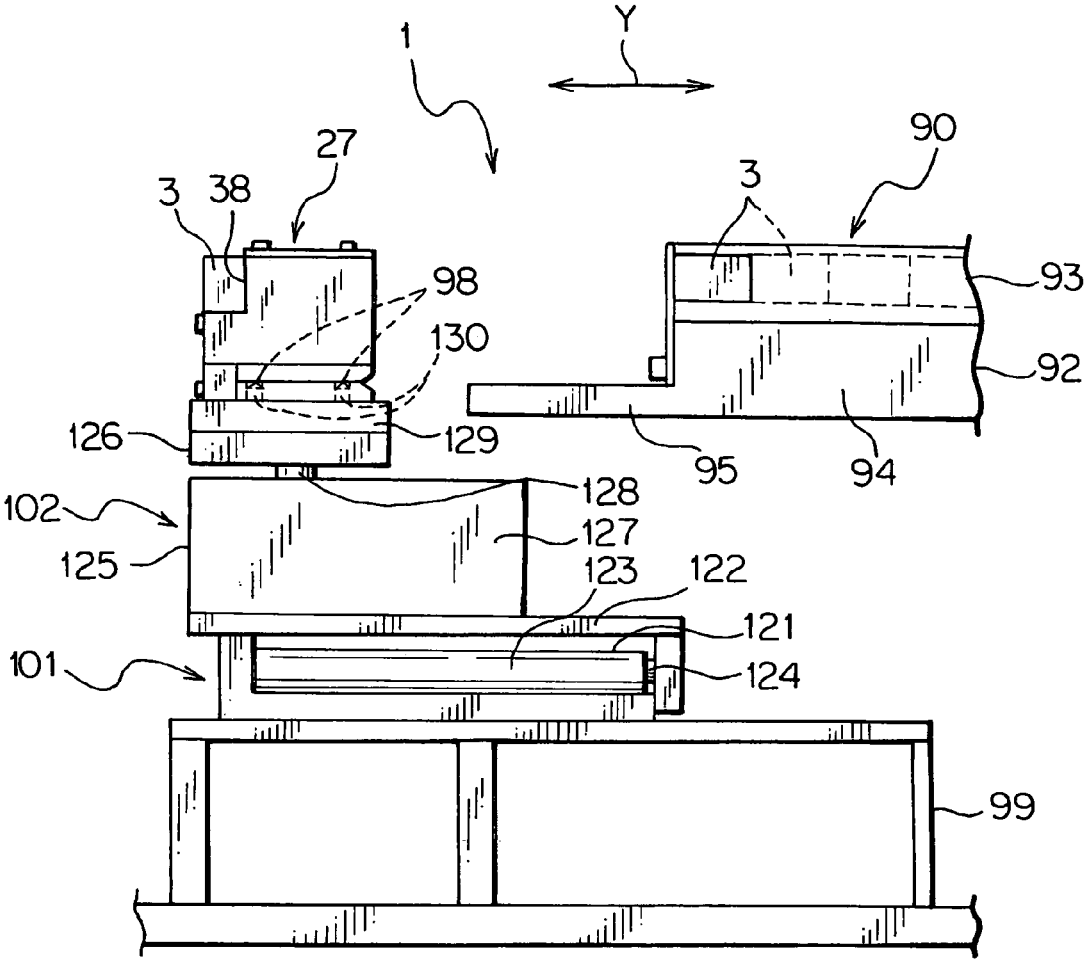
FIG. 22 is a side view illustrating a state when a rod of an elevating cylinder of a jig lifting unit shown in FIG. 21 is contracted.

Thereafter, as shown in FIG. 20, the control device 15 extends the rod 128 of the elevating cylinder 125 so as to raise the holding jig 27 from the jig placing bed 92 of the jig placing unit 90 by the lifting base 126. Then, as shown in FIG. 21, the control device 15 contracts the rod 124 of the slide cylinder 121. Thereafter, as shown in FIG. 22, the control device 15 contracts the rod 128 of the elevating cylinder 125. Thus, the control device 15 pulls out the holding jig 27 to the side of the housing holding unit 12 from the jig placing bed 92 of the jig placing unit 90 by the jig lifting unit 102 and the slide unit 101.

Figure 23:
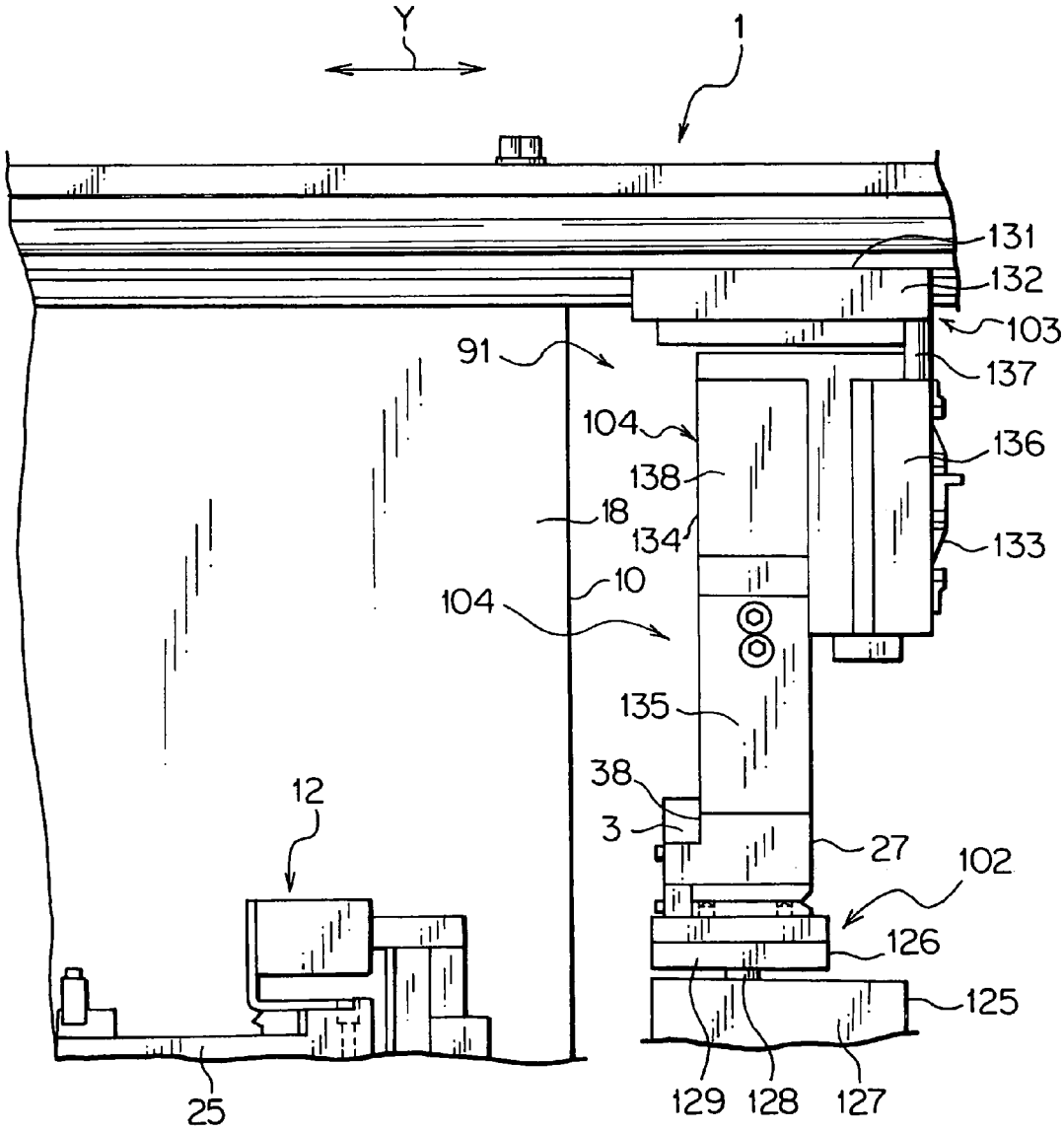
FIG. 23 is a side view illustrating a state when a jig grasping unit is positioned above a jig lifting unit shown in FIG. 22.

Then, the control device 15 moves the cylinder body 132 of the slide cylinder 131 along the arrow Y and as shown in FIG. 23 positions one jig grasping unit 104 above the holding jig 27 on the lifting base 126. At that time, the rod 137 of the elevating cylinder 133 is contracted and the approaching-and-leaving rods 139 of the chuck cylinder 134 are parted from each other.

Figure 24:
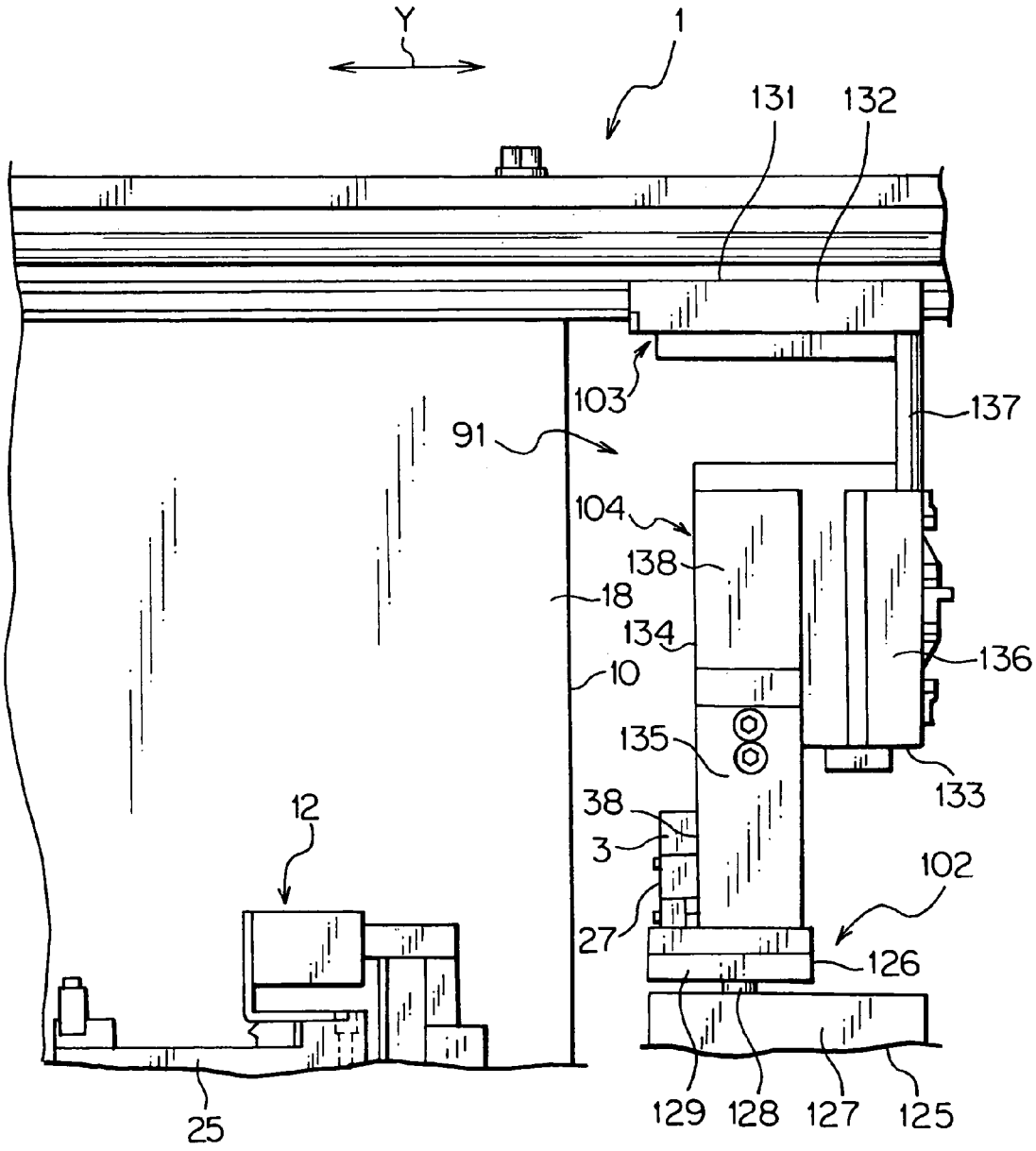
FIG. 24 is a side view illustrating a state when a rod of an elevating cylinder of a jig grasping unit shown in FIG. 23 is extended.
Figure 25:
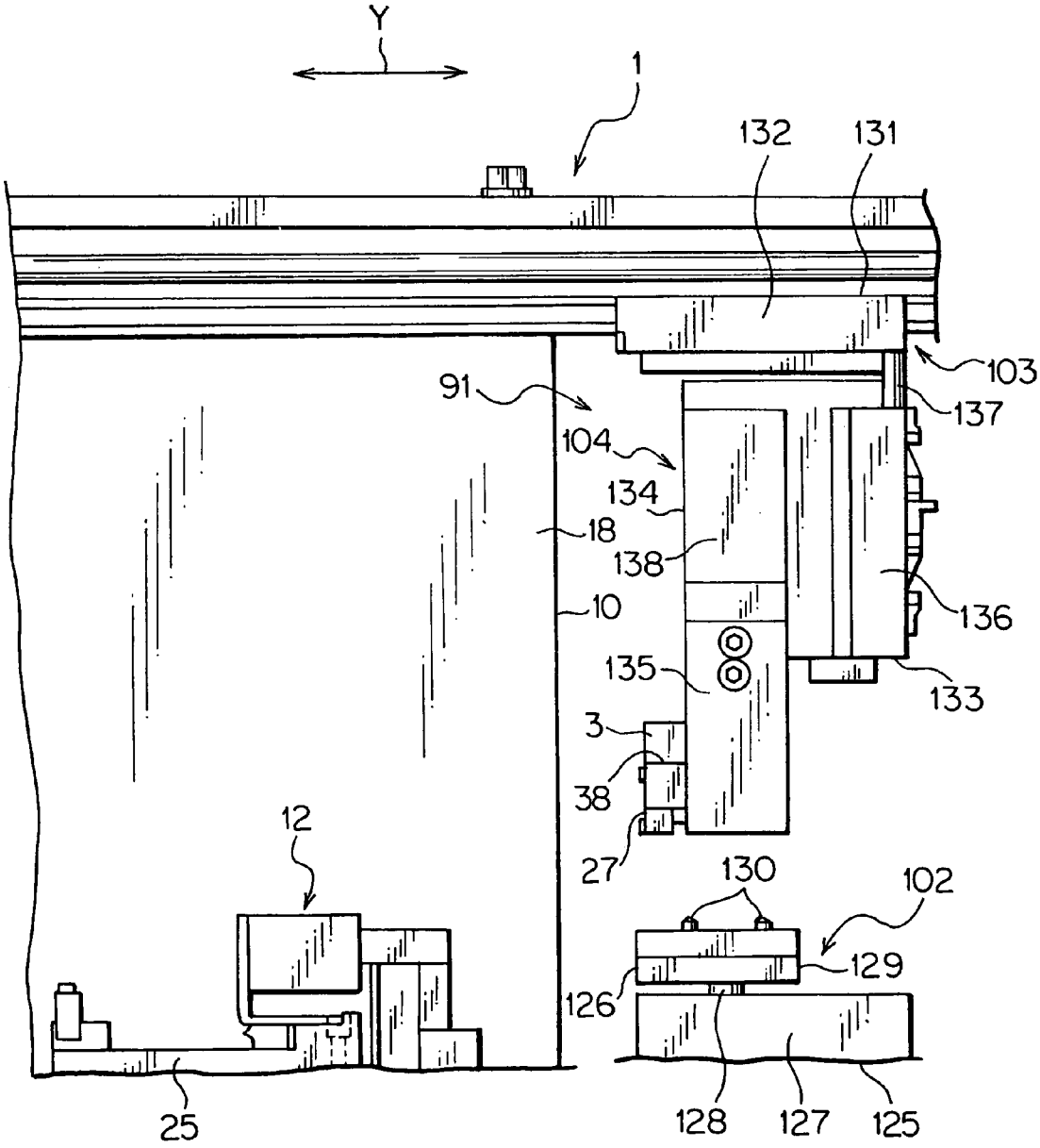
FIG. 25 is a side view illustrating a state when a rod of an elevating cylinder of a jig grasping unit shown in FIG. 24 is contracted.

Thereafter, as shown in FIG. 24, the control device 15 extends the rod 137 of the elevating cylinder 133 of the one jig grasping unit 104. Then, the control device 15 brings the approaching-and-leaving rods 139 of the chuck cylinder 134 close to each other so as to put (i.e. chuck) the holding jig 27 between the pair of the jig chucks 135. Then, as shown in FIG. 25, control device 15 contracts the rod 137 of the elevating cylinder 133 so as to lift the holding jig 27 from the lifting base 126.

Figure 26:
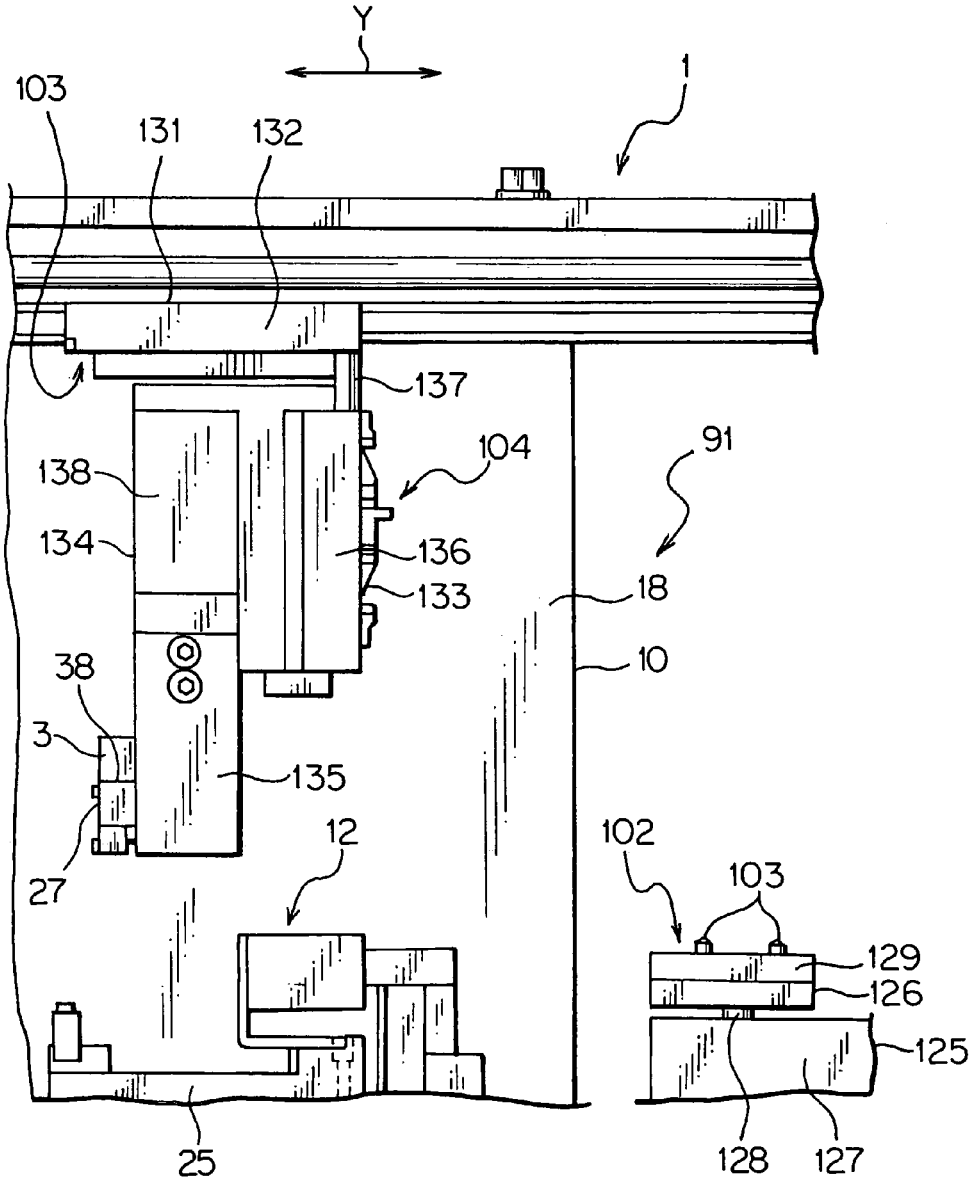
FIG. 26 is a side view illustrating a state when a jig grasping unit shown in FIG. 25 is positioned above a support table of a housing holding unit.

Thereafter, the control device 15 controls both the second slide unit 103 of the jig conveying unit 91 and the horizontal moving unit 23 of the housing holding unit 12 so as to position the holding jig 27 grasped (i.e. chucked) by the one jig grasping unit 104 above the support table 25 of the housing holding unit 12 as shown in FIG. 26.

Figure 27:
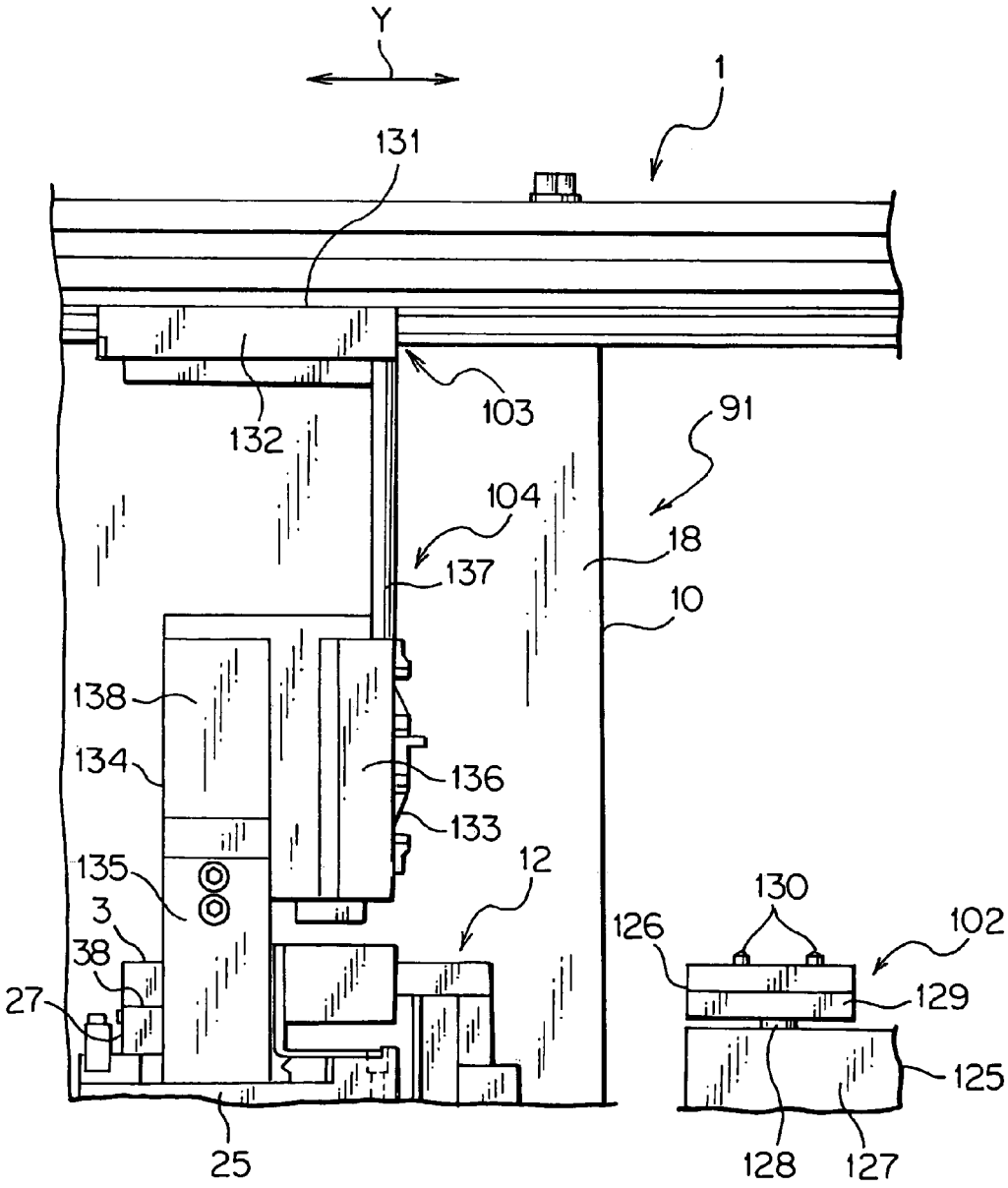
FIG. 27 is a side view illustrating a state when a rod of an elevating cylinder of a jig grasping unit shown in FIG. 26 is extended.
Figure 28:
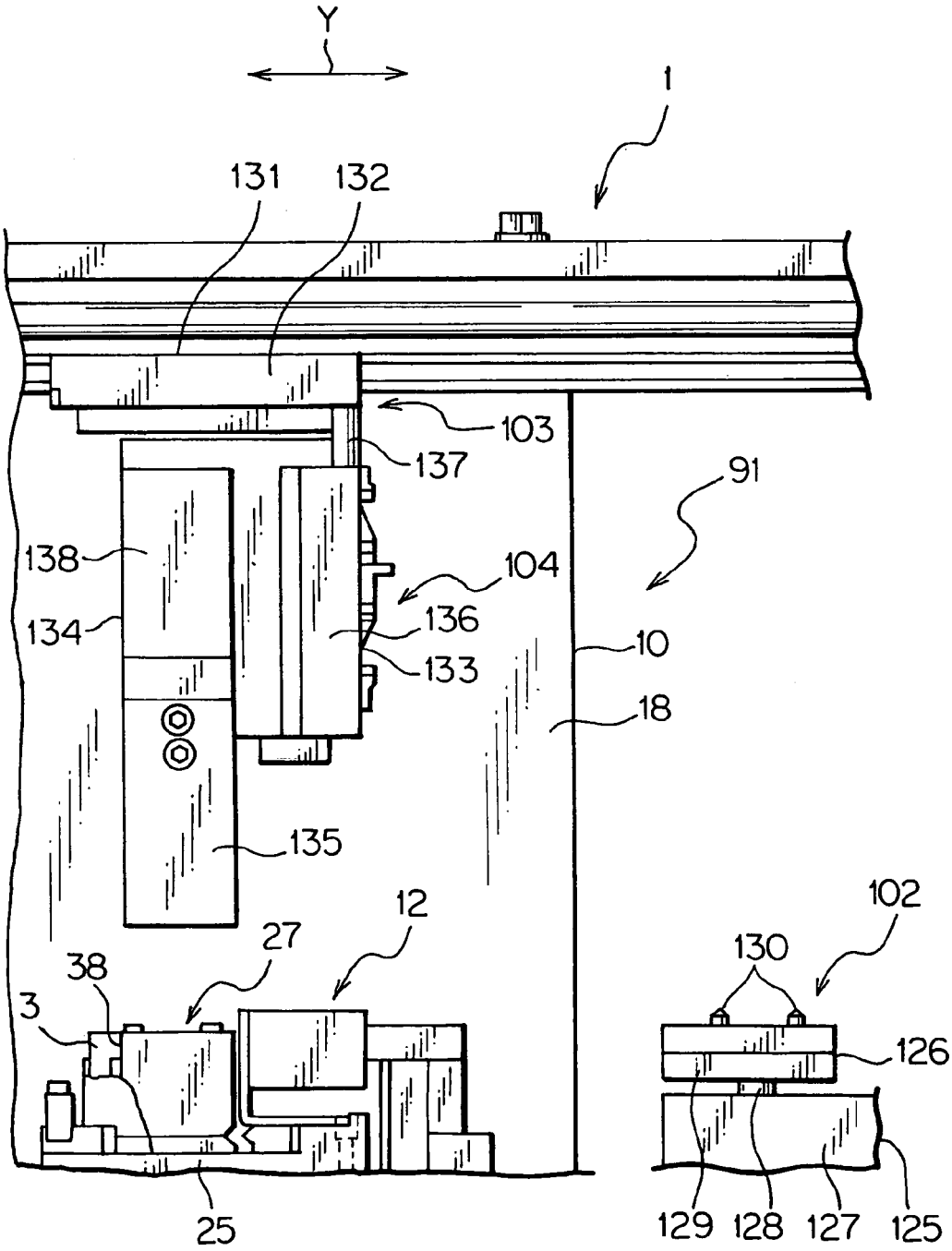
FIG. 28 is a side view illustrating a state when a rod of an elevating cylinder of a jig grasping unit shown in FIG. 27 is contracted.

Then, as shown in FIG. 27, the control device 15 extends the rod 137 of the elevating cylinder 133 of the one jig grasping unit 104 so as to place the holding jig 27 grasped (i.e. chucked) by the one jig grasping unit 104 on the support table 25. Further, the control device 15 parts the approaching-and-leaving rods 139 of the chuck cylinder 134 from each other. As shown in FIG. 28, the control device 15 contracts the rod 137 of the elevating cylinder 133 of the one jig grasping unit 104. Thus, the control device 15 selects one holding jig 27 among a plurality of the holding jigs 27 and conveys the selected holding jig 27 from the jig placing unit 90 to the housing holding unit 12.

Figure 29:
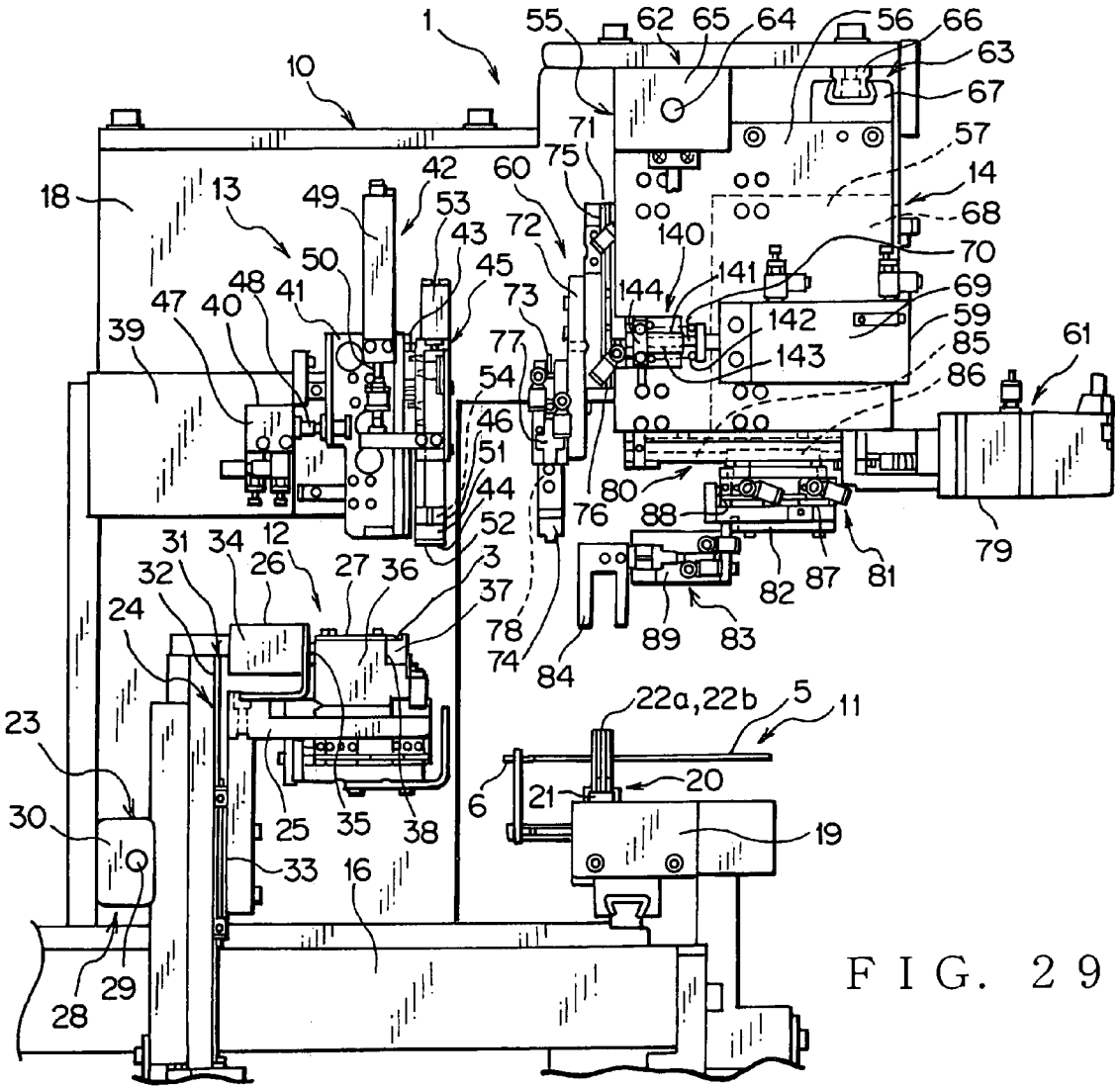
FIG. 29 is a side view illustrating a state when a holding jig is attached to a housing holding unit of the terminal inserting device shown in FIG. 5 and terminal fittings are inserted into the connector housing.

Then, as shown in FIG. 29, the control device 15 lifts the holding jig 27 by the elevating unit 24 of the housing holding unit 12 so as to maintain the holding jig 27 in the coming-off preventing state by the connector fixing cylinder 26. Further, the control device 15 extends the rod 48 of the front-and-rear cylinder 40 and contracts the elevating cylinder 42 and the rod 50 of the guide opening-and-closing part 45.

Further, the control device 15 contracts the elevating cylinder 57 of the inserting unit 14 and the rod 70 of the inserting cylinder 59. The control device 15 contracts the rod 76 of the elevating cylinder 71 of the front chuck unit 60 of the inserting unit 14 and parts the approaching-and-leaving rods 78 of the chuck cylinder 73 from each other. The control device 15 extends the rod 88 of the air cylinder 81 of the electric wire chuck unit 61 of the inserting unit 14 and parts the approaching-and-leaving rods of the chuck cylinder 83 from each other. Further, the control device 15 makes the regulator 145 contract the rod 88 of the air cylinder 81. At that time, the pressure of air in the first room is equal to that in the second room with regard to the terminal fittings 6 having different article numbers from each other.

Then, the control device 15 firstly controls the horizontal moving unit 23 of the housing holding unit 12 so as to position the terminal-receiving chamber 4, to which the terminal fitting 6 is inserted first, 4 below the guide plates 44 and 46 of the guide unit 13. Further, the control device 15 controls the horizontal moving unit 55 of the inserting unit 14 so as to position the front chuck unit 60 of the inserting unit 14 above the terminal fitting 6, which is first inserted into the terminal-receiving chamber 4, and to position the electric wire chuck unit 61 of the inserting unit 14 above the electric wire 5 attached to the terminal fitting 5.

Thereafter, as shown in FIG. 30, the control device 15 extends the rod 50 of the elevating cylinder 42 of the guide unit 13 so as to put the fixing guide plate 44 on an opening of the terminal-receiving chamber 4 of the connector housing 3 held by the holding jig 27. Further, a shown in FIG. 30, the control device 15 extends the rod 76 of the elevating cylinder 71 of the front chuck unit 60 and controls the elevating cylinder 57 of the inserting unit 14 so as to bring the front chuck unit 60 and the electric wire chuck unit 61 close to the terminal fitting 6 and the electric wire 5 held by the electric wire holding unit 11.

At that time, the terminal fitting 6 is located between the pair of the front chucks 74 and the electric wire 5 is located between the pair of the electric wire chucks 84. Then, the control device 15 controls the chuck cylinders 73 and 83 of the chuck units 60 and 61 so as to chuck the electric wire 5 between the front chucks 74 and to chuck the electric wire 5 between the electric wire chucks 84.

Figure 31:
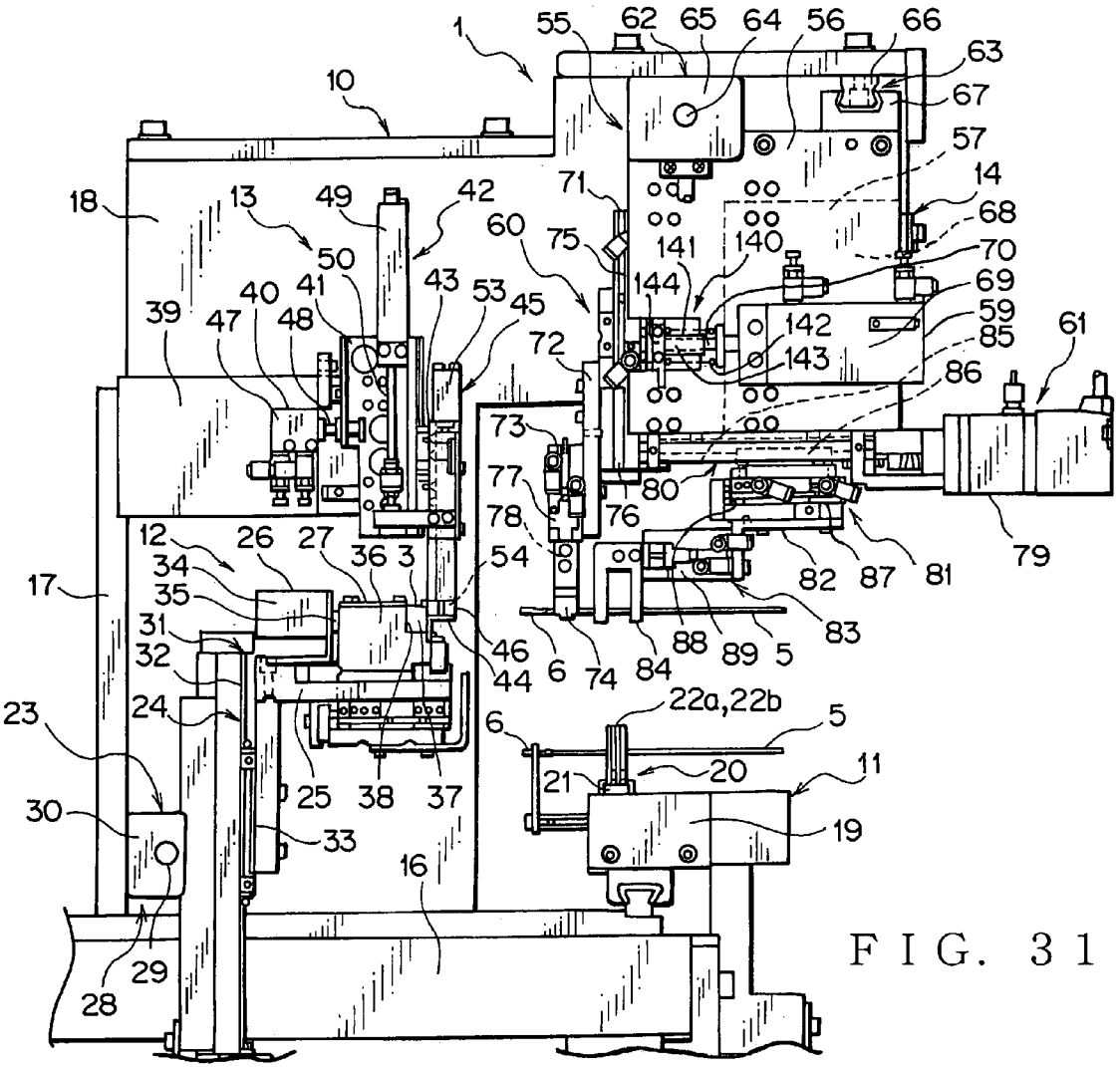
FIG. 31 is a side view illustrating a state when a guide plate adheres to a connector housing from the state shown in FIG. 30 and a chuck unit rises.

Then, as shown in FIG. 31, the control device 15 contracts the rod 48 of the front-and-rear cylinder 40 of the guide unit 13 so as to make the fixing guide plate 44 adhere to the connector housing 3 held by the holding jig 27. Further, the control device 15 controls the guide opening-and-closing part 45 so as to make a lower end of the moving guide plate 46 come in contact with the horizontal part 52 of the fixing guide plate 44.

Further, as shown in FIG. 31, the control device 15 controls the elevating cylinder 57 of the inserting unit 14 so as to lift the chuck units 60 and 61 to take out the chucked electric wire 5 attached to the terminal fitting 6 from the rod 20 of the electric wire holding unit 11. Then, the terminal-receiving chamber 4 of the connector housing 3 held by the holding jig 27 faces the electric wire 5 attached to the terminal fitting 6 chucked by the front chuck unit 60.

Figure 32:
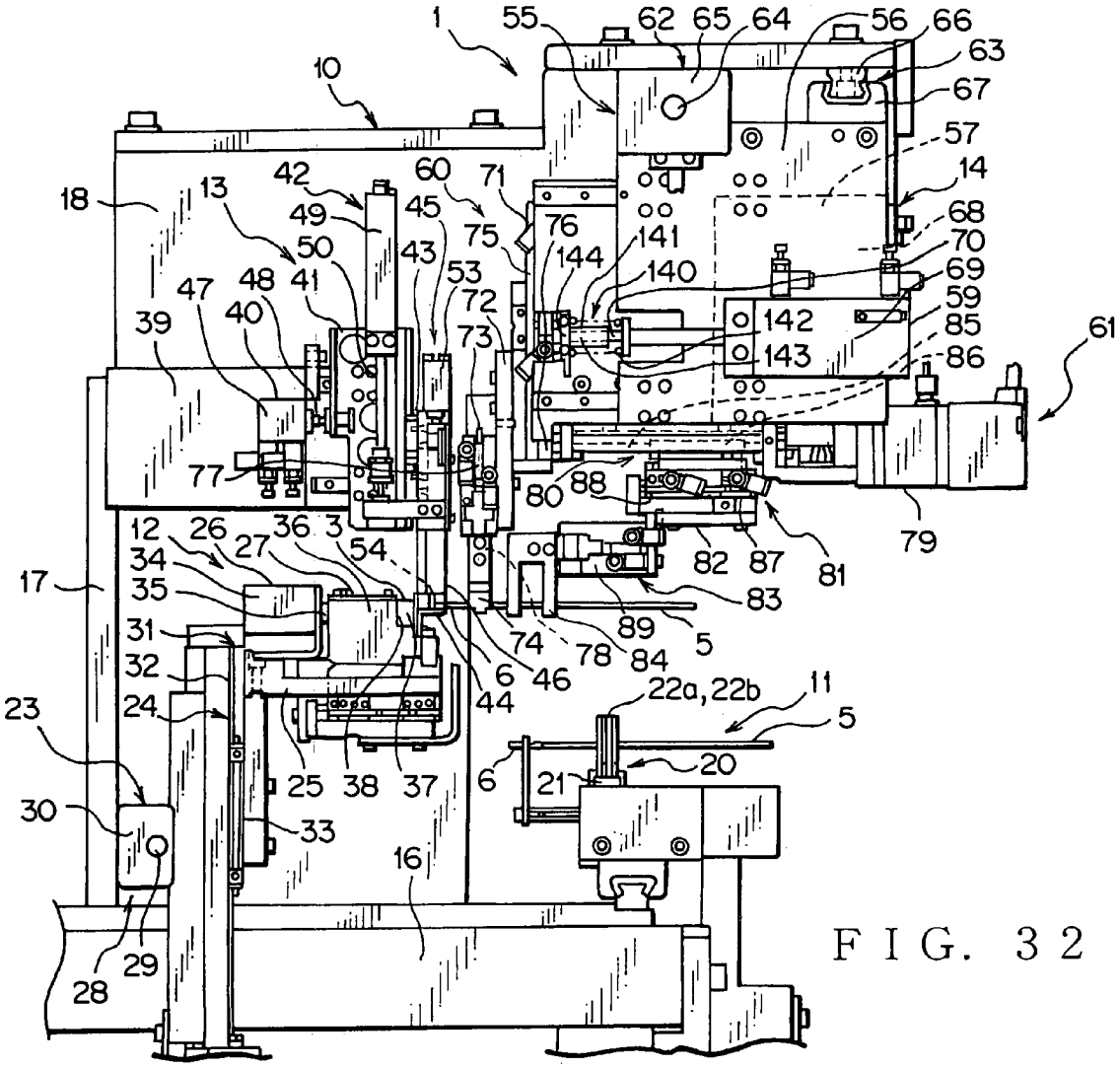
FIG. 32 is a side view illustrating a state when a terminal fitting is inserted into a guide notch of a guide plate from the state shown in FIG. 31.
Figure 33:
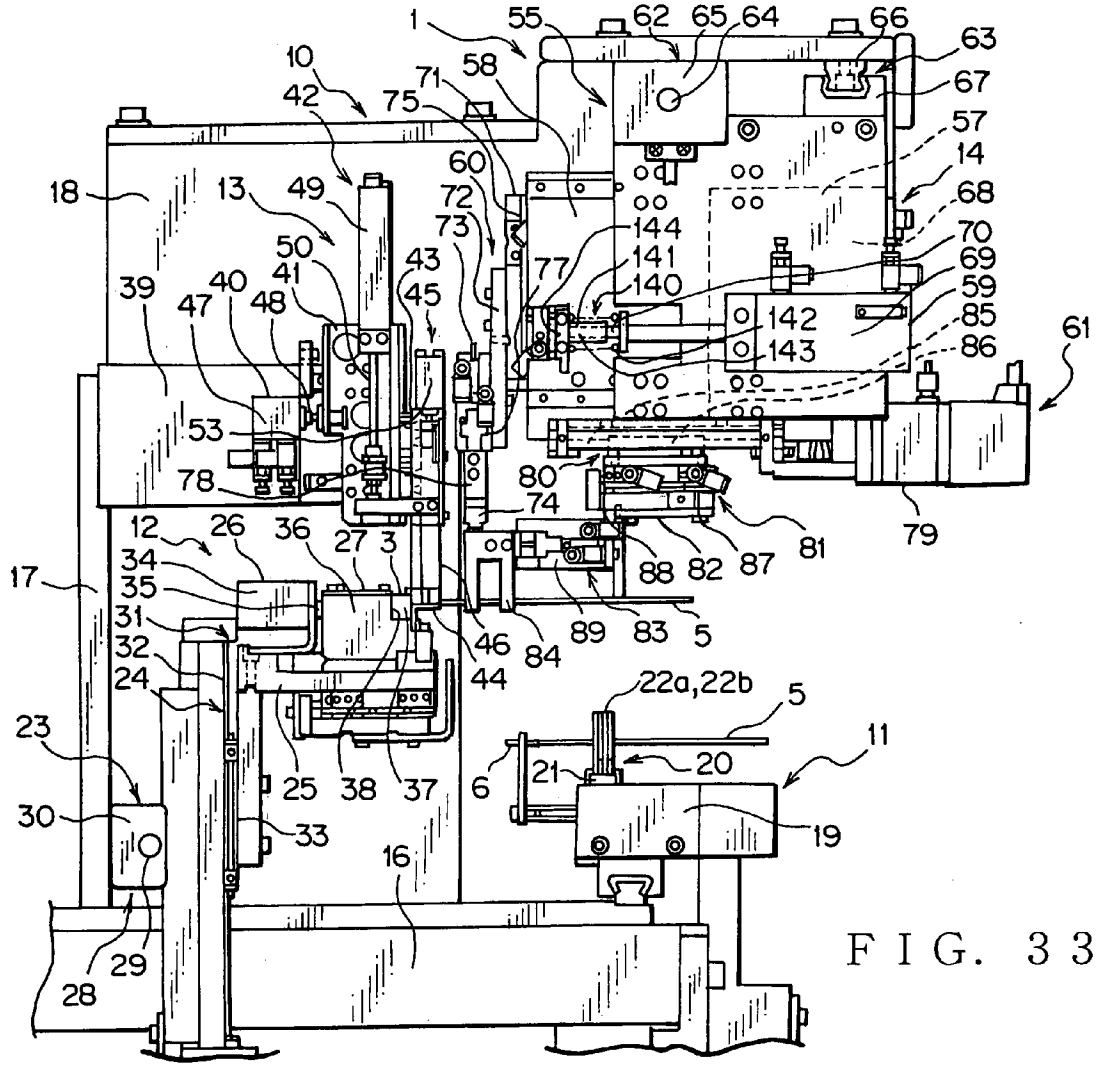
FIG. 33 is a side view illustrating a state when a terminal fitting is inserted into a terminal-receiving chamber of a connector housing from the state shown in FIG. 32.

Then, as shown in FIG. 32, the control device 15 extends the rod 70 of the inserting cylinder 59 of the inserting unit 14 so as to insert the terminal fitting 6 into the guide notch 54 of the moving guide plate 46 of the guide unit 13. Thereafter, as shown in FIG. 33, the control device 15 controls the chuck cylinder 73 of the front chuck unit 60 so as to part the front chuck 74 from the electric wire 5 and controls the elevating cylinder 71 of the front chuck unit 60 so as to lift the front chuck 74 (that is, to retract the front chuck 74 from the terminal fitting 6). Further, the control device 15 controls the inserting motor 79 of the inserting unit 14 so as to insert the terminal fitting 6 into the terminal-receiving chamber 4 of the connector housing 3 held by the holding jig 27.

Figure 34:
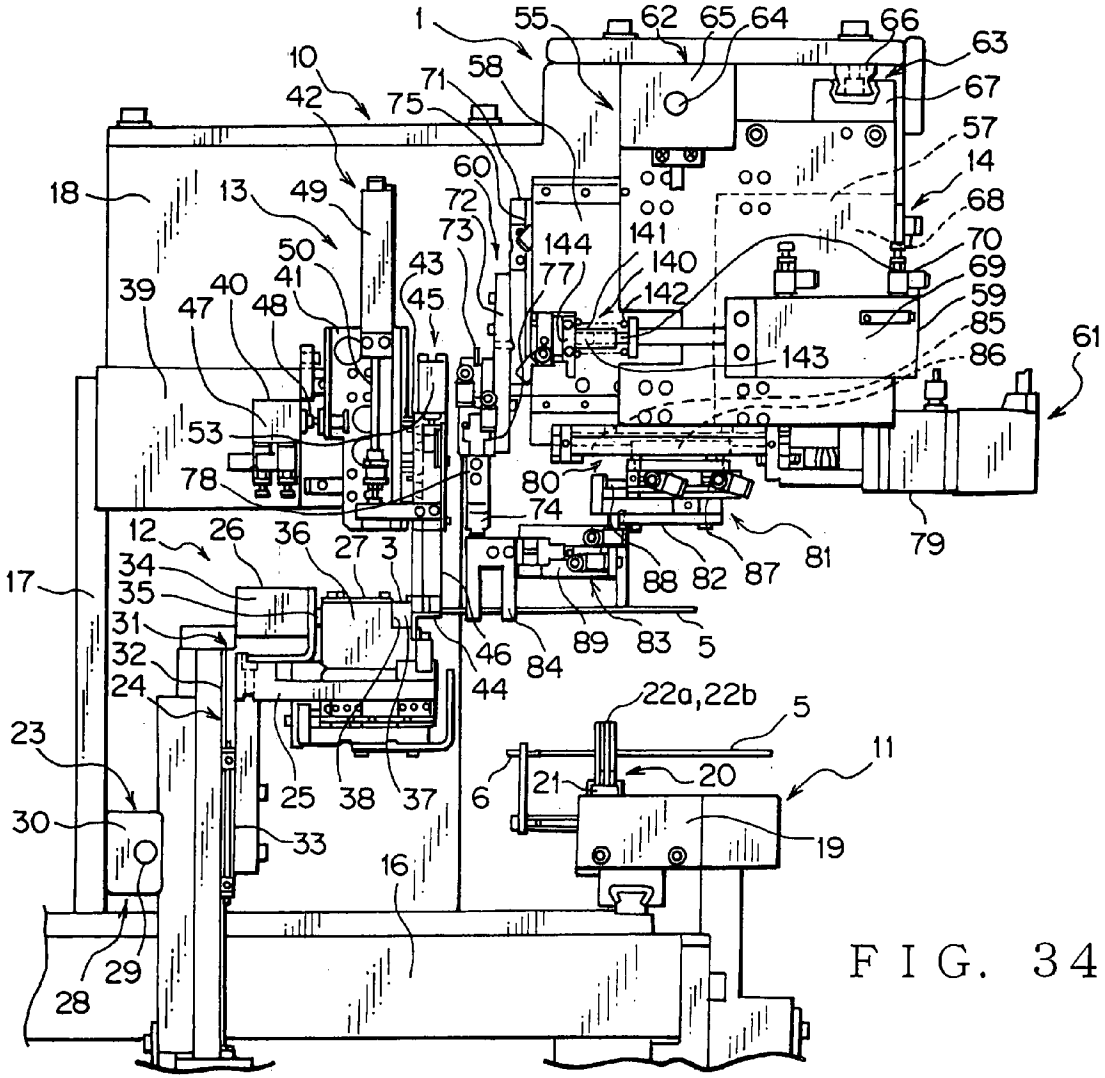
FIG. 34 is a side view illustrating a state when a terminal fitting is pulled from the state shown in FIG. 33.

Then, the control device 15 makes the inserting motor 79 pull the terminal fitting 6 inserted in the terminal-receiving chamber 4 and controls the regulator 145 to extend the rod 88 of the air cylinder 81 with a force predetermined depending on the terminal fitting 6. Then, as shown in FIG. 34, the cylinder body 89 of the air cylinder 81 leaves the connector housing 3 and the rod 88 of the air cylinder 81 extends. Thus, the terminal fitting 6 inserted in the terminal-receiving chamber 4 of the connector housing 3 is pulled so that it is judged whether or not the locking arm engages. That is, the pulling confirmation of the terminal fitting 6 is performed.

Figure 35:
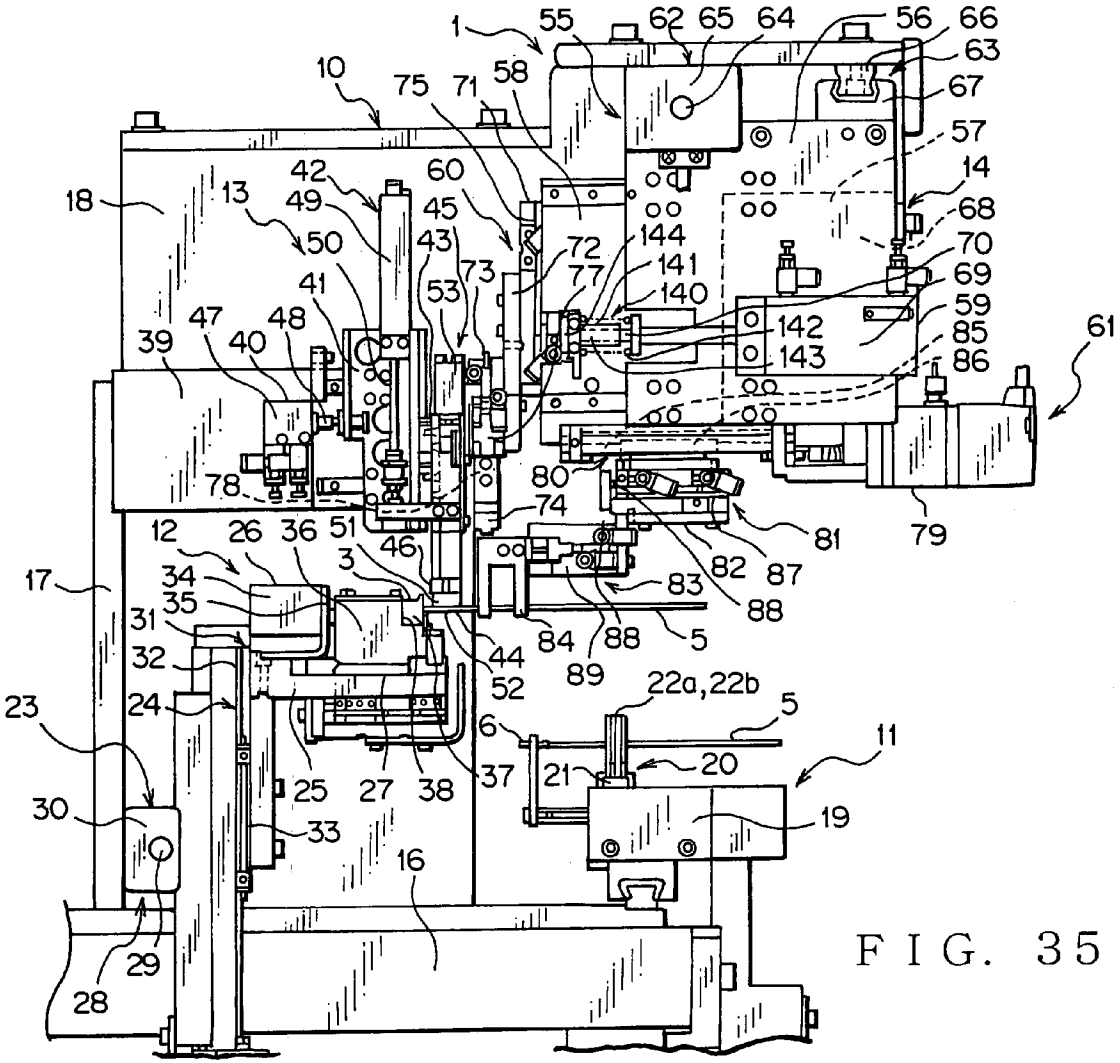
FIG. 35 is a side view illustrating a state when a guide plate is raised from the state shown in FIG. 34 so as to keep the guide plate away from a connector housing.

Thereafter, as shown in FIG. 35, the control device 15 retracts the rod 88 of the air cylinder 81 and brings the cylinder body 89 of the air cylinder 81 close to the connector housing by the inserting motor 79. Further, the control device 15 controls the guide opening-and-closing part 45 of the guide unit 13 so as to lift the moving guide plate 46 and extends the rod 48 of the front-and-rear cylinder 40 so as to part the fixing guide plate 44 from the connector housing 3. Then, the control device 15 controls the horizontal moving unit 23 of the housing holding unit 12 and the horizontal moving unit 55 of the inserting unit 14 so as to integrally move the chuck units 60 and 61 of the inserting unit 14 and the holding jig 27 of the housing holding unit 12 to this side in FIG. 35 while the electric wire chuck 84 maintains to chuck the electric wire 5.

Then, the electric wire 5 comes out from between the horizontal part 52 of the fixing guide plate 44 and the moving guide plate 46. Then, the control device 15 controls the electric wire chuck unit 61 so as to part the electric wire chuck 84 from the electric wire 5. Then, the control device 15 repeats the steps shown in FIGS. 29-35 so as to insert the terminal fittings 6 into the respective terminal-receiving chambers 4 of the connector housing 3 in turn.

Figure 36:
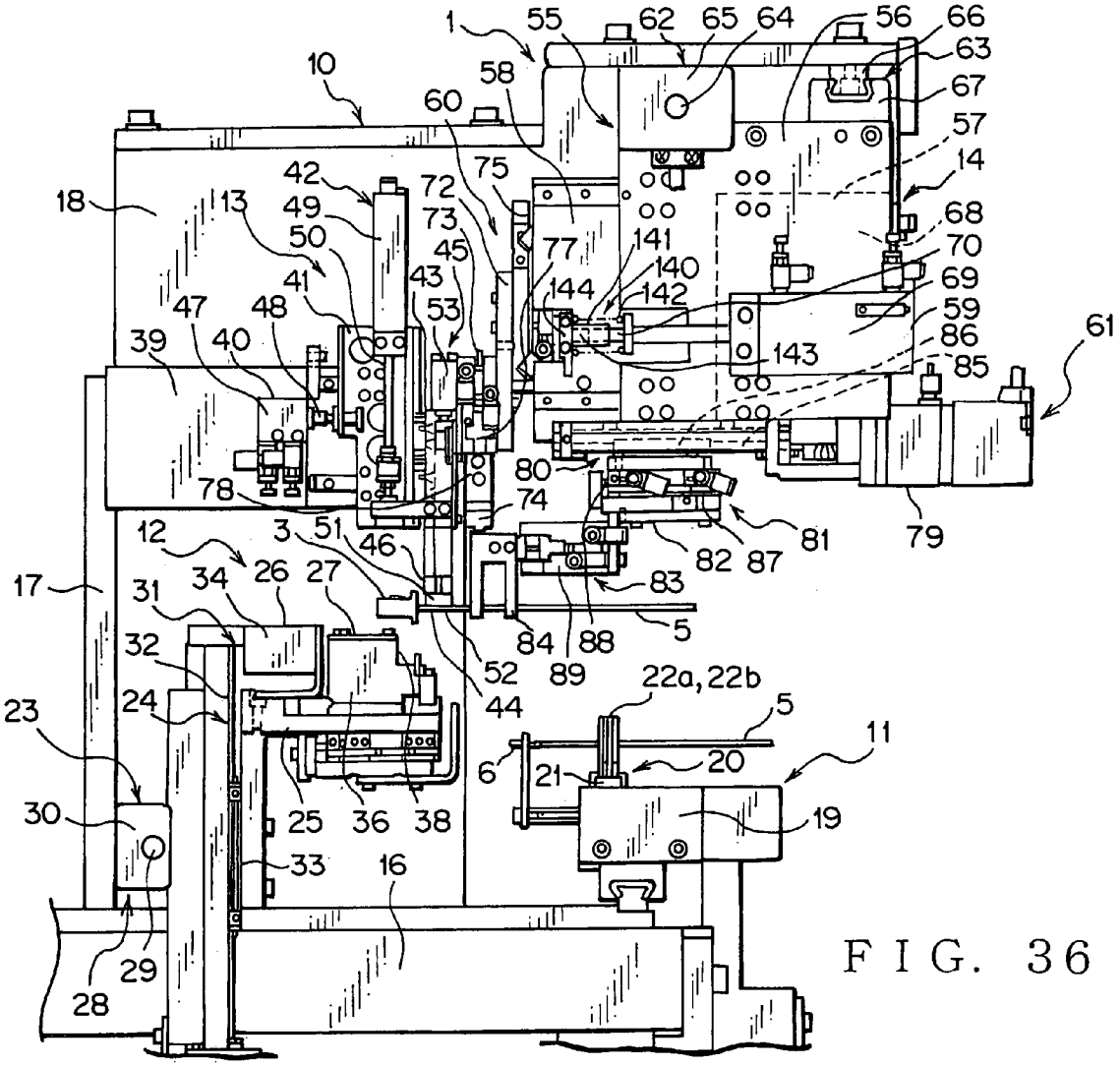
FIG. 36 is a side view illustrating a state when a holding jig falls from the state shown in FIG. 35.

When the insertion of the last terminal fitting 6 is finished, the control device 15 contracts the rod 35 of the connector fixing cylinder 26 of the housing holding unit 12 so as to position the holding jig 27 in the coming-off allowing state. Then, as shown in FIG. 36, while the electric wire chuck unit 61 maintains to chuck the electric wire 5 attached to the terminal fitting 6, which is lastly inserted into the terminal-receiving chamber 4, the control device 15 controls the elevating unit 24 of the housing holding unit 12 so as to put the holding jig 27 down.

Figure 37:
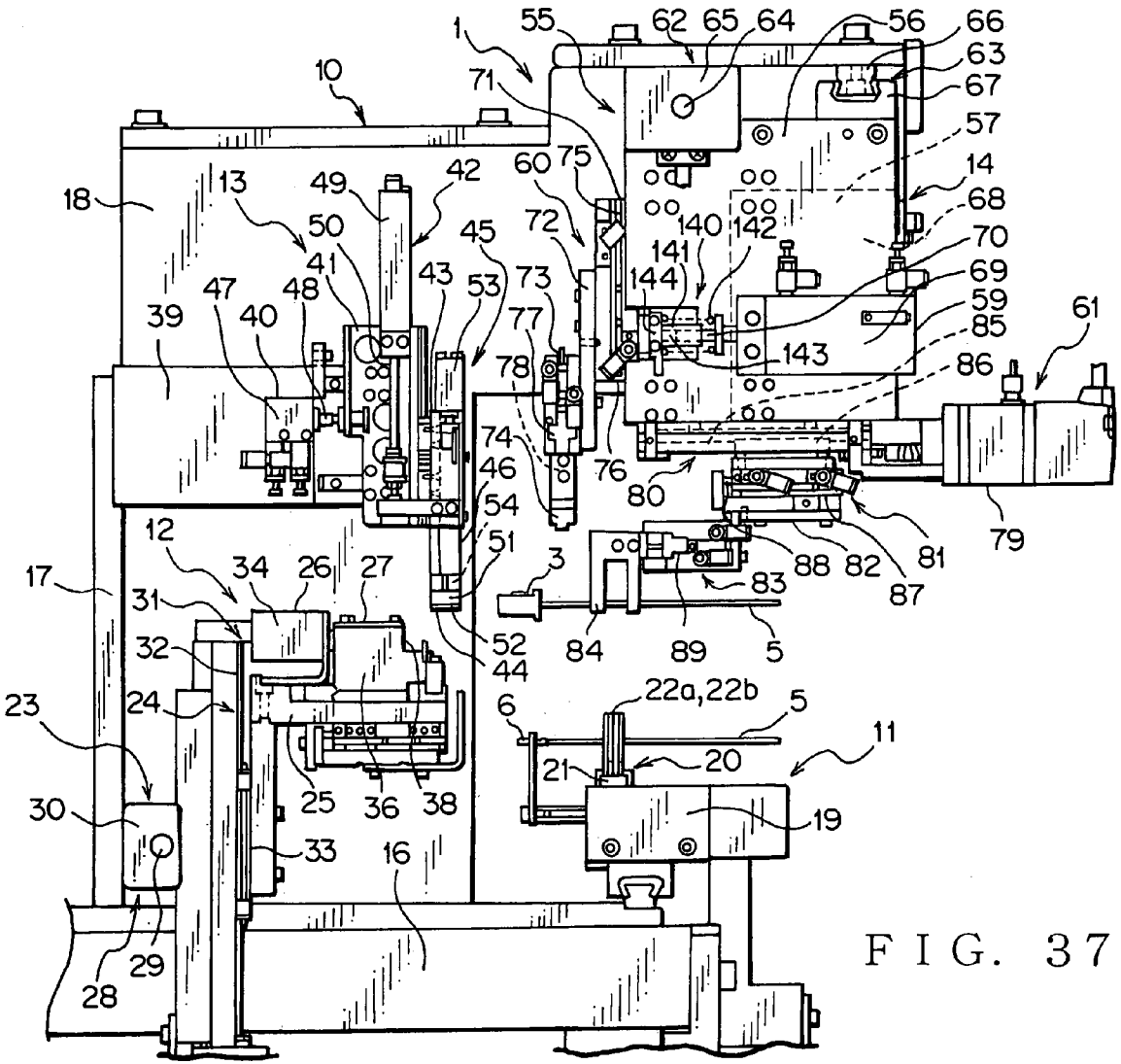
FIG. 37 is a side view illustrating a state when an electric wire is positioned above a rod from the state shown in FIG. 36.
Figure 38:
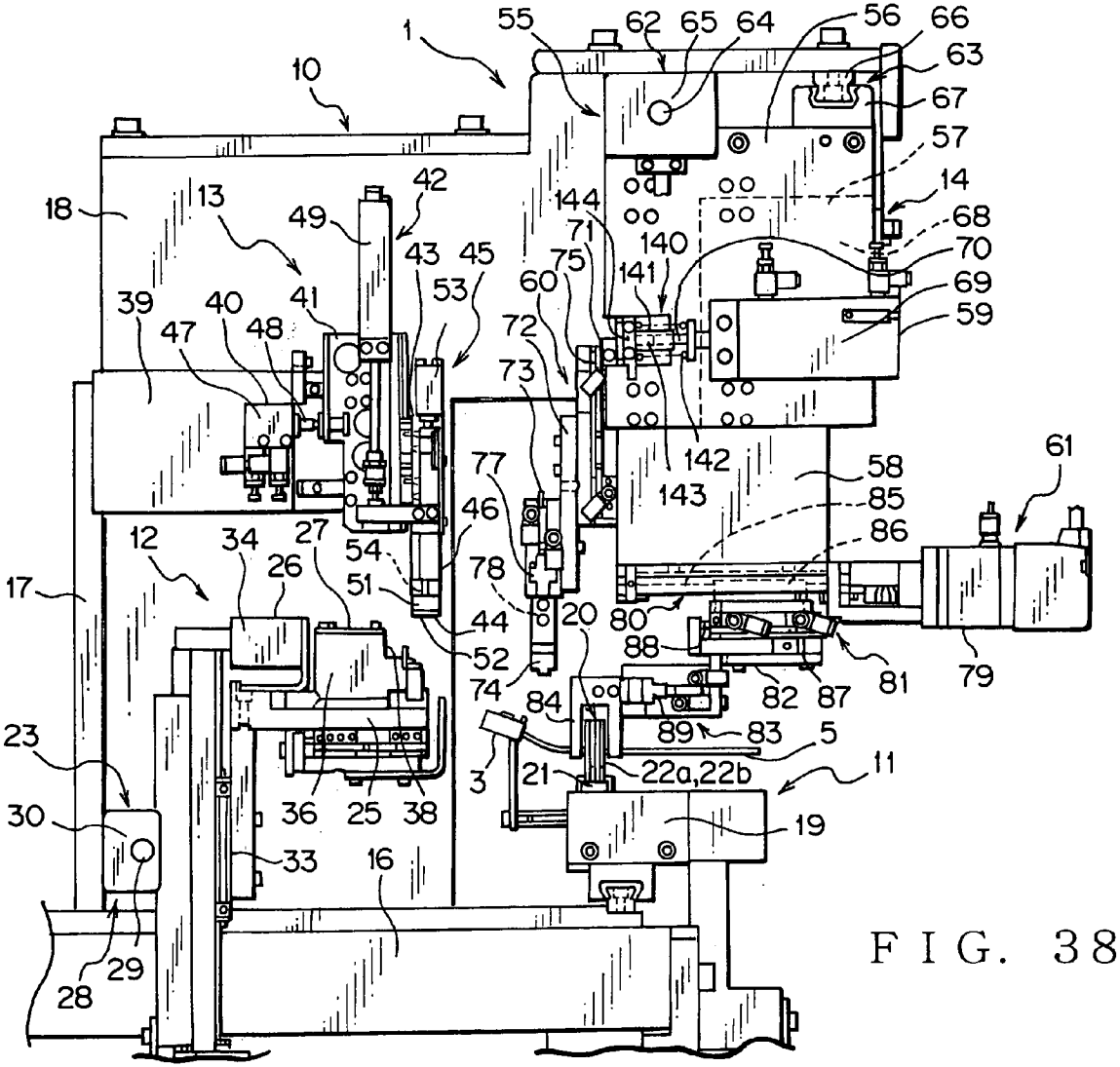
FIG. 38 is a side view illustrating a state when an electric wire attached to a connector housing is held by a rod from the state shown in FIG. 37.

Then, since the electric wire 5 is chucked by the electric wire chuck 84, the connector housing 3 comes out from the holding jig 27. Then, as shown in FIG. 37, the control device 15 controls the horizontal moving unit 55 of the inserting unit 14 so as to position the electric chuck 84 above the nipping members 22*a* and 22*b*, which nips the electric wire 5 attached to the connector housing 3. Then, as shown in FIG. 38, the control device 15 controls the elevating cylinder 57 of the inserting unit 14 to put the electric chuck 84 down and to press-fit the electric wire 5, which is attached to the connector housing 3 and chucked by the electric wire chuck 84, in between the nipping members 22*a* and 22*b*. Thus, the control device 15 makes the electric wire holding unit 11 hold the electric wire 5 attached to the connector housing 3.

In the terminal inserting device 1, while the terminal fitting 6 is inserted into the connector housing 3 held by the holding jig 27 attached to the housing holding unit 12, a holding jig 27 for a connector housing 3 into which the terminal fitting 6 is inserted next is grasped by one jig grasping unit 104. When the insertion of the terminal fittings 6 into one connector housing 3 is finished, a holding jig 27 on a support table 25 of the housing holding unit 12 is conveyed to the jig lifting base 126 by another jig grasping unit 104 and further, conveyed to a predetermined position of the jig placing unit 90 by the jig lifting unit 102. At that time, after the holding jig 27 is conveyed to the jig lifting base 126 by the other jig grasping unit 104, the holding jig 27 grasped by the one jig grasping unit 104 is conveyed to the support table 25 of the housing holding unit 12 by the one jig grasping unit 104.

Figure 39:
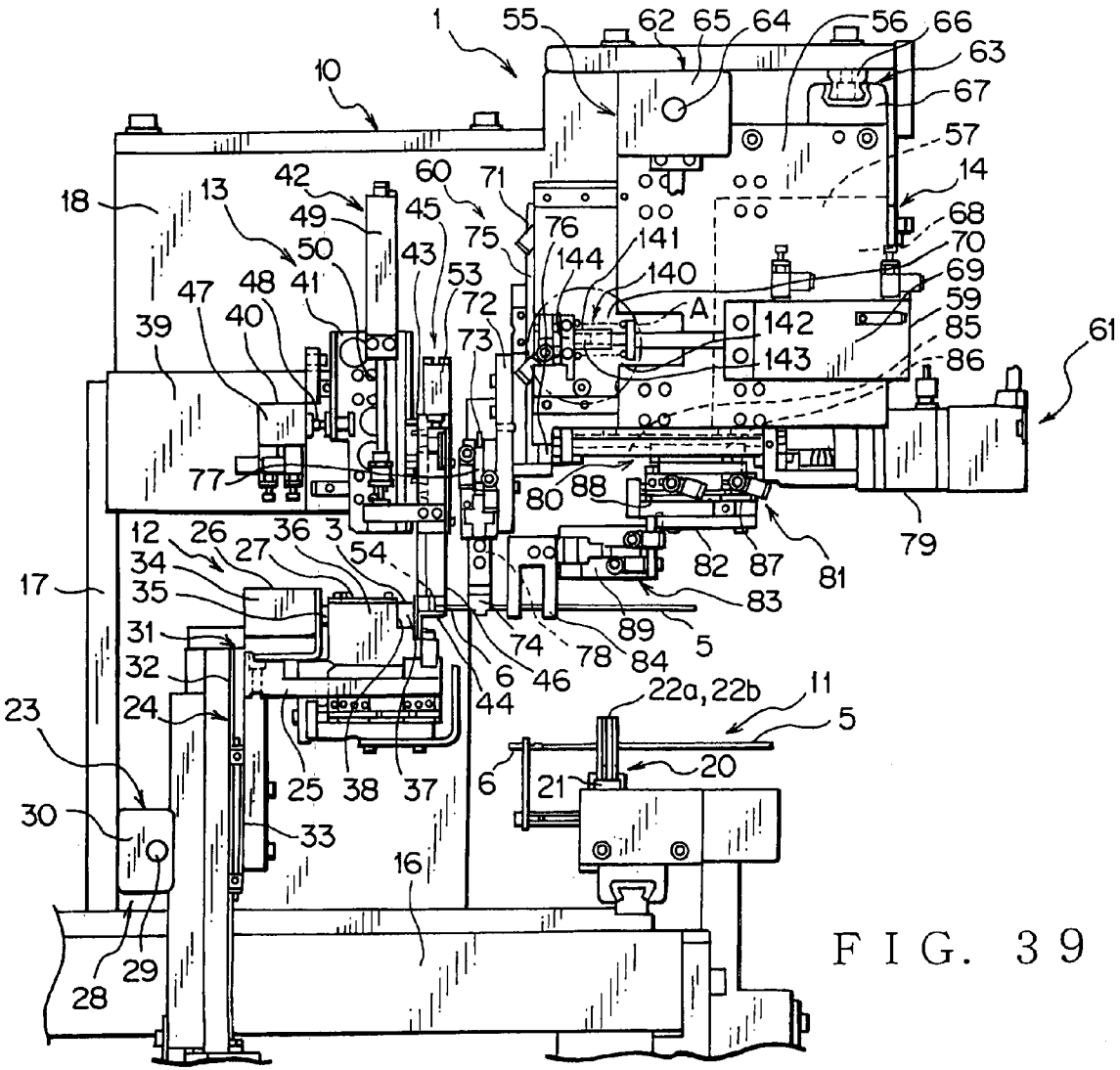
FIG. 39 is a side view illustrating a state when a terminal fitting shown in FIG. 31 abuts against a guide plate.

Further, in the terminal inserting device 1, as shown in FIG. 39, when the terminal fitting 6 to be inserted into the terminal-receiving chamber 4 of the connector housing 3 abuts against the guide plates 44 and 46, a relative position between the damper member 141 of the damper mechanism 140 and the rod 70 of the inserting cylinder 59 is changed from a position shown by the solid lines in FIG. 40 to a position shown by the alternate long and two short dashes lines in FIG. 40. That is, the coil spring 142 contracts against its elastic restoring force. Then, the detecting sensor detects that the coil spring 142 contracts against its elastic restoring force and outputs this to the control device 15. Then, the control device 15 stops an action of the inserting unit 14 for inserting the terminal fitting 6 and makes the display device display this.

According to the preferred embodiment, the terminal inserting device 1 includes the air cylinder 81 that can change the pulling force of the inserting motor 79 for pulling the electric wire 5 and the control device 15 for controlling the air cylinder 81, therefore after the insertion of the terminal fittings 6 the pulling force of the inserting motor 79 for pulling the electric wire 5 can be changed according to the article numbers of the terminal fittings 6.

Since the air cylinder 81 includes the inserting motor 79 and the rod 88, which is retractable from the cylinder body 87 that moves relatively to the connector housing 3 with the inserting motor 79 and biases the electric wire chuck 84 toward the connector housing 3, therefore the electric wire 5 is pulled with a force difference between the pulling force of the inserting motor 79 and the biasing force of the rod 88 toward the connector housing 3. Accordingly, force to pull the electric wire 3 can be finely changed in comparison with a case in which only the pulling force of either the air cylinder 81 or the inserting motor 79 to pull the electric wire 5 is changed and therefore, the force to pull the electric wire 5 can be set close to a desired force.

Since the control device 15 controls the rod 88 to change the biasing force for biasing the electric wire chuck 84, therefore the force for pulling the electric wire 5 can be securely changed. Since the air cylinder 81 change the biasing force of the rod 88 for biasing the electric wire chuck 84, therefore the force to pull the electric wire 5 can be changed with a simple and inexpensive construction and the electric wire 5 can be pulled with a desired force.

Further, since the terminal inserting device 1 includes the damper mechanism 140 described above, therefore the terminal fitting 6 is prevented from buckling.

The jig conveying unit 91 conveys one holding jig 27 among a plurality of the holding jigs 27 held by the jig placing unit 90 to the support table 25 of the housing holding unit 12. The inserting unit 14 inserts the terminal fitting 6 into the connector housing 3 held by the conveyed holding jig 27. Therefore, the electric wire 5 is not necessarily longer than a distance between the holding jigs 27. That is, the terminal inserting device 1 does not limit a wiring harness to be assembled.

The jig conveying unit 91 includes the jig lifting unit 102 to lift one holding jig 27 from the jig placing unit 90. Therefore, in comparison with a case in which the holding jig 27 is grasped with approaching the holding jig 27 from above the jig placing unit 90, a distance between the holding jigs 27 in the jig placing unit 90 can be small. Therefore, the terminal inserting device 1 can be made small.

The jig conveying unit 91 includes the jig grasping unit 104, which is movable along the arrow Y as the second direction and grasps one holding jig 27 lifted by the jig lifting unit 102. Therefore, the holding jig 27 can be securely conveyed from the jig placing unit 90 to the support table 25 of the jig lifting unit 102. Since the jig grasping unit 104 is movable along the arrow Y as the second direction and is not movable along the arrow X as the first direction, the terminal inserting device 1 can be made small in comparison with a case in which the jig grasping unit 104 is set movable along the arrow X as the first direction.

Since the terminal inserting device 1 includes a pair of the jig grasping units 104, therefore one jig grasping unit 104 can conveys a holding jig 27 from the jig lifting unit 102 to the support table 25 of the housing holding unit 12, while another jig grasping unit 104 can conveys a holding jig 27 from the support table 25 of the housing holding unit 12 to the jig lifting unit 102. Therefore, a time period required to perform the work can be shortened.

After the inserting unit 14 inserts the last terminal fitting 6, the inserting unit 14 makes the electric wire holding unit 11 hold the electric wire 5 attached to the terminal fitting 6 while maintaining to grasp the electric wire 5 attached to the terminal fitting 5, therefore the worker has no necessity to make the electric wire holding unit 11 hold the connector housing 3 into which the terminal fitting 6 is inserted by his hand. Therefore, the efficiency of the work can be improved and the connector housing 3, to which the terminal fittings 6 are attached, can be attached to a precise position of the rod 20 of the electric wire holding unit 11.

After the inserting unit 14 inserts the last terminal fitting 6, the holding jig 27 comes down, therefore the connector housing 3 can be securely taken out from the holding jig 27. Therefore, the inserting unit 14 can securely make the electric wire holding unit 11 hold the connector housing 3.

After the inserting unit 14 inserts the last terminal fitting 6, the connector fixing cylinder 26 displaces the holding jig 27 in a coming-off allowing state, therefore the connector housing 3 can be securely taken out from the holding jig 27. Therefore, the inserting unit 14 can securely make the electric wire holding unit 11 hold the connector housing 3.

When the inserting unit 14 inserts the terminal fitting 6, the connector fixing cylinder 26 positions the holding jig 27 in a coming-off preventing state, therefore the connector housing 3 can be prevented from abruptly coming off from the holding jig 27. Therefore, the terminal fitting 6 can be securely inserted into the terminal-receiving chamber 4 of the connector housing 3.

In the preferred embodiment described above, an air cylinder 81 is used as the changing means. However, instead, the changing means may be a hydraulic cylinder driven by oil as the pressurized fluid or a motor. In the preferred embodiment described above, the air cylinder 81 is controlled by controlling the pressure in the first room. However, instead, the air cylinder 81 may be controlled by controlling the pressure in the second room or by controlling the pressure in both the first and second rooms.

In the preferred embodiment described above, the force to pull the terminal fitting 6 is set changeable by using the inserting motor 79 and the air cylinder 81. However, instead, the force to pull the terminal fitting 6 may be set changeable by controlling torque of the inserting motor 79 with the control device 15. In this case, the inserting motor 79 acts as both the pulling means and the changing means.

That is, a construction of the pulling means and the changing means can be modified within the scope of the present invention.

In the preferred embodiment described above, the jig conveying unit 91 of the terminal inserting device 1 includes both the jig lifting unit 102 and the jig grasping unit 104. However, instead, the jig conveying unit 91 may include at least one of the jig lifting unit 102 and the jig grasping unit 104.

For example, in a case that the jig conveying unit 91 includes only the jig lifting unit 102, the amount of extension of the rod 124 of the slide cylinder 121 and a shape of the housing holding unit 12 may be changed appropriately. In a case that the jig conveying unit 91 includes only the jig grasping unit 104, the jig grasping unit 104 may be set movable along both the arrow X and the arrow Y. Further, a known robot arm may be used as the jig conveying means.

In the preferred embodiment described above, a pair of the jig grasping units 104 of the jig lifting unit 102 is provided. However, instead, three or more jig grasping units 104 of the jig lifting unit 102 may be provided.

The aforementioned preferred embodiments are described to aid in understanding the present invention and variations may be made by one skilled in the art without departing from the spirit and scope of the present invention.

What is claimed is:

1. A terminal inserting device for inserting terminal fittings attached to electric wires into terminal-receiving chambers of a connector housing, comprising:

terminal inserting means for inserting the terminal fitting attached to one of said electric wires into one of the terminal-receiving chambers of the connector housing;

electric wire holding means for holding the electric wire, the electric wire holding means being movable together with the terminal inserting means;

pulling means for pulling the electric wire after the terminal inserting means inserts the terminal fitting in the terminal-receiving chamber;

changing means, separate from the pulling means, for changing a pulling force with which the pulling means pulls the electric wire to result in a difference force between the pulling force of the pulling means and an extending force of the changing means; and control means for controlling the changing means to change the pulling force according to the type of the terminal fittings.

2. A terminal inserting device for inserting terminal fittings attached to electric wires into terminal-receiving chambers of a connector housing, comprising:

terminal inserting means for inserting the terminal fitting attached to one of said electric wires into one of the terminal-receiving chambers of the connector housing;

electric wire holding means for holding the electric wire, the electric wire holding means being movable together with the terminal inserting means;

pulling means for pulling the electric wire after the terminal inserting means inserts the terminal fitting in the terminal-receiving chamber;

changing means for changing a pulling force with which the pulling means pulls the electric wire to result in a difference force between the pulling force of the pulling means and an extending force of the changing means; and control means for controlling the changing means to change the pulling force according to the type of the terminal fittings, wherein the changing means includes:

a body which leaves the connector housing when the pulling means pulls the electric wire; and a retractable member which is retractable from the body toward the connector housing, attaches the electric wire holding means thereto, and changes biasing force for biasing the electric wire holding means toward the connector housing, and the control means controls the retractable member to change the biasing force according to the type of the terminal fittings.

3. The device according to claim 2, wherein pressurized fluid is supplied into the body of the changing means and pressure of the pressurized fluid is changed so that the retractable member changes the biasing force.

4. The device according to claim 3, wherein the pressurized fluid is air.

* * * * *